US009517629B2

(12) United States Patent
Kuno et al.

(10) Patent No.: US 9,517,629 B2
(45) Date of Patent: Dec. 13, 2016

(54) LIQUID DISCHARGE APPARATUS WITH WIPER CLEANER

(71) Applicant: Brother Kogyo Kabushiki Kaisha, Nagoya-shi, Aichi-ken (JP)

(72) Inventors: Daisuke Kuno, Nagoya (JP); Rie Higuchi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/870,372

(22) Filed: Sep. 30, 2015

(65) Prior Publication Data

US 2016/0089888 A1 Mar. 31, 2016

(30) Foreign Application Priority Data

Sep. 30, 2014 (JP) ..... 2014-202443
Sep. 30, 2014 (JP) ..... 2014-202544
Sep. 30, 2014 (JP) ..... 2014-202545
Sep. 30, 2014 (JP) ..... 2014-202546

(51) Int. Cl.
*B41J 2/165* (2006.01)

(52) U.S. Cl.
CPC ..... *B41J 2/16541* (2013.01); *B41J 2/16538* (2013.01)

(58) Field of Classification Search
CPC ..... B41J 2/16541; B41J 2/16538
See application file for complete search history.

(56) References Cited

U.S. PATENT DOCUMENTS 5,606,354 A 2/1997 Bekki et al.
2002/0163552 A1* 11/2002 Takahashi ..... B41J 2/16544 347/33
2005/0088480 A1* 4/2005 Wouters ..... B41J 2/16538 347/33
2005/0146554 A1 7/2005 Asanuma et al.
2007/0159508 A1* 7/2007 Yamamoto ..... B41J 2/16535 347/33
2013/0222474 A1* 8/2013 Williamson ..... B41J 2/16538 347/33

FOREIGN PATENT DOCUMENTS

JP H04-278358 10/1992
JP H07-17045 1/1995
JP H10-217490 8/1998
JP 2002-307698 10/2002
JP 2004-188611 7/2004
JP 2006-247999 9/2006
JP 4570865 10/2010

* cited by examiner

*Primary Examiner* — Bradley Thies
(74) *Attorney, Agent, or Firm* — Frommer Lawrence & Haug LLP

(57) ABSTRACT

There is provided a liquid discharge apparatus, including: a liquid discharge head; a wiper; a wiper cleaner cleaning a liquid adhering to a first surface of the wiper and including a first contact part, which makes contact with the first surface of the wiper, and a second contact part, which is disposed to face the first contact part and makes contact with the second surface of the wiper; a movement mechanism moving the wiper and the wiper cleaner relative to each other, and a space expansion part expanding a space between the first contact part and the second contact part.

20 Claims, 59 Drawing Sheets

SCANNING DIRECTION

LEFT ⟷ RIGHT (FRONT-REAR DIRECTION)

⊗

LIQUID DISCHARGE APPARATUS WITH WIPER CLEANER

CROSS REFERENCE TO RELATED APPLICATION

The present application claims priorities from Japanese Patent Application Nos. 2014-202443, 2014-202544, 2014-202545, and 2014-202546 filed on Sep. 30, 2014, the disclosures of which are incorporated herein by reference in its entirety.

BACKGROUND

Field of the Invention

The present teaching relates to a liquid discharge apparatus which discharges liquid.

Description of the Related Art

As a liquid discharge apparatus which discharges liquid onto a discharge target medium from liquid discharge ports formed on a liquid discharge surface of a liquid discharge head, there is known an ink-jet printer which performs printing on a recording sheet by discharging ink from an ink-jet head. The ink-jet printer wipes off foreign matters, such as ink adhering to an ink discharge surface, with a wiper made of rubber and the like. For example, the ink-jet printer may include a wiper cleaner being made of sponge and the like and having a slit to allow the wiper to pass therethrough, in order to remove the ink and the like which adhered to the wiper through the wiping of the ink and the like on the ink discharge surface. In this case, the wiper cleaner may be accommodated in a box-shaped support member in a state that an upper part of the wiper cleaner is compressed.

SUMMARY

The above ink-jet printer, however, has the following problems. Namely, since the wiper has flexibility, when the wiper is inserted into the slit of the wiper cleaner, the front end of the wiper may be caught by an entrance of the slit to bend and deform the wiper. This prevents the wiper from passing through the slit smoothly, and further the wiper or the wiper cleaner is liable to get damaged.

Further, the upper part of the wiper cleaner is practically undeformable, because the wiper cleaner is accommodated in the support member with the upper part of the wiper clear compressed. Thus, when the wiper having flexibility is inserted into the slit of the wiper cleaner, the wiper may be caught or scratched by the slit. This prevents the wiper from passing through the slit smoothly. If the slit is made to have larger width so as to allow the wiper to pass through the slit smoothly, cleaning accuracy will be reduced.

Furthermore, the front end of the wiper is more flexible than any other part of the wiper. Thus, when the wiper is inserted into the slit of the wiper cleaner, the front end of the wiper may be caught or scratched by the entrance of the slit of the wiper cleaner. This prevents the wiper from passing through the slit smoothly, and the wiper or the wiper cleaner is liable to get damaged.

An object of the present teaching is to provide a liquid discharge apparatus in which a wiper is easily inserted into a slit of a wiper clear.

Another object of the present teaching is to provide a liquid discharge apparatus in which a wiper can pass through a slit of a wiper cleaner smoothly without reducing cleaning accuracy of the wiper.

According to a first aspect of the present teaching, there is provided a liquid discharge apparatus configured to discharge a liquid, including:

a liquid discharge head having a liquid discharge surface formed with liquid discharge ports from which the liquid is discharged;

a wiper configured to move relative to the liquid discharge head in a first direction, the wiper including a first surface and a second surface, and the wiper being configured to wipe the liquid discharge surface with the first surface;

a wiper cleaner configured to clean the liquid adhering to the first surface of the wiper and including a first contact part, which is configured to make contact with the first surface of the wiper, and a second contact part, which is disposed to face the first contact part and is configured to make contact with the second surface of the wiper;

a movement mechanism configured to move the wiper and the wiper cleaner relative to each other in a third direction, which intersects with the first direction and a second direction orthogonal to the liquid discharge surface; and a space expansion part configured to expand a space between the first contact part and the second contact part. The space expansion part is configured to move integrally with the wiper relative to the wiper cleaner; the space expansion part is disposed on at least one side, of the wiper, in the third direction; the space expansion part has rigidity higher than that of the wiper; and the space expansion part is configured to be inserted first into the space between the first contact part and the second contact part to expand the space, in the case that the wiper and the wiper cleaner move relative to each other in the third direction.

Regarding the above configuration, for example, the space expansion part is inserted first into the space between the first contact part and the second contact part to expand the space in the case that the wiper and the wiper cleaner move relative to each other in the third direction. This allows the wiper to be inserted into the space which is being expanded by the space expansion part. Thus, the wiper is prevented from being caught by the wiper cleaner and is allowed to be inserted into the space smoothly as compared to a case in which the wiper is inserted into the space which is not being expanded.

According to a second aspect of the present teaching, there is provided a liquid discharge apparatus configured to discharge a liquid, including:

a liquid discharge head having a liquid discharge surface formed with liquid discharge ports from which the liquid is discharged;

a wiper configured to move relative to the liquid discharge head in a first direction, including a first surface and a second surface, and configured to wipe the liquid discharge surface with the first surface;

a wiper cleaner configured to clean the liquid adhering to the first surface of the wiper and including a first contact part, which is configured to make contact with the first surface of the wiper, and a second contact part, which is disposed to face the first contact part and is configured to make contact with the second surface of the wiper; and a movement mechanism configured to move the wiper and the wiper cleaner relative to each other in a third direction, which intersects with the first direction and a second direction orthogonal to the liquid discharge surface, wherein a part of the wiper is less likely to be bent than any other part of the wiper; and the wiper is configured such that the part which is less likely to be bent is inserted first into the space between the first contact part and the second contact part to expand the space, in the case that the wiper and the wiper cleaner move relative to each other in the third direction.

An end, of the wiper, on at least one side in the third direction may have rigidity higher than that of any other part of the wiper, and the wiper may be configured so that the end on the at least one side in the third direction is inserted first into the space between the first contact part and the second contact part to expand the space, in the case that the wiper and the wiper cleaner move relative to each other in the third direction. Further, the wiper may include an upper end on a side close to the liquid discharge surface, a terminal end which is farthest from the upper end in the second direction perpendicular to the liquid discharge surface, and an intermediate part between the upper end and the terminal end; and the wiper may be configured so that the intermediate part is inserted first into the space between the first contact part and the second contact part in the case that the wiper and the wiper cleaner move relative to each other in the third direction.

Regarding the former configuration, for example, the end, of the wiper, which is on the at least one side in the third direction and has high rigidity, is inserted first into the space between the first contact part and the second contact part to expand the space in the case that the wiper and the wiper cleaner move relative to each other in the third direction. This allows any other part of the wiper to be inserted into the space which is being expanded by the end on the at least one side in the third direction. Thus, any other part, of the wiper, having low rigidity is prevented from being caught by the wiper cleaner, thereby allowing the wiper to be inserted into the space smoothly. Regarding the latter configuration, for example, the intermediate part of the wiper is inserted first into the space of the wiper cleaner. Since a distance from the wiper holder to the intermediate part is shorter than a distance from the wiper holder to the upper end, the intermediate part is less likely to be bent. Thus, the wiper is prevented from being caught by the wiper cleaner and is allowed to be inserted into the space easily.

According to a third aspect of the present teaching, there is provided a liquid discharge apparatus configured to discharge a liquid, including:

a liquid discharge head having a liquid discharge surface formed with liquid discharge ports from which the liquid is discharged;

a wiper configured to move relative to the liquid discharge head in a first direction, the wiper including a first surface and a second surface, and the wiper being configured to wipe the liquid discharge surface with the first surface;

a wiper cleaner configured to clean the liquid adhering to the first surface of the wiper and including a first contact part, which is configured to make contact with the first surface of the wiper, and a second contact part, which is disposed to face the first contact part and is configured to make contact with the second surface of the wiper;

a movement mechanism configured to move the wiper and the wiper cleaner relative to each other in a third direction, which intersects with the first direction and a second direction orthogonal to the liquid discharge surface; and an assist mechanism configured to reduce deformation of the wiper in a case that the wiper is inserted into a space between the first contact part and the second contact part, thereby allowing the wiper to pass through the space easily.

The wiper may include an upper end on a side close to the liquid discharge surface and a terminal end on a side opposite to the upper end in the second direction perpendicular to the liquid discharge surface. The assist mechanism may be a wiper guide being disposed on at least one side of the wiper cleaner in the third direction and having a distance from the wiper cleaner which is less than a length of the wiper in the third direction. The wiper guide may include a first guide piece facing the first surface of the wiper and a second guide piece facing the second surface of the wiper, and may be configured to be positioned on both sides of the wiper so as to regulate deformation of the wiper in the case that the wiper is inserted into the space between the first contact part and the second contact part.

In this configuration, the wiper disposed between the first guide piece and the second guide piece is inserted into the space of the wiper cleaner. Thus, even when the wiper is caught by the wiper cleaner, the wiper guide regulates the bending and deformation of the wiper. This allows the wiper to be inserted into the space of the wiper cleaner easily.

DESCRIPTION OF THE EMBODIMENTS

<First Embodiment>

Figure 1:
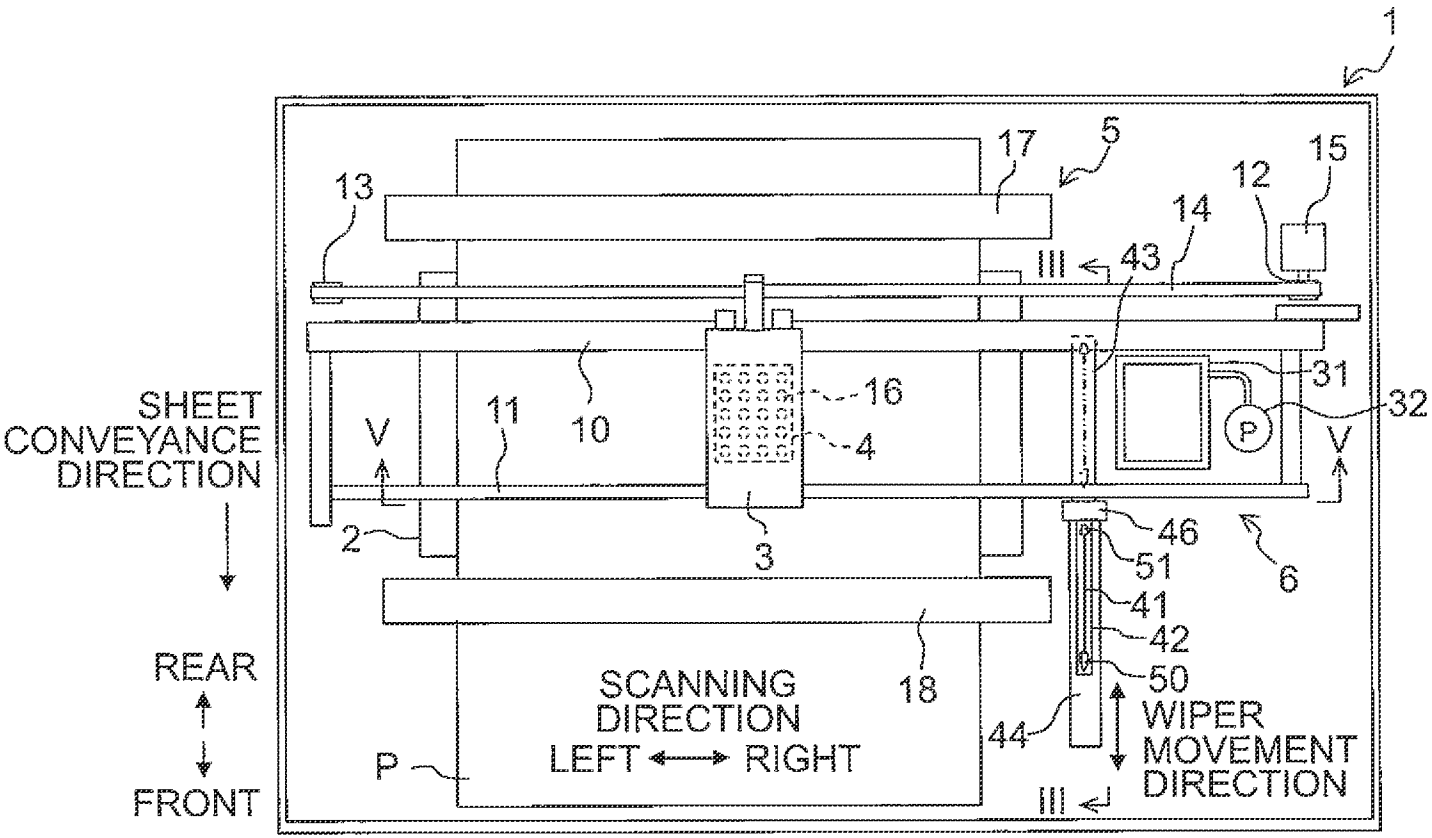
FIG. 1 is a schematic plan view depicting an ink-jet printer according to a first embodiment of the present teaching.

Next, an explanation will be made about the first embodiment of the present teaching. FIG. 1 is a schematic plan view depicting an ink-jet printer according to the first embodiment. In the following, the frontward direction (front side), the rearward direction (rear side), the leftward direction (left side), and the rightward direction (right side) are defined as indicated in FIG. 1, and the direction perpendicular to the paper surface of FIG. 1 is defined as the up-down direction. These definitions are appropriately used in the following description.

As depicted in FIG. 1, an ink-jet printer 1 (a liquid discharge apparatus of the present teaching) includes a platen 2 on which a recording sheet P is placed, a carriage 3 which is reciprocatively movable in a scanning direction (left-right direction) parallel to the platen 2, an ink-jet head 4 (a liquid discharge head of the present teaching) which is carried on the carriage 3, a conveyance mechanism 5 which conveys the recording sheet P in a sheet conveyance direction (frontward direction) perpendicular to the scanning direction, a maintenance unit 6 which performs various maintenance operations to maintain and recover the liquid discharge performance of the ink-jet head 4, a control unit 7 (see FIG. 2) which is in charge of control of the entire parts of components of the ink-jet printer 1, and the like.

The recording sheet P supplied from an unillustrated paper feed mechanism is placed on the upper surface of the platen 2. Two guide rails 10, 11 extending parallel to the scanning direction (left-right direction) are provided over or above the platen 2. The carriage 3 is configured to be reciprocatively movable in the scanning direction along two guide rails 10, 11 within an area facing the platen 2. Further, two guide rails 10, 11 extend to a position (maintenance position) on the right side of the platen 2 in the scanning direction (left-right direction). The carriage 3 is configured to be movable from an area (recording area), which faces the recording sheet P on the platen 2, to the maintenance position as a non-recording area. Further, an endless belt 14 wound and applied between two pulleys 12, 13 is connected to the carriage 3. When the endless belt 14 is driven to travel by a carriage drive motor 15, the carriage 3 moves, in the scanning direction, accompanying with the travel of the endless belt 14.

The ink-jet head 4 is installed to a lower part of the carriage 3. Ink Discharge ports 16 are formed on the lower surface (ink discharge surface 4*a*), of the ink-jet head 4, which is parallel to the upper surface of the platen 2. The ink discharge surface 4*a* is covered with a water-repellent film (not depicted). Ink is discharged from the ink discharge ports 16 of the ink discharge surface 4*a* toward the recording sheet P placed on the platen 2. The conveyance mechanism 5 has two conveyance rollers 17, 18 which are disposed to interpose the platen 2 in the sheet conveyance direction. The recording sheet P placed on the platen 2 is conveyed in the sheet conveyance direction (frontward direction) by the aid of two conveyance rollers 17, 18. The ink-jet printer 1 prints a desired image, letters, and the like on the recording sheet P by jetting the ink to the recording sheet P placed on the platen 2 from the ink-jet head 4, which reciprocatively moves in the scanning direction (left-right direction) together with the carriage 3, while conveying the recording sheet P in the sheet conveyance direction (frontward direction) by the aid of two transport rollers 17, 18.

The maintenance unit 6 is disposed at the maintenance position, which is on the right side of the recording area of the ink-jet head 4 in the scanning direction (left-right direction). In order to remove any foreign matters, bubbles, and the like, mixed in the ink-jet head 4, the maintenance unit 6 performs a suction purge for sucking and discharging the ink from the ink discharge ports 16 and the wiping of ink adhering to the ink discharge surface 4*a*, when the ink-jet head 4 and the carriage 3 are positioned in the maintenance position. This makes it possible to maintain and recover the ink discharge performance of the ink-jet head 4. The maintenance unit 6 includes a wiper 41, a wiper cleaner 46, a suction cap 31, a suction pump 32, and the like.

Figure 5A:
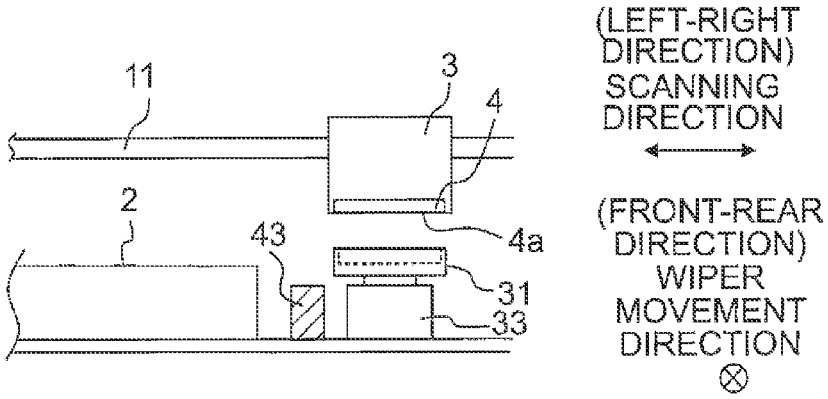
FIGS. 5A to 5D are illustrative views each illustrating an operation of a maintenance unit according to the first embodiment.
Figure 5B:
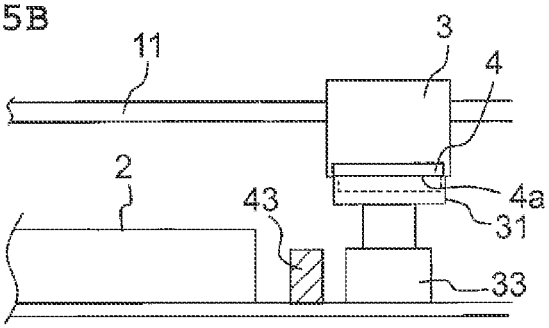

When the ink-jet head 4 is in the maintenance position, the suction cap 31 is positioned to face the ink discharge surface 4*a* of the ink-jet head 4. As depicted in FIGS. 5A and 5B, the suction cap 31 is driven by a cap lifting mechanism 33 in the up-down direction, and the cap lifting mechanism 33 is driven by a cap lifting motor 24 (see FIG. 2). The suction cap 31 is connected to the suction pump 32. FIGS. 5A to 5D are cross sectional views taken along the line V-V in FIG. 1.

When the suction cap 31 is driven to move upward by the cap lifting mechanism 33 in a state that the ink-jet head 4 is in the maintenance position, the suction cap 31 is brought in tight contact with the ink discharge surface 4*a* of the ink-jet head 4 to cover the ink discharge ports 16. In this situation, when the suction pump 32 connected to the suction cap 31 is driven, the pressure in the suction cap 31 is reduced. Thus, the ink in the ink-jet head 4 is sucked from the ink discharge ports 16 and discharged into the suction cap 31 (suction purge).

Figure 3:
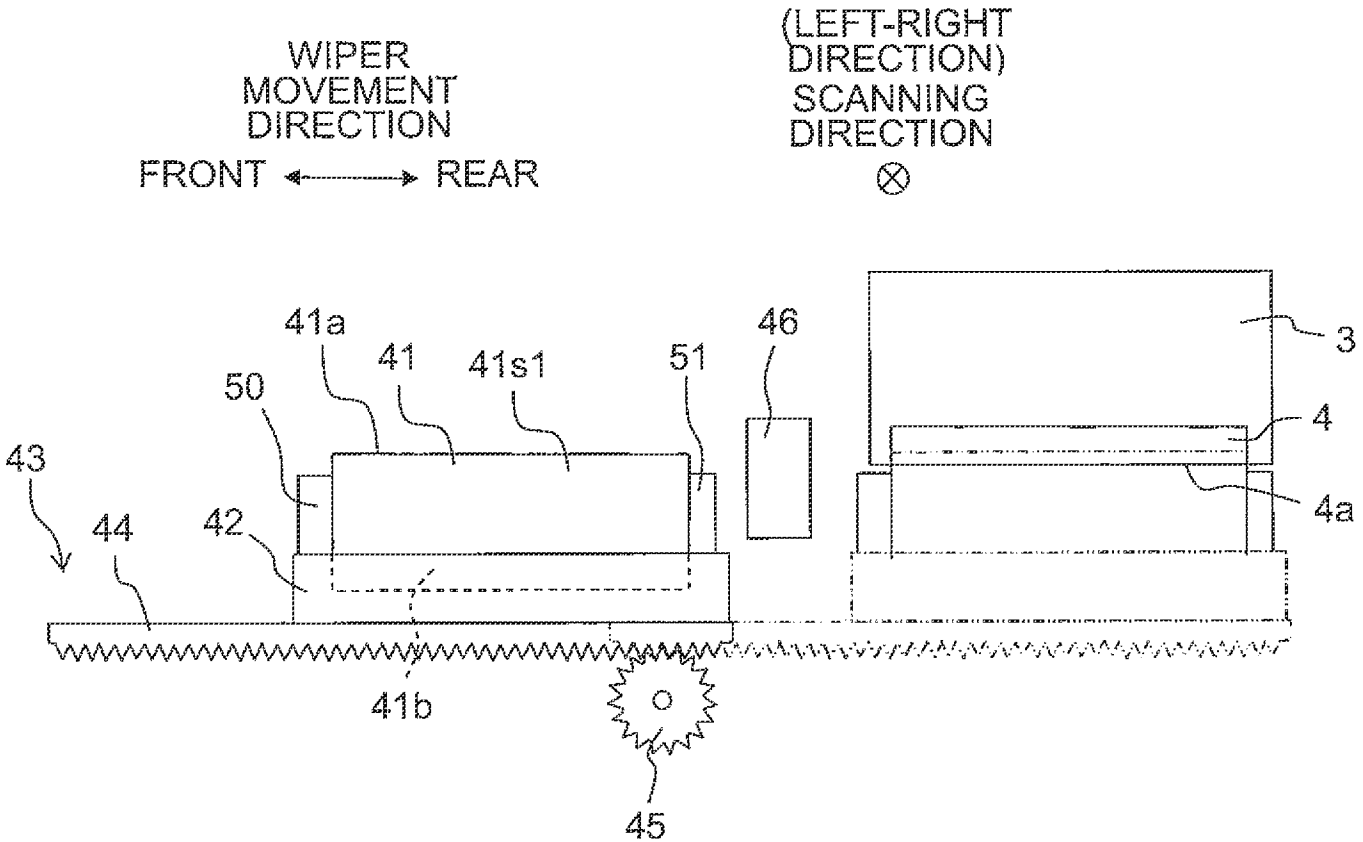
FIG. 3 is a view taken along the arrow III-III in FIG. 1.

The wiper 41 is a flat plate member made of flexible material such as rubber and synthetic resin. As depicted in FIGS. 3 and 4B, the wiper 41 is disposed to be orthogonal to the scanning direction (left-right direction) in a state that a lower end 41*b* (an end of the present teaching) thereof is held by a wiper holder 42. The wiper 41 is formed in a rectangular shape, and an upper end 41*a* of the wiper 41 extends parallel to the ink discharge surface 4*a* in a front-rear direction.

The wiper 41 is reciprocatively and linearly driven by means of a wiper movement mechanism 43 in a direction (hereinafter referred to as "wiper movement direction") parallel to the ink discharge surface 4*a* and orthogonal to the scanning direction. The wiper 41 is driven between a wiping position and a waiting position. The wiping position is on the movement path of the carriage 3 in the scanning direction (indicated by alternate long and two short dashes line in FIG. 1 and FIG. 3). The waiting position is on the front side of the wiping position (indicated by solid line in FIG. 1 and FIG. 3). The wiper movement mechanism 43 includes a rack 44 attached to the wiper holder 42, a pinion 45 engaging with the rack 44, and a wiper drive motor 25 which drives and rotates the pinion 45. The wiper movement mechanism 43 may have any other structure than the above.

Figure 5C:
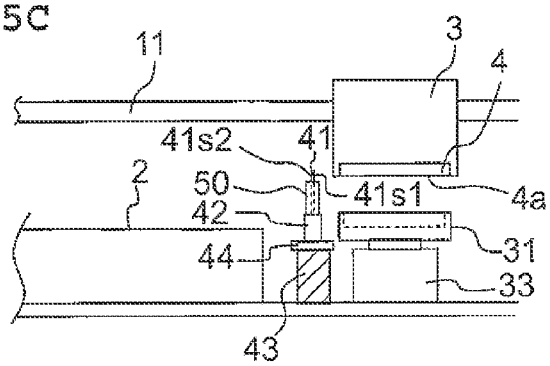
Figure 5D:
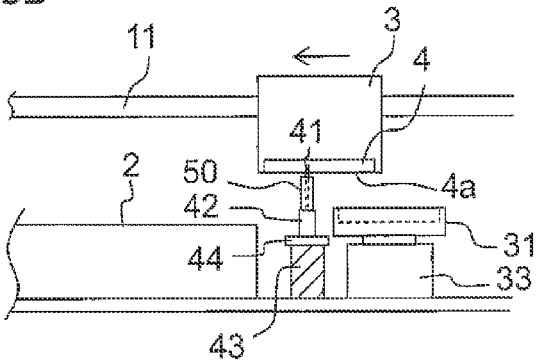

The upper end 41*a* of the wiper 41 is positioned above the ink discharge surface 4*a*. As depicted in FIG. 5C and FIG. 5D, when the ink-jet head 4 in the maintenance position moves in the scanning direction (in particular, leftward) with the wiper 41 being in the wiping position, the ink adhering to the ink discharge surface 4*a* of the ink-jet head 4 is wiped with a right surface 41*s*1 (a first surface of the present teaching) of the wiper 41. The ink wiped is more likely to adhere to the right surface 41*s*1 of the wiper 41, and is less likely to adhere to a left surface 41*s*2 (a second surface of the present teaching). The length of the wiper 41 in the front-rear direction is substantially the same as or longer than the length of the ink discharge surface 4*a* in the front-rear direction. The wiper 41 can wipe the entire ink discharge surface 4*a* during a single wiping operation.

The wiper 41 is thin, of which entire thickness is, for example, about 1 mm. The upper end of the wiper 41 is in a tapered shape. This allows the wiper 41 to bend easily when the wiper 41 makes contact with the ink discharge surface 4*a*, and thereby making it possible to wipe off the ink on the ink discharge surface 4*a* reliably. When the restoring force or resilience, by which the wiper 41 in the bent state is restored to a normal state, is great, the force, which is transmitted from the wiper 41 to the water-repellent film covering the ink discharge surface 4*a*, is also great. In the first embodiment, however, since the wiper 41 has the thickness of approximately 1 mm, the resilience is relatively small. This reduces the force transmitting from the wiper 41 to the water-repellent film, and thereby making it possible to prevent the water-repellent film from peeling off.

The wiper holder 42 includes two space expansion parts 50, 51 which are disposed on the front and rear sides of the wiper 41 respectively. The space expansion part 50 is disposed near the front end of the wiper 41 but does not make contact therewith. The space expansion part 51 is disposed near the rear end of the wiper 41 but does not make contact therewith. The two space expansion parts 50, 51 are made of, for example, synthetic resin. The space expansion parts 50, 51 have the rigidity higher than that of the wiper 41. The lengths of the space expansion parts 50, 51 in the scanning direction (left-right direction) are longer than the thickness of the wiper 41. The lengths of the space expansion parts 50, 51 in the up-down direction are shorter than the length, of the wiper 41, ranging from the upper surface of the wiper holder 42 to the upper end 41*a* (ranging from the lower end 41*b* to the upper end 41*a*). The upper ends of the space expansion parts 50, 51 are positioned below the upper end 41*a* of the wiper 41, in a state that the wiper 41 is not brought into contact with the ink discharge surface 4*a*. Further, the upper ends of the space expansion parts 50, 51 are positioned below the ink discharge surface 4*a*. Thus, the space expansion parts 50, 51 are separated from the ink discharge surface 4*a* in the up-down direction, when the wiper 41 is being brought into contact with the ink discharge surface 4*a*. According to this configuration, even when the length of the wiper 41 in the front-rear direction is the same as the length of the ink discharge surface 4*a* in the front-rear direction, the space expansion parts 50, 51 do not make contact with the ink discharge surface 4*a*, and thus the space expansion parts 50, 51 hardly obstruct the wiping operation.

The wiper cleaner 46 is held by a cleaner holder 47 and is disposed between the waiting position and the wiper position of the wiper 41. The illustration of the cleaner holder 47 is omitted in FIGS. 1 and 3. The wiper cleaner 46 is made of an elastic absorber, such as sponge, to have a cuboid form. The wiper cleaner 46 includes a slit 46*a* roughly in the center thereof in the left-right direction. The slit 46*a* ranges from the lower end to the vicinity of the upper end of the wiper cleaner 46 and extends parallel to the wiper movement direction. The slit 46*a* is formed by cutting or slitting the absorber. The width of the slit 46*a* is smaller than the thickness of the wiper 41, that is, the width of the slit 46*a* is substantially zero. A part, of the wiper cleaner 46, on the right side of the slit 46*a* corresponds to a first contact part of the present teaching. A part, of the wiper cleaner 46, on the left side of the slit 46*a* corresponds to a second contact part of the present teaching.

Figure 4A:
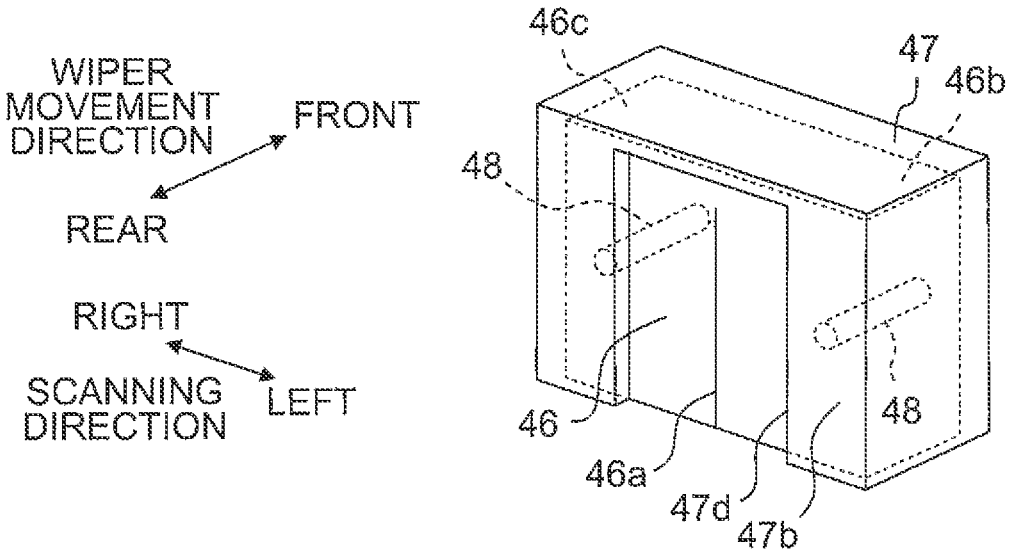
FIG. 4A is a perspective view of a wiper cleaner as viewed from the rear side of FIG. 1.
Figure 4B:
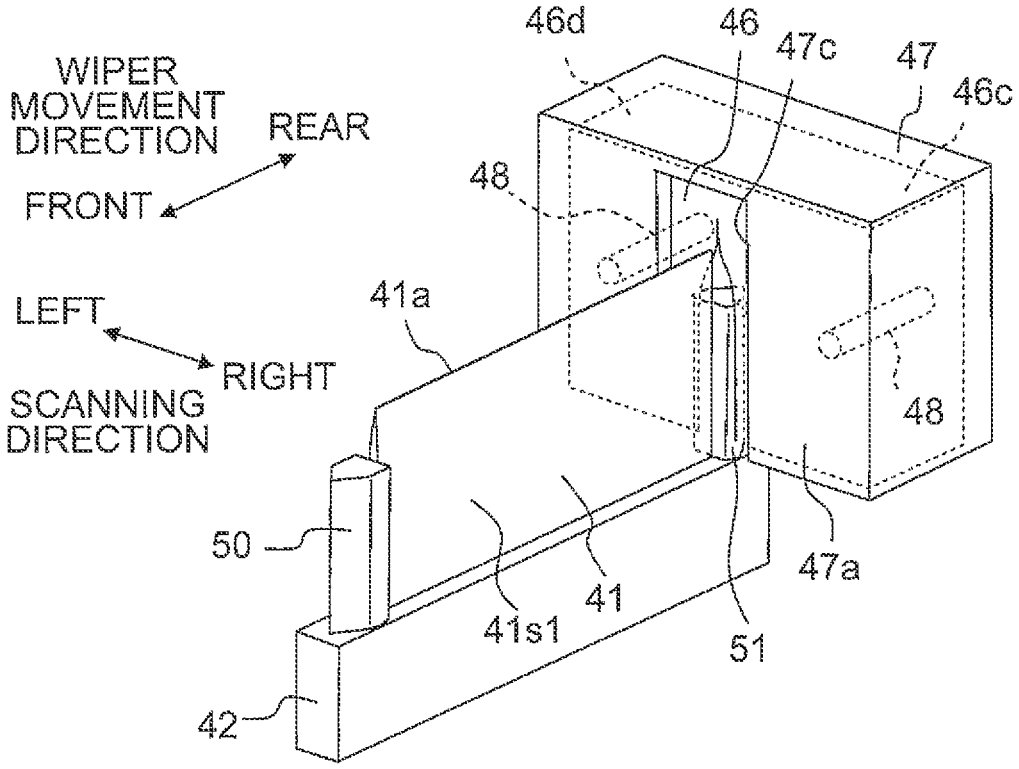
FIG. 4B is a perspective view of the wiper cleaner and a wiper as viewed from the front side of FIG. 1.

As depicted in FIGS. 4A and 4B, the cleaner holder 47 fixes a left end 46*b* and a right end 46*c* of the wiper cleaner 46. Specifically, the wiper cleaner 46 is fixed by two fixation bars 48. The two fixation bars 48 penetrate through circular holes formed in the left and right ends 46*b*, 46*c* of the wiper cleaner 46. The structure for fixing the left and right ends 46*b*, 46*c* of the wiper cleaner 46 may be any other structure than the above. The cleaner holder 47 covers or surrounds parts of the front and rear surfaces, the left and right surfaces, and the upper surface, of the wiper cleaner 46. The cleaner holder 47 is supported by an unillustrated support member in a cantilever manner. The cleaner holder 47 includes notches 47*c*, 47*d* which are formed in a front wall 47*a* (a second wall of the present teaching) and a rear wall 47*b* (a first wall of the present teaching) of the cleaner holder 47, respectively. The slit 46*a* and the periphery thereof are exposed through the notches 47*c*, 47*d*.

The wiper cleaner 46 is disposed at a position which allows a part, of the wiper 41, on the upper side of the wiper holder 42 to pass through the slit 46*a* during the movement of the wiper 41 between the waiting position and the wiping position.

Figure 6A:
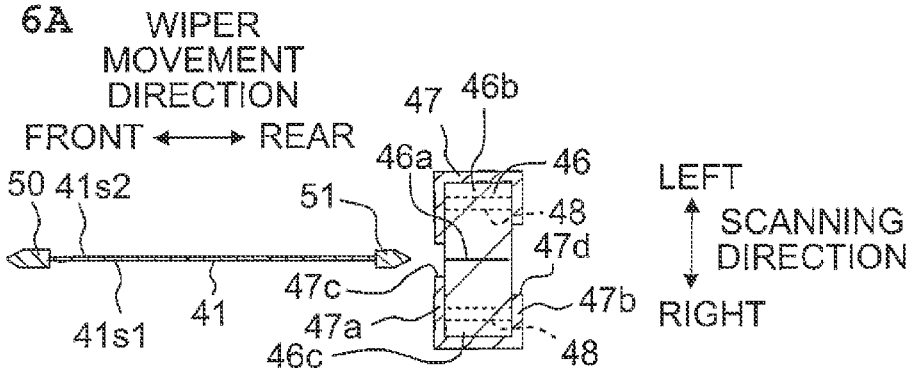
FIGS. 6A to 6F are views depicting a process, in which the wiper moves from a waiting position to a wiping position, according to the first embodiment.
Figure 6B:
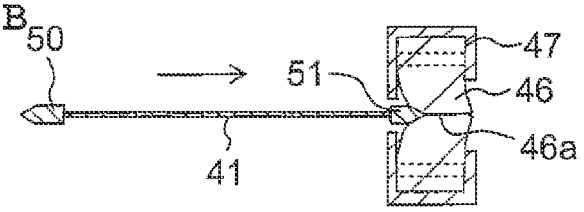
Figure 6C:
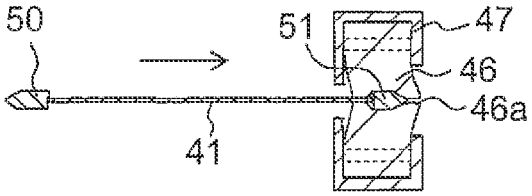
Figure 6D:
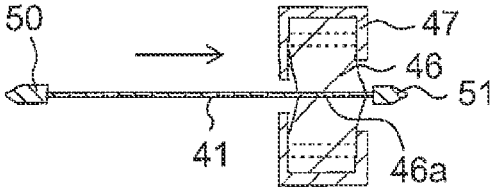
Figure 6E:
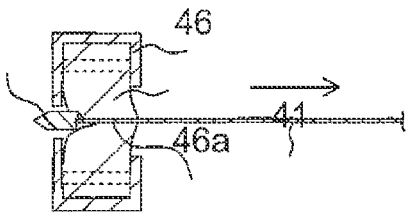
Figure 6F:
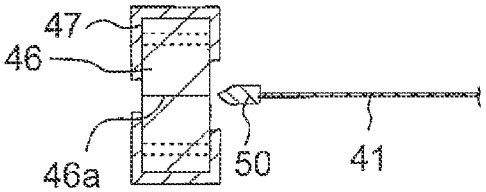
Figure 7A:
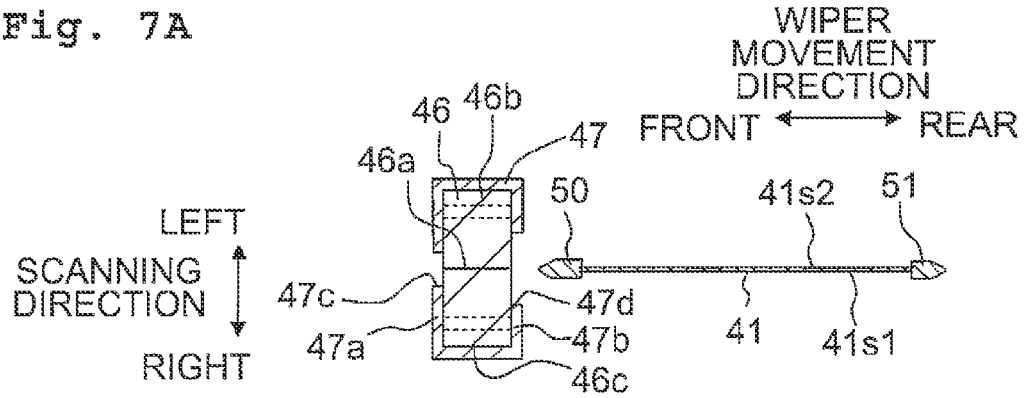
FIGS. 7A to 7F are views depicting a process, in which the wiper moves from the wiping position to the waiting position, according to the first embodiment.
Figure 7B:
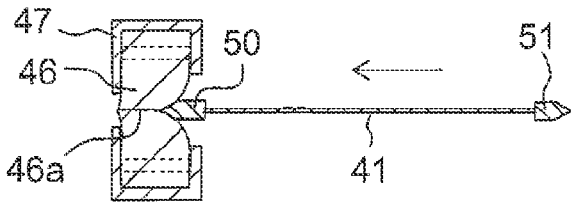
Figure 7C:
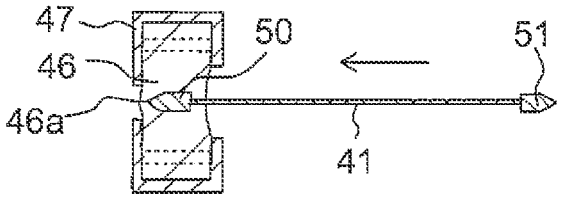
Figure 7D:
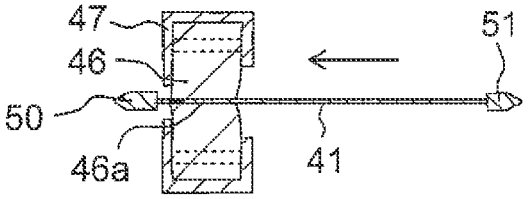
Figure 7E:
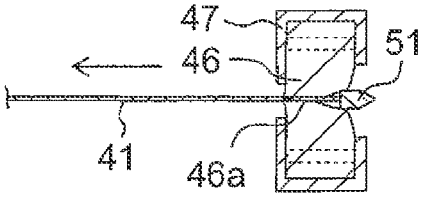
Figure 7F:
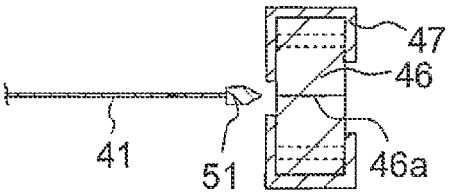

As depicted in FIGS. 6A and 6B, when the wiper 41 moves rearward from the waiting position to the wiping position, the space expansion part 51 on the rear side of the wiper 41 (the front side in the wiper travelling direction) is inserted first into the slit 46*a* (i.e., the space expansion part 51 is inserted before the wiper 41). The space expansion part 51 has high rigidity. Thus, the space expansion part 51 can be inserted into the slit 46*a* smoothly, although having a wider width than the wiper 41. Then, as depicted in FIG. 6C, the wiper 41 is inserted into the slit 46*a*, which is being expanded by the space expansion part 51. This prevents the wiper 41 from being caught by the slit 46*a*, and thereby making it possible to insert the wiper 41 into the slit 46*a* smoothly. As depicted in FIG. 6D, after the space expansion part 51 has passed through the slit 46*a*, the width of the slit 46*a* narrows to allow the wiper cleaner 46 to make contact with both surfaces of the wiper 41.

As depicted in FIGS. 7A to 7F, when the wiper 41 moves from the wiping position to the waiting position, the wiper 41 can be inserted into the slit 46*a* smoothly by the aid of the space expansion part 50 disposed on the front side of the wiper 41 (the front side in the wiper travelling direction), as with the case in which the wiper 41 moves from the waiting position to the wiping position. When the wiper 41 moves from the wiping position to the waiting position, the ink, which has adhered to the wiper 41 during the wiping operation for the ink discharge surface 4*a*, can be removed by the wiper cleaner 46.

As described above, the ink is less likely to adhere to the left surface 41*s*2 (the second surface of the present teaching) of the wiper 41. Thus, a part (the second contact part of the present teaching), of the wiper cleaner 46, which makes contact with the left surface 41*s*2 has little association with the cleaning for the wiper 41 in some cases. In both of the case where the ink adheres to the left surface 41*s*2 and the case where no ink adheres to the left surface 41s2, the part (the second contact part of the present teaching), of the wiper cleaner 46, which makes contact with the left surface 41s2 functions to ensure the contact surface pressure between the right surface 41s1 (the first surface of the present teaching) of the wiper 41 and the wiper cleaner 46.

The ends, of the space expansion parts 50, 51, farther from the wiper 41 in the front-rear direction, are formed to be tapered in directions, which are farther from the wiper 41 in the front-rear direction respectively. Thus, the space expansion parts 50, 51 can be inserted into the slit 46*a* easily.

Inserting the space expansion parts 50, 51 into the slit 46*a* compressively deforms the wiper cleaner 46 in the left-right direction. This allows the ink, which has been absorbed into the wiper cleaner 46, to be discharged, thereby making it possible to recover the absorbability of the wiper cleaner 46.

The space expansion part 50 disposed on the front side of the wiper 41 has a length in the wiper movement direction (front-rear direction) which is longer than that of the space expansion part 51 disposed on the rear side of the wiper 41. Thus, the space expansion part 50 is capable of compressively deforming the wiper cleaner 46 over a wider range in the wiper movement direction so as to recover the absorbability of the wiper cleaner 46 better than the space expansion part 51. As compared with the case where the space expansion parts 50, 51 have the same length in the wiper movement direction, this structure or configuration can improve the cleaning accuracy of the wiper 41 moving from the wiping position to the waiting position, without increasing the total of the lengths of the space expansion parts 50, 51. The space expansion parts 50, 51, however, may have the same length in the wiper movement direction.

Both of the ends 46*b*, 46*c* of the wiper cleaner 46 are fixed by the fixation bars 48. Thus, when each of the space expansion parts 50 and 51 is inserted into the slit 46*a*, the wiper cleaner 46 is deformed to bend in the travelling direction of the wiper 41, with the ends 46*b*, 46*c* as the fulcrums. This allows the slit 46*a* to expand more easily, as compared with the case where the entire upper surface of the wiper cleaner 46 is fixed by the cleaner holder 47. Thus, each of the space expansion part 50 and 51, which is to be inserted into the slit 46*a* before the wiper 41, can pass through the slit 46*a* smoothly.

As depicted in FIGS. 6A to 6F, when the wiper 41 moves rearward through the slit 46*a*, the rear surface of the wiper cleaner 46 is pressed against the rear wall 47*b* of the cleaner holder 47 to regulate the deformation of the wiper cleaner 46 toward the rear side. As depicted in FIGS. 7A to 7F, when the wiper 41 moves frontward through the slit 46*a*, the front surface of the wiper cleaner 46 is pressed against the front wall 47*a* of the cleaner holder 47 to regulate the deformation of the wiper cleaner 46 toward the front side. The notch 47*c* formed in the front wall 47*a* of the cleaner holder 47 has a length in the scanning direction (left-right direction), which is shorter than that of the notch 47*d* formed in the rear wall 47*b* of the cleaner holder 47. Thus, the contact area between the front wall 47*a* of the cleaner holder 47 and the wiper cleaner 46 is larger than the contact area between the rear wall 47*b* of the cleaner holder 47 and the wiper cleaner 46. In this structure or configuration, the wiper cleaner 46 is less likely to be deformed when the wiper 41 moves frontward from the wiping position to pass through the slit 46*a*, as compared with the case where the wiper 41 moves rearward from the waiting position to pass through the slit 46*a*. Therefore, the wiper cleaner 46 can be brought in contact stronger with the wiper 41 to improve the cleaning accuracy, when the wiper 41 moves frontward from the wiping position to pass through the slit 46*a*. Meanwhile, when the wiper 41 moves from the waiting position to the wiping position, it is possible to reduce the loads on the wiper 41 and the wiper cleaner 46. This elongates the service lives of the wiper 41 and the wiper cleaner 46.

Figure 2:
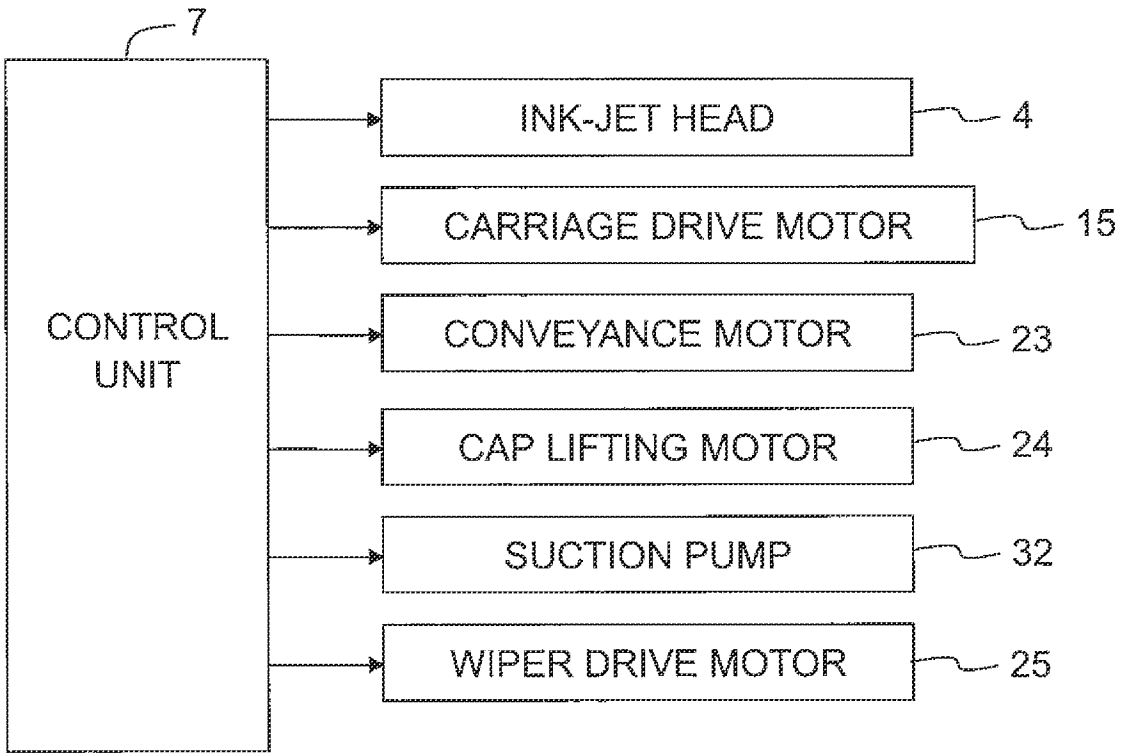
FIG. 2 is a block diagram schematically depicting a control system of the ink-jet printer.

FIG. 2 is a block diagram depicting a control system of the ink-jet printer 1. A control unit 7 depicted in FIG. 2 includes a Read Only Memory (ROM), a Random Access Memory (RAM), an Application Specific Integrated Circuit (ASIC) including various control circuits, and the like. The control unit 7 controls the ASIC to perform various processes, such as printing, on the recording sheet P in accordance with the programs stored in the ROM. The control unit 7 controls the carriage drive motor 15 and a conveyance motor 23 to perform the printing on the recording sheet P based on a printing command inputted from an external device, such as a PC. The carriage drive motor 15 drives the ink-jet head 4 and the carriage 3, and the conveyance motor 23 drives the conveyance rollers 17, 18 of the conveyance mechanism 5. The control unit 7 drives the carriage drive motor 15 to control the position of the ink-jet head 4 during the maintenance (suction purge or wiping of ink). Further, the control unit 7 controls the cap lifting motor 24 and the wiper drive motor 25 to perform the suction purge and the wiping of ink. The cap lifting motor 24 drives the suction cap 31 to move upward and downward. The wipe drive motor 25 drives the suction pump 32 and the wiper 41.

An explanation will be made in detail about the action or motion of the maintenance unit 6. The control unit 7 controls the maintenance unit 6 to move, in a case that the suction purge for the ink-jet head 4 is required to be performed. The case includes, for example, the timing immediately after power is applied to the ink-jet printer 1 and the case in which a purge command is inputted by a user.

At first, as depicted in FIG. 5A, the ink-jet head 4 is positioned in the maintenance position to face the suction cap 31. Next, the cap lifting motor 24 is driven to move the suction cap 31 upward from the waiting position depicted in FIG. 5A. Then, the suction cap 31 is brought into tight contact with the ink discharge surface 4*a* of the ink-jet head 4 as depicted in FIG. 5B. In this state, the suction pump 32 is driven to reduce the pressure in the suction cap 31. In this way, foreign matters and bubbles mixed in the ink-jet head 4 are sucked and discharged, together with the ink, from the ink discharge ports 16 covered with the suction cap 31 (suction purge).

After the suction purge for a certain period of time, the suction cap 31 is moved down to return to the waiting position. In this situation, a part of the ink, which was discharged from the ink discharge ports 16 during the suction purge, is adhering to the ink discharge surface 4*a*. Thus, subsequent to the suction purge, the wiper 41 wipes off the ink on the ink discharge surface 4*a*. As depicted in FIG. 5C and FIGS. 6A to 6F, the wiper drive motor 25 is at first driven to move the wiper 41 from the waiting position to the wiping position. During this movement, the wiper 41 and the space expansion parts 50, 51 pass through the slit 46*a* of the wiper cleaner 46.

Next, as depicted in FIG. 5D, the carriage 3 moves in a direction closer to the platen 2 to bring the ink discharge surface 4*a* of the ink-jet head 4 into contact with the upper end of the wiper 41. This allows the wiper 41 to wipe off the ink adhering to the ink discharge surface 4*a*. After that, as depicted in FIGS. 7A to 7F, the wiper 41 moves from the wiping position to the waiting position. During this movement, the wiper 41 and the space expansion parts 50, 51 pass through the slit 46*a* of the wiper cleaner 46, and thus the ink, which adhered to the wiper 41 during the wiping operation for the ink discharge surface 4*a*, is removed by wiper cleaner 46.

In the first embodiment, the scanning direction (left-right direction) corresponds to a first direction of the present teaching, the up-down direction perpendicular to the ink discharge surface 4*a* corresponds to a second direction of the present teaching, and the wiper movement direction (front-rear direction) corresponds to a third direction of the present teaching. The space expansion part 50 corresponds to a first space expansion part of the present teaching, and the space expansion part 51 corresponds to a second space expansion part of the present teaching.

<Modified Embodiments of First Embodiment>

Although the first embodiment of the present teaching has been explained above, the present teaching is not restricted to the first embodiment and various changes may be made within the scope of the claims. Further, the modified embodiments as described later can be performed by appropriately combining them.

In the first embodiment, two space expansion parts 50, 51 are disposed near the front and rear ends of the wiper 41 but do not to make contact therewith, respectively. One or both of two space expansion parts 50, 51, however, may be brought into contact with the front end and/or rear end of the wiper 41 in the front-rear direction.

Figure 8:
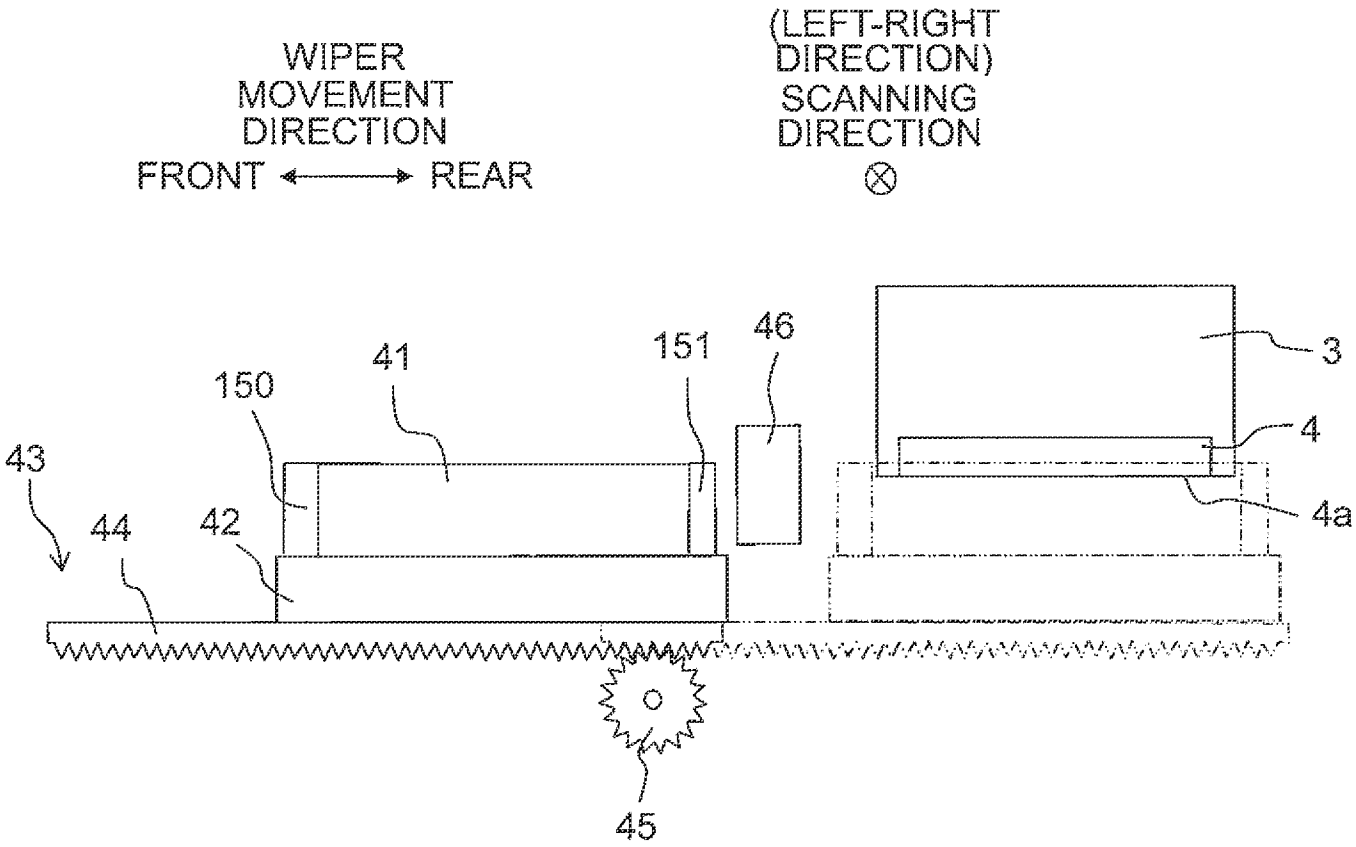
FIG. 8 is a view depicting an ink-jet printer according to a modified embodiment of the first embodiment and corresponding to FIG. 3.

For example, like space expansion parts 150, 151 depicted in FIG. 8, the lengths of the space expansion parts 150, 151 in the up-down direction may be the same as or longer than the length, of the wiper 41, ranging from the upper surface of the wiper holder 42 to the upper end 41*a* (the length from the lower end 41*b* to the upper end 41*a*). In this case, however, the length of the wiper 41 in the front-rear direction is required to be longer than the length of the ink discharge surface 4*a* in the front-rear direction, so that the space expansion parts 150, 151 never make contact with the ink-jet head 4 or the carriage 3. According to this modified embodiment, when the wiper 41 is inserted into the slit 46*a*, the upper end of the wiper 41 is reliably prevented from being caught by the slit 46*a* of the wiper cleaner 46.

Figure 9:
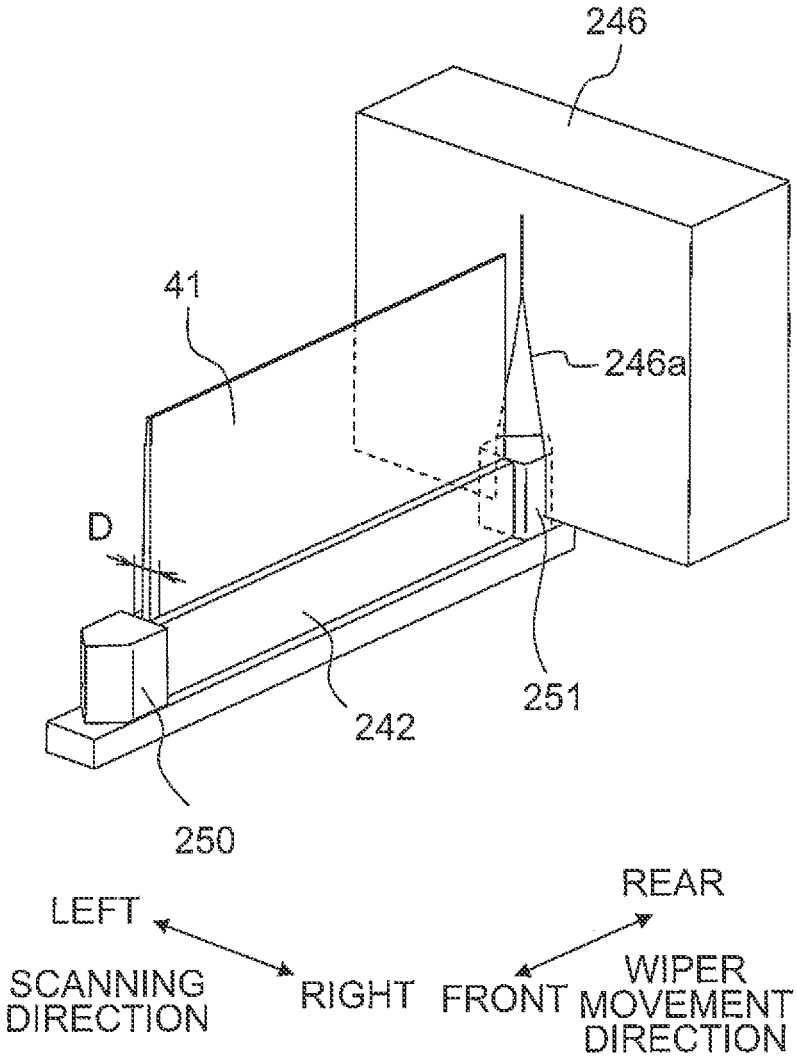
FIG. 9 is a view depicting an ink-jet printer according to a modified embodiment of the first embodiment and corresponding to FIG. 4B.

In the first embodiment, the space expansion parts 50, 51 and the part, of the wiper 41, on the upper side of the wiper holder 42 are arranged in the wiper movement direction. However, as depicted in FIG. 9, space expansion parts 250, 251 and a part, of the wiper 41, held by a wiper holder 242 may be arranged in the wiper movement direction. In this case, the length of a wiper cleaner 246 in the up-down direction is required to be longer than that of the first embodiment, so that the space expansion parts 250, 251 and the wiper cleaner 246 are arranged in the wiper movement direction. Further, in order to increase the contact area and the contact surface pressure between the wiper 41 and the wiper cleaner 246, it is preferred that a part, of the wiper holder 242, passing through a slit 246*a* have a thickness D (the length in the scanning direction), which is smaller than the thicknesses of the space expansion parts 250, 251. According to this modified embodiment, the space expansion parts 250, 251 are less likely to obstruct the wiping operation for the ink discharge surface 4*a* by use of the wiper 41. This expands the possibility of design of the carriage 3 and the ink-jet head 4.

Figure 10:
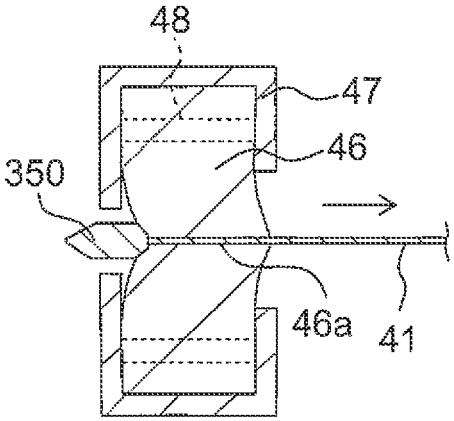
FIG. 10 is a view depicting an ink-jet printer according to a modified embodiment of the first embodiment and corresponding to FIG. 6E.
Figure 10:
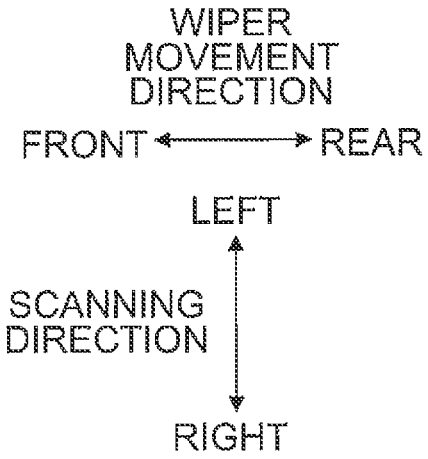

For example, as depicted in FIG. 10, the end of a space expansion part 350 on the side of the wiper 41 may be tapered in the direction, which is closer to the wiper 41 in the wiper movement direction. According to this modified embodiment, when the space expansion part 350 is inserted into the slit 46*a* after the wiper 41, the space expansion part 350 is prevented from being caught by the slit 46*a*.

In the first embodiment, the lengths of the space expansion parts 50, 51 in the scanning direction (left-right direction) are longer than the thickness of the wiper 41. The lengths of the space expansion parts 50, 51 in the scanning direction, however, may be the same as that of the wiper 41.

Figure 11:
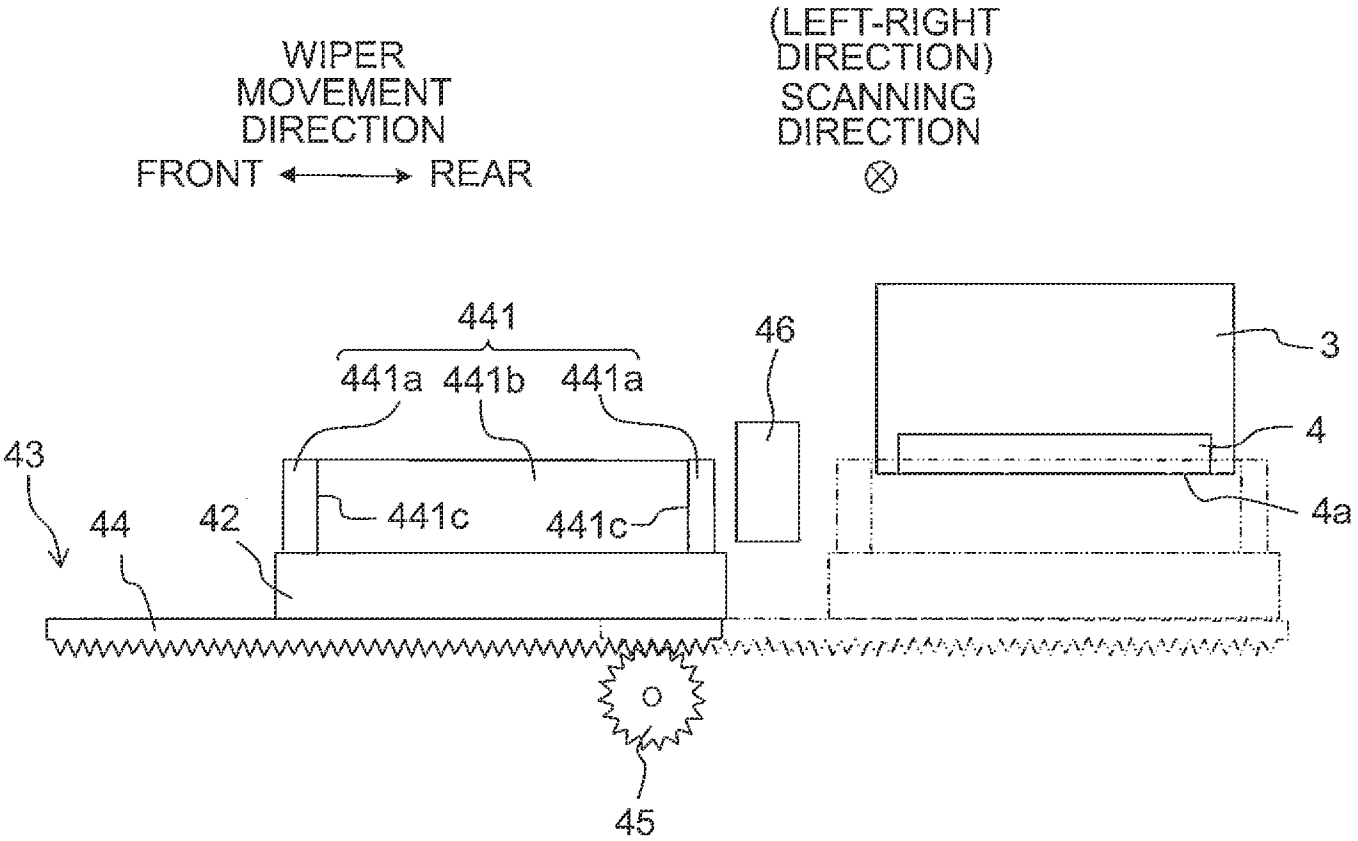
FIG. 11 is a view depicting an ink-jet printer according to a modified embodiment of the first embodiment and corresponding to FIG. 3.

For example, as depicted in FIG. 11, instead of providing the space expansion parts 50, 51, at least one end (ends 441*a* in FIG. 11) of a wiper 441 in the front-rear direction may have the rigidity which is higher than that of any other part (intermediate part 441*b* in FIG. 11) of the wiper 441. The method for allowing the wiper 441 to partially have high rigidity is not specifically limited. For example, it is possible to employ a method in which the thicknesses of the ends 441*a* are made to be thicker than that of the intermediate part 441*b*; a method in which coating is applied on only surfaces of the ends 441*a*; and a method in which the ends 441*a* are made of a material different from that of the intermediate part 441*b* (including a case where the ends 441*a* and the intermediate part 441*b* are made of the same material but to have different compounding ratios). In this modified embodiment, since the intermediate part 441*b* is inserted into the slit which is being expanded by the end 441*a*, the intermediate part 441*b* is prevented from being caught by the wiper cleaner 46. It is preferred that the length of the intermediate part 441*b* in the front-rear direction be the same as or longer than the length of ink discharge surface 4*a* in the front-rear direction. Further, it is preferred that slits 441*c* be formed at the boundaries between the ends 441*a* and the intermediate part 441*b* to reduce the force to be applied on the ink discharge surface 4*a* during the wiping operation for the ink discharge surface 4*a* by use of the wiper 441.

Figure 12:
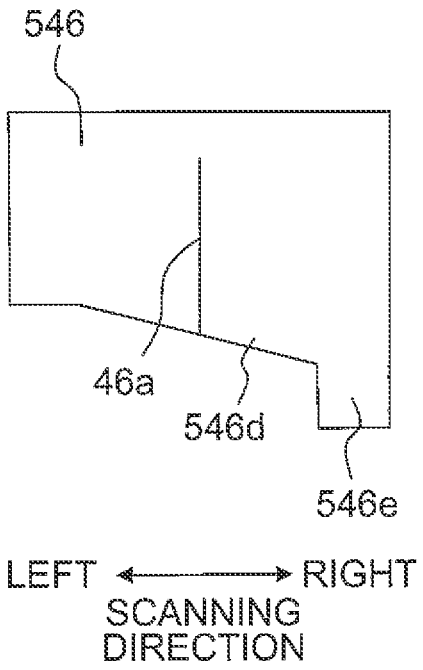
FIG. 12 is a front view of a wiper cleaner of an ink-jet printer according to a modified embodiment of the first embodiment.

In the first embodiment, the entire lower surface of the wiper cleaner 46 is horizontal. However, as depicted in FIG. 12, at least a part (inclined surface 546*d*), of the lower surface of a wiper cleaner 546, directly beneath the slit 46*a* may be inclined to the horizontal surface to have different levels in the left-right direction. This moves the ink absorbed in the wiper cleaner 546 downward along the inclined surface 546*d*, so that the ink gathers at a lower part of the inclined surface 546*d*. In FIG. 12, the wiper cleaner 546 includes an ink discharge part 546*e* protruding downward beyond the lowermost end of the inclined surface 546*d*. The ink is discharged from the ink discharge part 546*e*.

Figure 13:
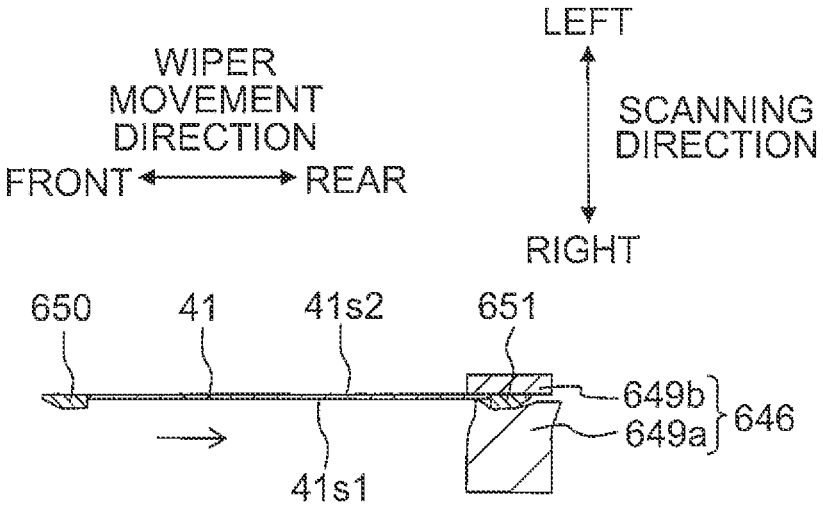
FIG. 13 is a view depicting an ink-jet printer according to a modified embodiment of the first embodiment and corresponding to FIG. 6C.

In the first embodiment, the wiper cleaner 46 is formed only of the absorber. However, as depicted in FIG. 13, a wiper cleaner 646 may be formed of an ink absorbing part 649*a* (the first contact part of the present teaching) and a wiper contact part 649*b* (the second contact part of the present teaching). The ink absorbing part 649*a* is made of the absorber, and the wiper contact part 649*b* is made of synthetic resin and the like to have the rigidity higher than that of the absorber. The ink absorbing part 649*a* makes contact with the right surface 41*s*1 of the wiper 41 (the first surface of the present teaching), and the wiper contact part 649*b* makes contact with the left surface 41*s*2 of the wiper 41 (the second surface of the present teaching). Space expansion parts 650, 651 are formed not to protrude beyond the left surface 41*s*2 of the wiper 41 in the thickness direction of the wiper 41. Since the ink is more likely to adhere to the right surface 41*s*1 and less likely to adhere to the left surface 41*s*2, the wiper 41 can be cleaned with the wiper cleaner 646 as well. However, the wiper cleaner 46 in the first embodiment is more preferred to improve the cleaning quality. The wiper contact part 649*b* functions to ensure the contact surface pressure between the right surface 41*s* of the wiper 41 and the ink absorbing part 649*a*.

In the first embodiment, the space expansion parts 50, 51 and the wiper 41 integrally move. The space expansion parts 50, 51, however, may move separately from the wiper 41. For example, the space expansion parts 50, 51 may be attached to the wiper holder 42 to be movable in the up-down direction. When the wiper 41 wipes the ink discharge surface 4*a*, the space expansion parts 50, 51 may be positioned on the side lower than the position at which the wiper 41 is inserted into the slit 46*a* of the wiper cleaner 46.

In the first embodiment, the waiting position of the wiper 41 is on the front side of the wiping position in the sheet conveyance direction. The waiting position of the wiper 41, however, may be on the rear side of the wiping position.

Figure 14A:
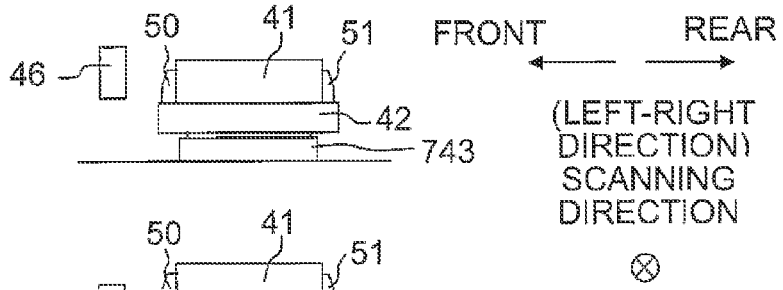
FIGS. 14A to 14G are illustrative views each illustrating an operation of an ink-jet printer according to a modified embodiment of the first embodiment.
Figure 14B:
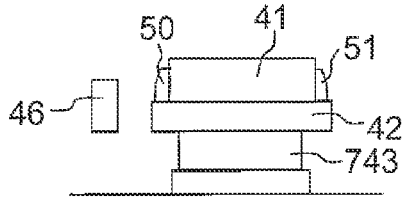
Figure 14C:
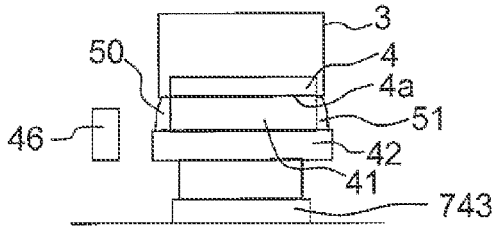
Figure 14D:
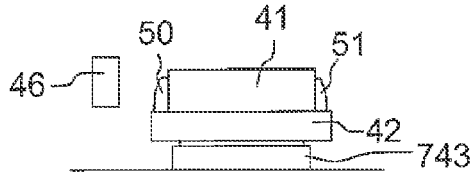
Figure 14E:
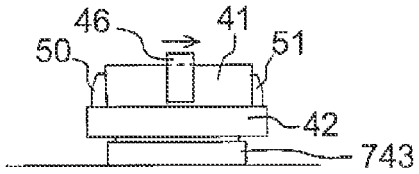
Figure 14F:
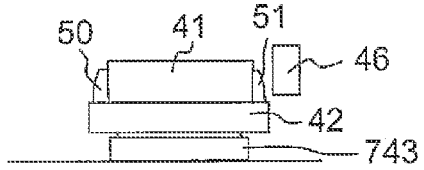
Figure 14G:
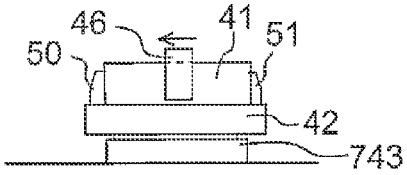
Figure 15A:
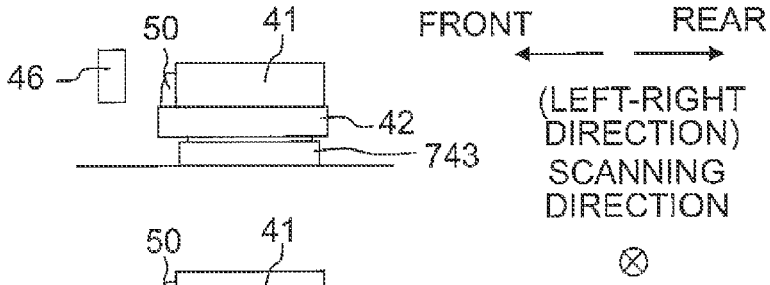
FIGS. 15A to 15G are illustrative views each illustrating an operation of an ink-jet printer according to a modified embodiment of the first embodiment.
Figure 15B:
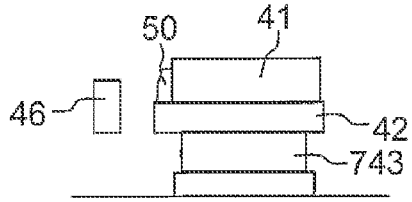
Figure 15C:
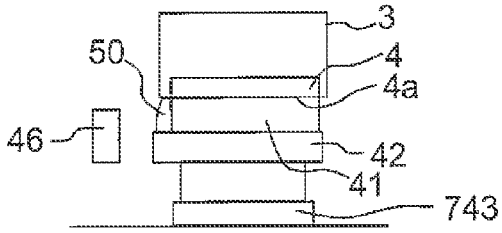
Figure 15D:
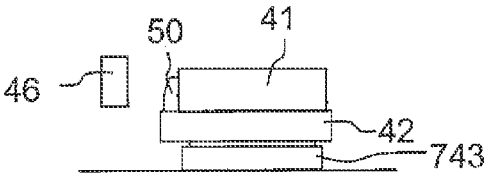
Figure 15E:
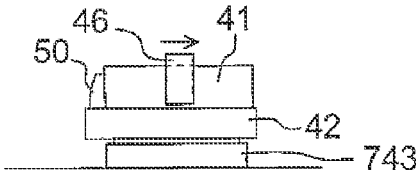

In the first embodiment, the movement of the wiper 41 causes the relative movement between the wiper 41 and the wiper cleaner 46. However, as depicted in FIGS. 14D to 14G and FIGS. 15D to 15G, the movement of the wiper cleaner 46 in the front-rear direction may cause the relative movement between the wiper 41 and the wiper cleaner 46. The modified embodiments depicted in FIGS. 14A to 14G and FIGS. 15A to 15G will be explained in detail as follows. The wiper 41 is allowed to move up and down by a lifting motor 743, which is driven by a motor or the like. The wiper cleaner 46 is allowed to reciprocate in the direction (front-rear direction) parallel to the ink discharge surface 4*a* and orthogonal to the scanning direction by an unillustrated movement mechanism (corresponding to a movement mechanism of the present teaching), which is driven by a motor or the like. When the wiper 41 wipes off the ink on the ink discharge surface 4*a*, the wiper 41 at first moves upward from the position depicted in FIGS. 14A and 15A to the position depicted in FIGS. 14B and 15B. Then, the ink-jet head 4 moves in the scanning direction as depicted in FIGS. 14C and 15C in a state that the wiper 41 is in the position depicted in FIGS. 14B and 15B, thereby wiping off the ink adhering to the ink discharge surface 4*a* with the wiper 41. After that, the wiper 41 moves down as depicted in FIGS. 14D and 15D. After the downward movement of the wiper 41, as depicted in FIGS. 14E to 14G and FIGS. 15E to 15G, the wiper cleaner 46 reciprocates in the front-rear direction to remove the ink adhering to the wiper 41.

Figure 15F:
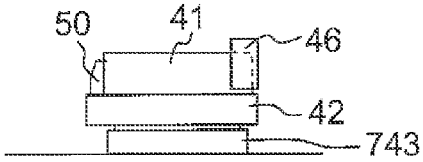
Figure 15G:
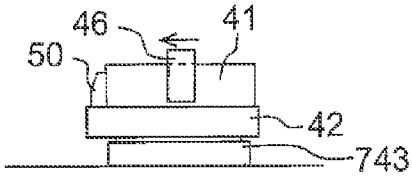
Figure 16A:
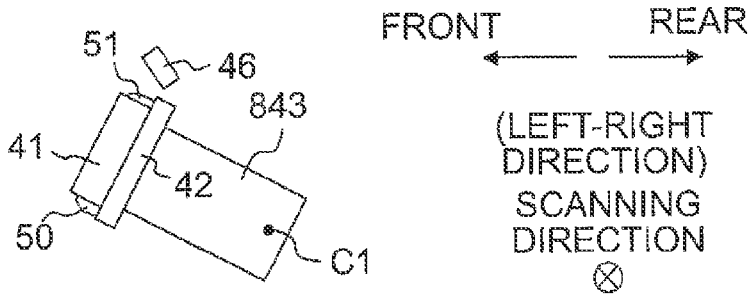
FIGS. 16A to 16E are illustrative views each illustrating an operation of an ink-jet printer according to a modified embodiment of the first embodiment.
Figure 16B:
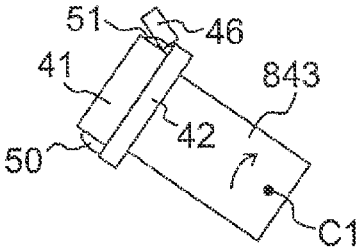
Figure 16C:
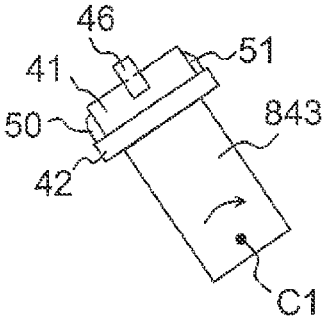
Figure 16D:
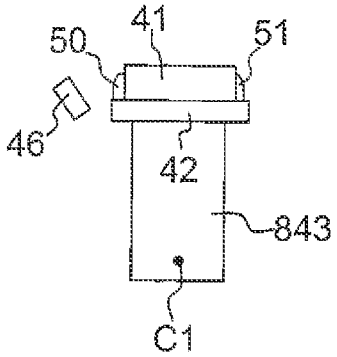
Figure 16E:
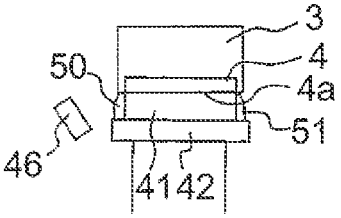

In the first embodiment, the wiper 41 passes through the slit 46*a* when moving to the wiper cleaner 46 toward either side in the front-rear direction. However, as depicted in FIG. 15F, the wiper 41 may not pass through the slit 46*a* when moving relative to the wiper cleaner 46 toward any one side in the front-rear direction. In this case, the space expansion part (the space expansion part 50 in FIG. 15F) is disposed on only one side of the wiper 41 in the front-rear direction. In other words, the space expansion part may not be disposed on the other side of the wiper 41 in the front-rear direction.

In the first embodiment, the wiper 41 is disposed so that the longitudinal direction thereof is parallel to the ink discharge surface 4*a* and orthogonal to the scanning direction, and the wiper movement mechanism 43 drives the wiper 41 in the longitudinal direction of the wiper 41. The arrangement direction and driving direction of the wiper 41, however, are not limited to those. The longitudinal direction of the wiper 41 may be any direction, provided that the longitudinal direction of the wiper 41 intersects with both of the scanning direction and the direction (up-down direction) orthogonal to the ink discharge surface 4*a*. Further, the movement direction of the wiper 41 by the wiper movement mechanism 43 may not be perfectly parallel to the longitudinal direction of the wiper 41, provided that the movement direction of the wiper 41 is along the wiper 41. In the first embodiment, the wiper 41 is disposed so that the upper end 41*a* is perpendicular to the up-down direction. The wiper 41, however, may be disposed so that the upper end 41*a* is inclined to the up-down direction.

In the first embodiment, the wiper 41 linearly moves relative to the wiper cleaner 46 in the longitudinal direction of the wiper 41. However, as depicted in FIGS. 16A to 16E, the wiper 41 may move relative to the wiper cleaner 46 in a circumferential direction around an axis C1 extending in a direction orthogonal to the wiper 41. In this case, the wiper 41 intersects with the wiper cleaner 46 in the direction (up-down direction) orthogonal to the ink discharge surface 4*a*, and the wiper 41 moves relative to the wiper cleaner 46 in the direction intersecting with the scanning direction. In FIGS. 16A to 16E, the wiper cleaner 46 is fixed and the wiper 41 is rotatably moved by a wiper movement mechanism 843, which is driven by a motor or the like. However, the wiper 41 may be fixed and the wiper cleaner 46 may be rotated.

In the first embodiment, the ink-jet head 4 moves leftward to wipe the ink discharge surface 4*a* with the right surface 41*s*1 of the wiper 41. The ink-jet head 4, however, may move rightward to wipe the ink discharge surface 4*a* with the left surface 41*s*2 of the wiper 41. Alternatively, the ink-jet head 4 may reciprocate in the left-right direction to wipe the ink discharge surface 4*a* with the right and left surfaces 41*s*1 and 41*s*2 of the wiper 41 in a state that the wiper 41 is in the wiping position.

In the first embodiment, the ink-jet head 4 and the carriage 3 move in the scanning direction to wipe the ink discharge surface 4*a* with the wiper 41. However, the following configuration is also allowable. That is, the wiper 41 is caused to move relative to the ink-jet head 4 by a suitable means, such as a motor, thereby wiping the ink discharge surface 4*a*.

The wiping direction of the wiper 41 (the movement direction relative to the ink discharge surface 4*a*) is not limited to the direction away from the platen 2. For example, the wiper 41 may move in the direction close to the platen 2, or the wiper 41 may be disposed in the direction intersecting with the sheet conveyance direction to move in the sheet conveyance direction.

The timing at which the wiper 41 wipes off the ink adhering to the ink discharge surface 4*a* is not limited to the timing after the suction purge which is an exemplary timing in the first embodiment. For example, the wiper 41 may wipe off the ink after printing is performed by discharging the ink onto the recording sheet P.

<Second Embodiment>

Figure 17:
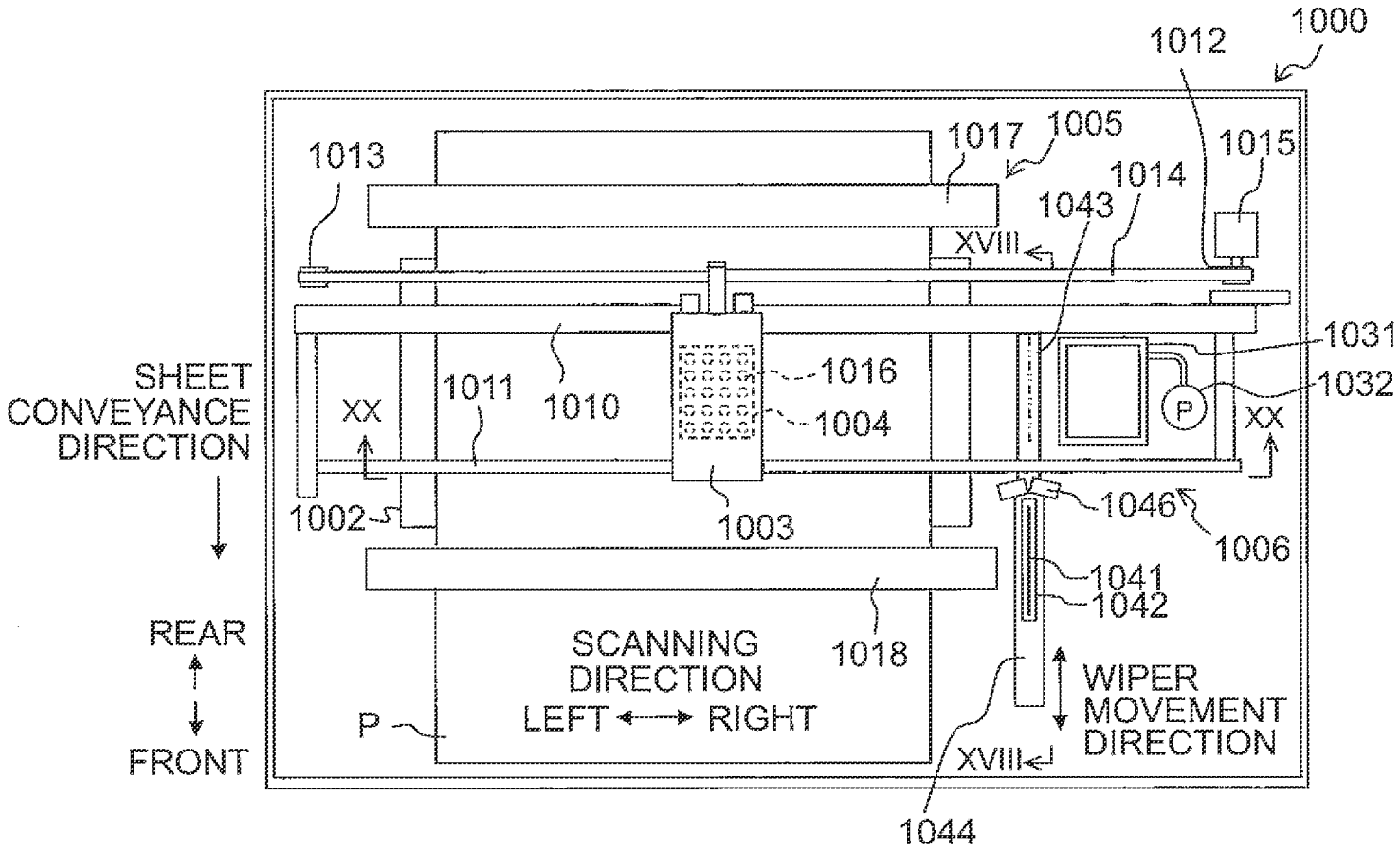
FIG. 17 is a schematic plan view depicting an ink-jet printer according to a second embodiment of the present teaching.

Next, an explanation will be made about the second embodiment of the present teaching. The constitutive parts or components, which are the same as or equivalent to those of the first embodiment, are designated by the same reference numerals, any explanation of which will be omitted as appropriate. As depicted in FIG. 17, an ink-jet printer 1001 (a liquid discharge apparatus of the present teaching) includes a platen 2 on which a recording sheet P is placed, a carriage 3 which is reciprocatively movable in a scanning direction (left-right direction) parallel to the platen 2, an ink-jet head 4 (a liquid discharge head of the present teaching) which is carried on the carriage 3, a conveyance mechanism 5 which conveys the recording sheet P in a sheet conveyance direction (frontward direction) perpendicular to the scanning direction, a maintenance unit 1006 which performs various maintenance operations to maintain and recover the liquid discharge performance of the ink-jet head 4, a control unit 7 (see FIG. 2) which is in charge of control of the entire parts of components of the ink-jet printer 1001, and the like.

The maintenance unit 1006 is disposed at a maintenance position, which is on the right side of the recording area of the ink-jet head 4 in the scanning direction (left-right direction). In order to remove any foreign matters, bubbles, and the like, mixed in the ink-jet head 4, the maintenance unit 1006 performs a suction purge for sucking and discharging the ink from ink discharge ports 16 and the wiping of ink adhering to an ink discharge surface 4*a* of the ink-jet head 4, when the ink-jet head 4 and the carriage 3 are positioned in the maintenance position. This makes it possible to maintain and recover the ink discharge performance of the ink-jet head 4. The maintenance unit 1006 includes a wiper 1041, a wiper cleaner 1046, a suction cap 31, a suction pump 32, and the like.

When the suction cap 31 is driven to move upward by a cap lifting mechanism 33 in a state that the ink-jet head 4 is in the maintenance position, the suction cap 31 is brought in tight contact with the ink discharge surface 4*a* of the ink-jet head 4 to cover the ink discharge ports 16. In this situation, when the suction pump 32 connected to the suction cap 31 is driven, the pressure in the suction cap 31 is reduced. Thus, the ink in the ink-jet head 4 is sucked from the ink discharge ports 16 and discharged into the suction cap 31 (suction purge).

Figure 18:
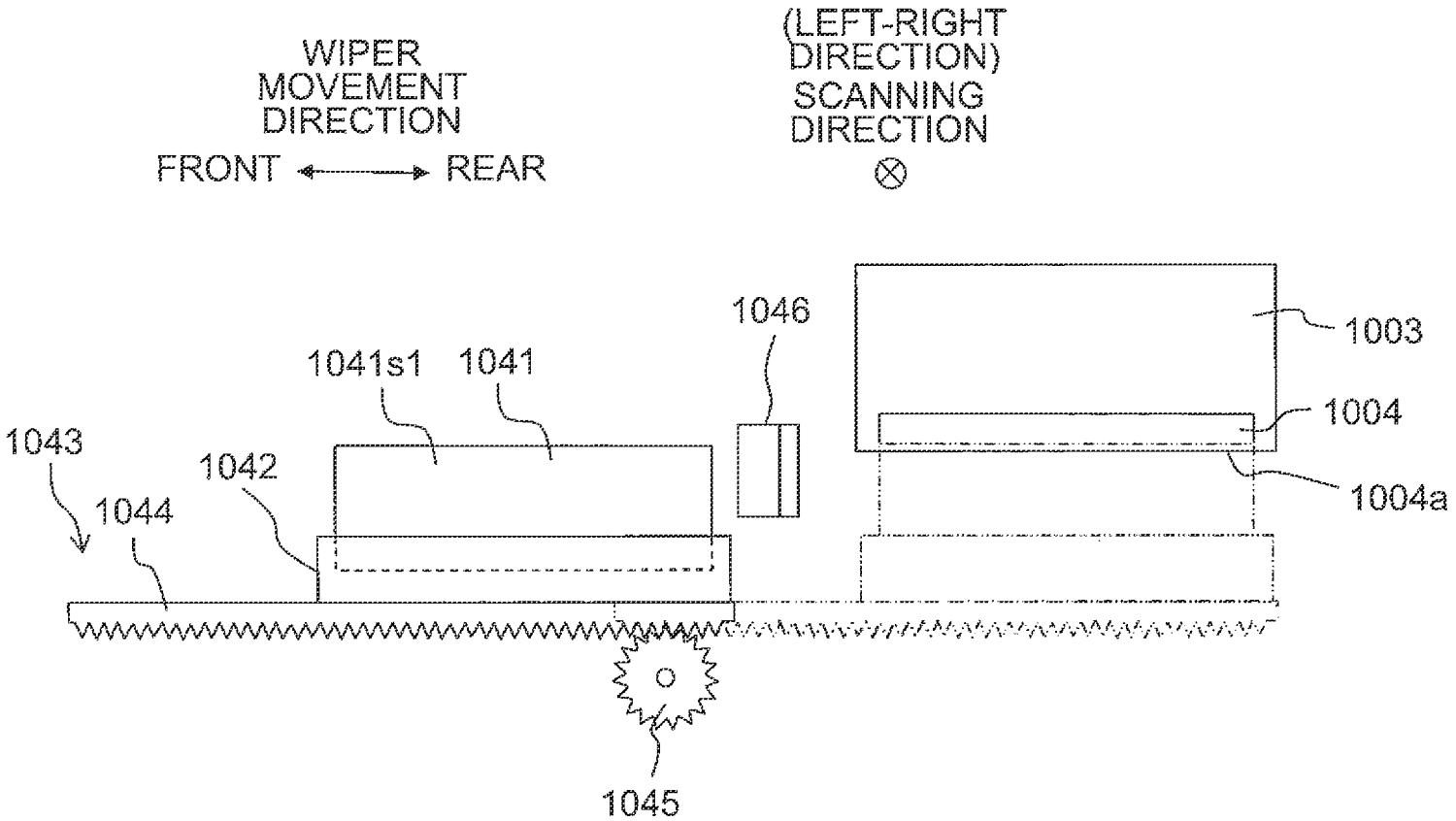
FIG. 18 is a view taken along the arrow XVIII-XVIII in FIG. 17.
Figure 19:
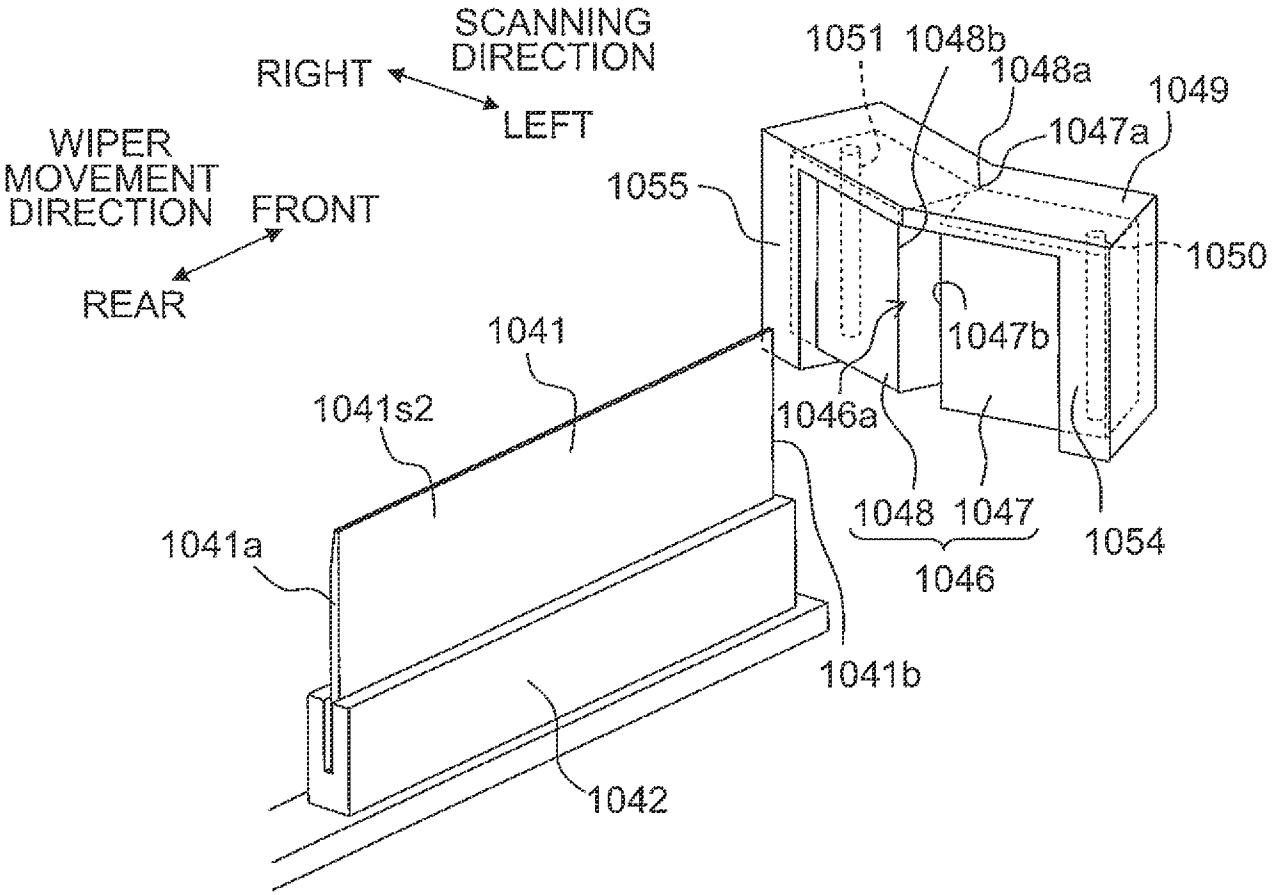
FIG. 19 is a perspective view of a wiper cleaner and a wiper in a wiping position, as viewed from the rear side of FIG. 17.

The wiper 1041 is a flat plate member made of flexible material such as rubber and synthetic resin. As depicted in FIGS. 18 and 19, the wiper 1041 is disposed to be orthogonal to the scanning direction in a state that a terminal end (lower end) thereof is held by a wiper holder 1042. The wiper 1041 is formed in a rectangular shape, and the upper end of the wiper 1041 extends parallel to the ink discharge surface 4*a* in a front-rear direction.

The wiper 1041 is reciprocatively and linearly driven by means of a wiper movement mechanism 1043 in a direction (hereinafter referred to as "wiper movement direction") parallel to the ink discharge surface 4*a* and orthogonal to the scanning direction. The wiper 1041 is driven between a wiping position and a waiting position. The wiping position is on the movement path of the carriage 3 in the scanning direction (indicated by alternate long and two short dashes line in FIG. 17 and FIG. 18). The waiting position is on the front side of the wiping position (indicated by solid line in FIG. 17 and FIG. 18). The wiper movement mechanism 1043 includes a rack 44 attached to the wiper holder 1042, a pinion 45 engaging with the rack 44, and a wiper drive motor 25 which drives and rotates the pinion 45. The wiper movement mechanism 1043 may have any other structure than the above.

The upper end of the wiper 1041 is positioned above the ink discharge surface 4*a*. As depicted in FIG. 20C and FIG. 20D, when the ink-jet head 4 in the maintenance position moves in the scanning direction (in particular, leftward) with the wiper 1041 being in the wiping position, the ink adhering to the ink discharge surface 4*a* of the ink-jet head 4 is wiped with a right surface 1041*s*1 (a first surface of the present teaching) of the wiper 1041. In the second embodiment, a carriage drive motor 15 corresponds to a second movement mechanism of the present teaching. The ink wiped is more likely to adhere to the right surface 1041*s*1 of the wiper 1041, and is less likely to adhere to a left surface 1041*s*2 (a second surface of the present teaching). The length of the wiper 1041 in the front-rear direction is substantially the same as or longer than the length of the ink discharge surface 4*a* in the front-rear direction. The wiper 1041 can wipe the entire ink discharge surface 4*a* during a single wiping operation.

The wiper 1041 is thin, of which entire thickness is, for example, about 1 mm. The upper end of the wiper 1041 is in a tapered shape. This allows the wiper 1041 to bend easily when the wiper 1041 makes contact with the ink discharge surface 4*a*, and thereby making it possible to wipe off the ink on the ink discharge surface 4*a* reliably. When the restoring force or resilience, by which the wiper 1041 in the bent state is restored to a normal state, is great, the force, which is transmitted from the wiper 1041 to the water-repellent film covering the ink discharge surface 4*a*, is also great. In the second embodiment, however, since the wiper 1041 has the thickness of approximately 1 mm, the resilience is relatively small. This reduces the force transmitting from the wiper 1041 to the water-repellent film, and thereby making it possible to prevent the water-repellent film from peeling off.

The wiper cleaner 1046 is held by a cleaner holder 1049 and is disposed between the waiting position and the wiper position of the wiper 1041. The illustration of the cleaner holder 1049 is omitted in FIGS. 17 and 18. The wiper cleaner 1046 is made of an elastic absorber, such as sponge, to include two rectangular parallelepiped cleaner parts 1047, 1048 (corresponding to a second contact part and a first contact part of the present teaching) which are disposed in the left-right direction. The cleaner part 1047 is positioned on the left side of the cleaner part 1048.

Figure 20A:
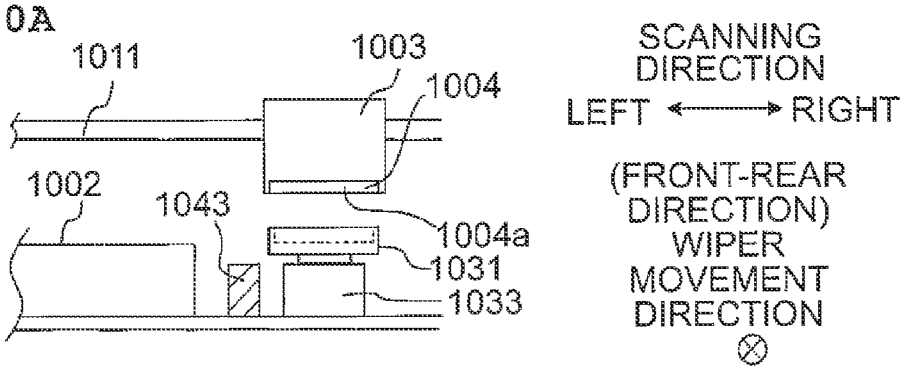
FIGS. 20A to 20D are illustrative views each illustrating an operation of a maintenance unit according to the second embodiment.

As depicted in FIGS. 19 and 20A, two cleaner parts 1047, 1048 have the same shape and are disposed symmetrically. The two cleaner parts 1047, 1048 are disposed to extend in the up-down direction. Further, two cleaner parts 1047, 1048 are obliquely disposed in the front-rear direction and the up-down direction so that a space 1046*a* between the cleaner parts 1047, 1048 widens toward the rear side (the side of the wiping position). Thus, a clearance between rear ends 1047*b*, 1048*b* of surfaces, of the cleaner parts 1047, 1048, facing each other is greater than a clearance between front ends 1047*a*, 1048*a* of surfaces, of the cleaner parts 1047, 1048, facing each other. In the following, the surfaces, of the cleaner parts 1047, 1048, facing each other are referred to as "facing surfaces" in some cases. The two cleaner parts 1047, 1048 are disposed so that the front ends 1047*a*, 1048*a* of the facing surfaces and the vicinity thereof are brought into contact with each other while being slightly compressed in the left-right direction.

The wiper cleaner 1046 is disposed at a position which allows a part, of the wiper 1041, on the upper side of the wiper holder 1042 to pass through the space 1046*a* between two cleaner parts 1047, 1048 during the movement of the wiper 1041 between the waiting position and the wiping position.

Figure 21A:
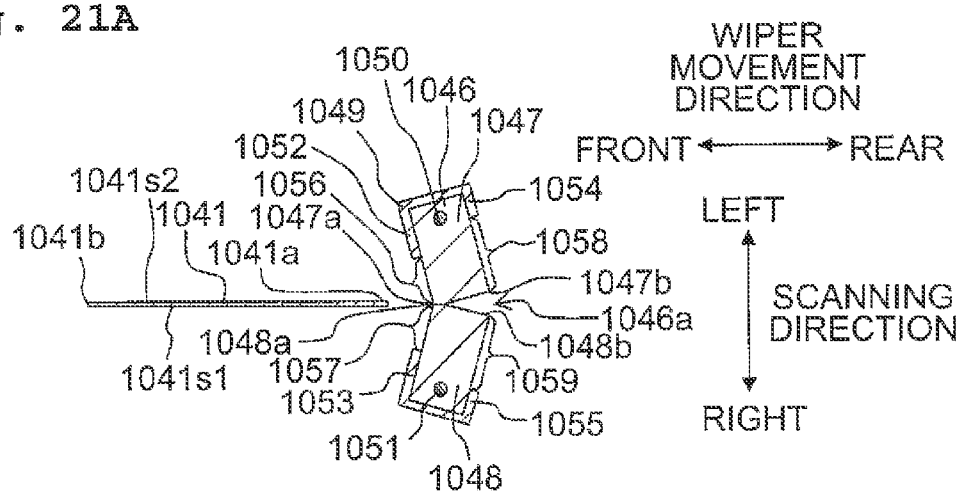
FIGS. 21A to 21C are views depicting a process, in which the wiper moves from a waiting position to the wiping position, according to the second embodiment.

As depicted in FIG. 19 and FIG. 21A, the cleaner holder 1049 is formed symmetrically. The cleaner holder 1049 includes two shafts 1050, 1051, which penetrate in the up-down direction at the ends, of two cleaner parts 1047, 1048, on the side farther away from the space 1046*a* in the left-right direction. The cleaner holder 1049 rotatably holds two cleaner parts 1047, 1048 around the shafts 1050, 1051 extending in the up-down direction.

The cleaner holder 1049 includes walls which cover the upper surface, the left and right surfaces, parts of the front and rear surfaces, and a part of the lower surface, of the wiper cleaner 1046, respectively. The walls, which cover the upper and lower surfaces of the wiper cleaner 1046, support both ends of two shafts 1050, 1051. The walls, of the cleaner holder 1049, covering the wiper cleaner 1046 are not fixed to the wiper cleaner 1046. The walls, which cover the front surfaces (each of which is a first side surface of the present teaching) of two cleaner parts 1047, 1048, are referred to as first pressing walls 1052, 1053, respectively. The walls, which cover the rear surfaces (each of which is a second side surface of the present teaching) of two cleaner parts 1047, 1048, are referred to as second pressing walls 1054, 1055, respectively. The four pressing walls 1052, 1053, 1054, and 1055 cover parts, of two cleaner parts 1047, 1048, on the side away from the space 1046*a* in the left-right direction. A part, of the front surface of the cleaner part 1047, which is not covered with the pressing wall 1052 is referred to as an exposed part 1056 (a first exposed part of the present teaching); a part, of the front surface of the cleaner part 1048, which is not covered with the pressing wall 1053 is referred to as an exposed part 1057 (a first exposed part of the present teaching). A part, of the rear surface of the cleaner part 1047, which is not covered with the pressing wall 1054 is referred to as an exposed part 1058 (a second exposed part of the present teaching); and a part, of the rear surface of the cleaner part 1048, which is not covered with the pressing wall 1055 is referred to as an exposed part 1059 (a second exposed part of the present teaching). The lengths of the exposed parts 1056, 1057 of the first pressing walls 1052, 1053 in the horizontal direction are shorter than the lengths of the exposed parts 1058, 1059 of the second pressing walls 1054, 1055 in the horizontal direction.

Figure 21B:
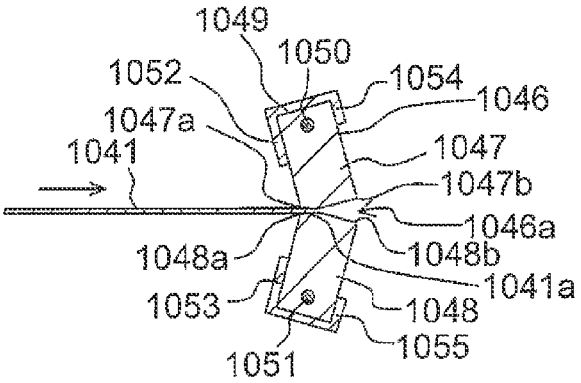
Figure 21C:
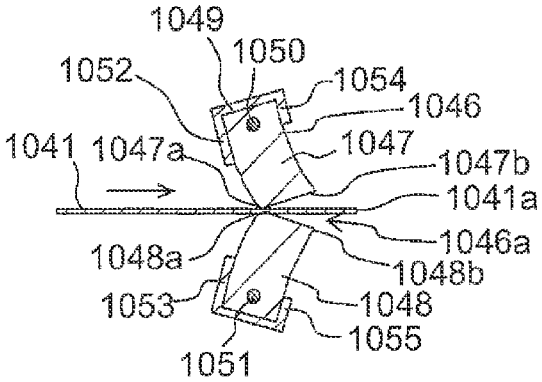

As depicted in FIGS. 21A to 21C, when the wiper 1041 moves rearward from the waiting position to the wiping position, a rear end 1041*a* (the front end in the wiper travelling direction) of the wiper 1041 makes contact with the front surface of the wiper cleaner 1046, in particular, the boundary (space 1046*a*) between two cleaner parts 1047, 1048 or the vicinity thereof. The front surfaces of two cleaner parts 1047, 1048 are inclined in the left-right direction (scanning direction) so that portions, of the front surfaces, closest to the space 1046*a* in the left-right direction, are positioned on the rearmost side in the front-rear direction. Thus, even when the rear end 1041*a* of the wiper 1041 makes contact with a position deviating from the space 1046*a*, the rear end 1041*a* of the wiper 1041 moves along the front surface of the cleaner part (1047 or 1048) to be guided to the space 1046*a* during the movement of the wiper 1041. This can insert the rear end 1041*a* of the wiper 1041 into the space 1046*a* reliably.

When the wiper 1041 is inserted into the space 1046*a* of the wiper cleaner 1046, surfaces 1041*s*1, 1041*s*2 of the wiper 1041 make contact with the facing surfaces of two cleaner parts 1048, 1047 respectively. In this situation, when the wiper 1041 further moves rearward, two cleaner parts 1047, 1048 rotate rearward while being deformed to bend rearward, with two shafts 1050, 1051 as the rotation centers. This expands the space 1046 between two cleaner parts 1047, 1048. The contact surface pressure between the wiper 1041 and two cleaner parts 1047, 1048 is smaller, as the wiper 1041 moves further rearward to pass through the space 1046*a*. Thus, the wiper 1041 can pass through the space 1046*a* of the wiper cleaner 1046 smoothly. Further, since the space 1046*a* is expanded by the wiper 1041, the contact surface pressure between the wiper 1041 and the wiper 1046 can be ensured to some extent, although the contact surface pressure is small. Therefore, when the ink is adhering to the wiper 1041, the ink can be absorbed into the wiper cleaner 1046 and removed.

Figure 22A:
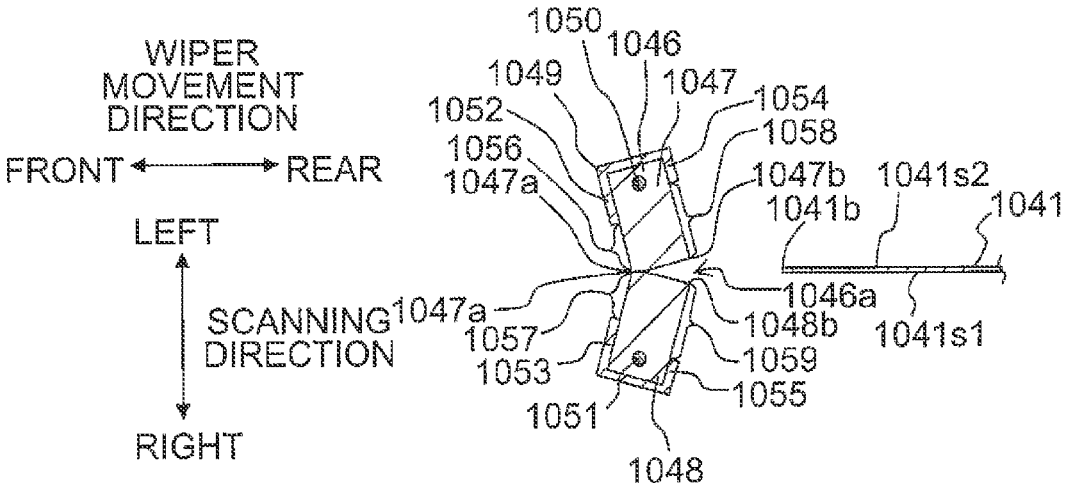
FIGS. 22A to 22C are views depicting a process, in which the wiper moves from the wiping position to the waiting position, according to the second embodiment.
Figure 22B:
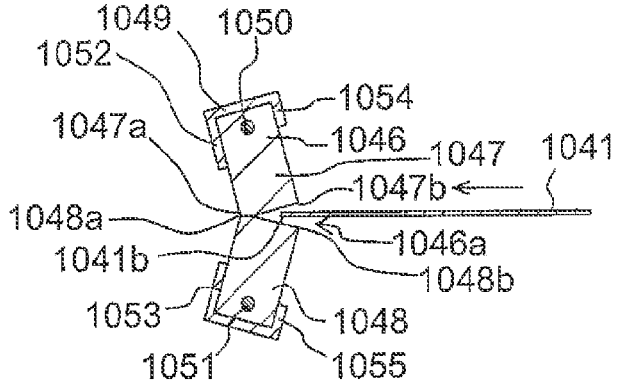
Figure 22C:
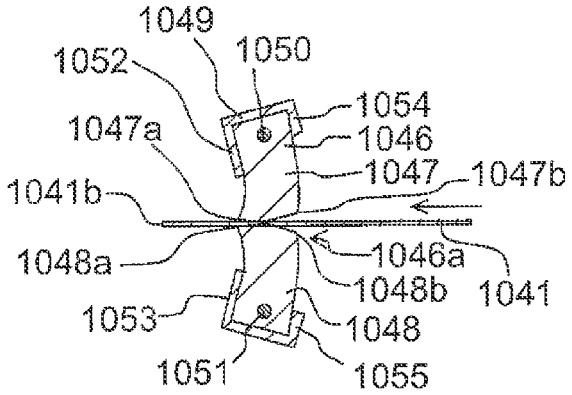

As depicted in FIGS. 22A to 22C, when the wiper 1041 moves frontward from the wiping position to the waiting position, a front end 1041*b* (the front end in the wiper travelling direction) of the wiper 1041 is inserted first into a space between the rear ends 1047*b*, 1048*b* of the facing surfaces of two cleaner parts 1047, 1048. The clearance between the rear ends 1047*b*, 1048*b* of the facing surfaces of two cleaner parts 1047, 1048 is greater than the clearance between the front ends 1047*a*, 1048*a* of the facing surfaces of two cleaner parts 1047, 1048. Thus, the front end 1041*b* of the wiper 1041 can be inserted into the space 1046*a* reliably.

When the inserted wiper 1041 moves frontward, the surfaces 1041*s*1, 1041*s*2 of the wiper 1041 make contact with the facing surfaces of two cleaner parts 1047, 1048. In this situation, when the wiper 1041 further moves frontward, two cleaner parts 1047, 1048 rotate frontward while being deformed to bend frontward, with two shafts 1050, 1051 as the rotation centers. This narrows the space 1046*a* between two cleaner parts 1047, 1048. Thus, the wiper cleaner 1046 can be pressed strongly against the wiper 1041 to increase the contact area between the wiper 1041 and the wiper cleaner 1046, as compared with the case in which the wiper 1041 moves rearward. As a result, the ink, which adhered to the wiper 1041 during the wiping operation for the ink discharge surface 4*a* at the wiping position, can be absorbed into the wiper cleaner 1046 and removed reliably. Further, although the space 1046*a* of the wiper cleaner 1046 is reduced, the rotations of two cleaner parts 1047, 1048 allow the wiper 1041 to pass through the space 1046*a* smoothly, as compared with the case in which the same level of contact surface pressure is generated without rotations of two cleaner parts 1047, 1048.

As depicted in FIGS. 22A to 22C, when the wiper 1041 moves frontward through the space 1046*a*, the front surfaces of two cleaner parts 1047, 1048 are pressed against the first pressing walls 1052, 1053 of the cleaner holder 1049. This regulates the frontward rotations and deformations of two cleaner parts 1047, 1048. Further, as depicted in FIGS. 21A to 21C, when the wiper 1041 moves rearward through the space 1046*a*, the rear surfaces of two cleaner parts 1047, 1048 are pressed against the second pressing walls 1054, 1055 of the cleaner holder 1049. This regulates the rearward rotations and deformations of two cleaner parts 1047, 1048. Accordingly, two cleaner parts 1047, 1048 are prevented from being rotated and deformed excessively. This restores two cleaner parts 1047, 1048 to shapes or states before the rotation and deformation by the aid of the resilience, after the wiper 1041 passes through the space 1046*a*.

The lengths of the exposed parts 1056, 1057 in the horizontal direction are shorter than the lengths of the exposed parts 1058, 1059 in the horizontal direction. The exposed parts 1056, 1057 are parts which are included in the front surfaces of two cleaner parts 1047, 1048 respectively and are not covered with the first pressing walls 1052, 1053 respectively; and the exposed parts 1058, 1059 are parts which are included in the rear surfaces of two cleaner parts 1047, 1048 respectively and are not covered with the second pressing walls 1054, 1055 respectively. Thus, when the wiper 1041 moves frontward through the space 1046*a*, the rotations and deformations of two cleaner parts 1047, 1048 are regulated more reliably than the case in which the wiper 1041 moves rearward through the space 1046*a*. This prevents two cleaner parts 1047, 1048 from being rotated excessively, and thereby making it possible to prevent the space between the front ends 1047*a*, 1048*a* (including the vicinities thereof) of facing surfaces of two cleaner parts 1047, 1048 from being expanded.

As described above, the ink is less likely to adhere to the left surface 1041*s*2 (the second surface of the present teaching) of the wiper 1041. Thus, the cleaner part 1047 (the second contact part of the present teaching), which makes contact with the left surface 1041*s*2 of the wiper 1041, has little association with the cleaning for the wiper 1041 in some cases. In both of the case where the ink adheres to the left surface 1041*s*2 and the case where no ink adheres to the left surface 1041*s*2, the cleaner part 1047 functions to ensure the contact surface pressure between the right surface 1041*s*1 (the first surface of the present teaching) of the wiper 1041 and the cleaner part 1048.

An explanation will be made in detail about the action or motion of the maintenance unit 1006. The control unit 7 controls the maintenance unit 1006 to move, in a case that the suction purge for the ink-jet head 4 is required to be performed. The case includes, for example, the timing immediately after power is applied to the ink-jet printer 1 and the case in which a purge command is inputted by a user.

Figure 20B:
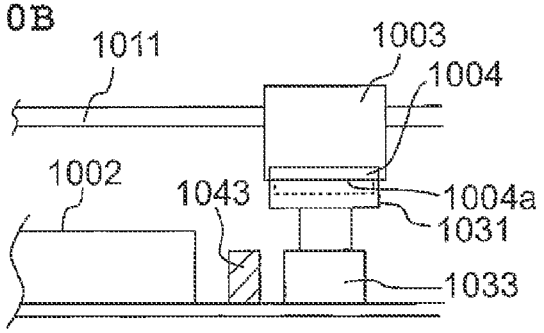
Figure 20C:
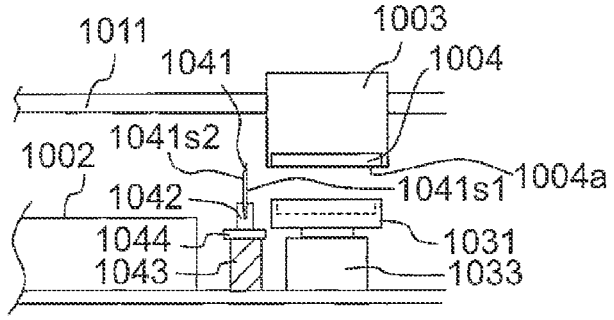
Figure 20D:
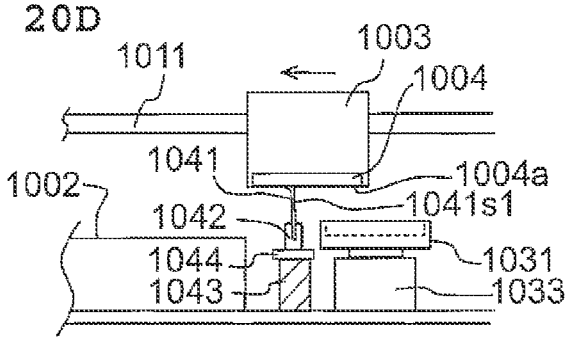

At first, as depicted in FIG. 20A, the ink-jet head 4 is positioned in the maintenance position to face the suction cap 31. Next, the cap lifting motor 24 is driven to move the suction cap 31 upward from the waiting position depicted in FIG. 20A. Then, the suction cap 31 is brought into tight contact with the ink discharge surface 4*a* of the ink-jet head 4 as depicted in FIG. 20B. In this state, the suction pump 32 is driven to reduce the pressure in the suction cap 31. In this way, foreign matters and bubbles mixed in the ink-jet head 4 are sucked and discharged, together with the ink, from the ink discharge ports 16 covered with the suction cap 31 (suction purge).

After the suction purge for a certain period of time, the suction cap 31 is moved down to return to the waiting position. In this situation, a part of the ink, which was discharged from the ink discharge ports 16 during the suction purge, is adhering to the ink discharge surface 4*a*. Thus, subsequent to the suction purge, the wiper 1041 wipes off the ink on the ink discharge surface 4*a*. As depicted in FIG. 20C and FIGS. 21A to 21C, the wiper drive motor 25 is at first driven to move the wiper 1041 from the waiting position to the wiping position. During this movement, the wiper 1041 passes through the space 1046*a* of the wiper cleaner 1046.

Next, as depicted in FIG. 20D, the carriage 3 moves in a direction closer to the platen 2 to bring the ink discharge surface 4*a* of the ink-jet head 4 into contact with the upper end of the wiper 1041. This allows the wiper 1041 to wipe off the ink adhering to the ink discharge surface 4*a*. After that, as depicted in FIGS. 22A to 22C, the wiper 1041 is moved from the wiping position to the waiting position by the wiper drive motor 25. During this movement, the wiper 1041 passes through the space 1046*a* of the wiper cleaner 1046, and thus the ink, which adhered to the wiper 1041 during the wiping operation for the ink discharge surface 4*a*, is removed by the wiper cleaner 1046, and thereby cleaning the wiper 1041.

In the second embodiment, the scanning direction (left-right direction) corresponds to a first direction of the present teaching; the wiper movement direction (front-rear direction) corresponds to a third direction of the present teaching; the front side corresponds to a first way in the third direction of the present teaching; and the rear side corresponds to a second way in the third direction of the present teaching.

<Modified Embodiments of the Second Embodiment>

Although the second embodiment of the present teaching has been explained above, the present teaching is not restricted to the second embodiment and various changes may be made within the scope of the claims.

In the second embodiment, the lengths of the parts, which are included in the front surfaces of two cleaner parts 1047, 1048 and are not covered with the first pressing walls 1052, 1053, in the horizontal direction are shorter than the lengths of the parts, which are included in the rear surfaces of two cleaner parts 1047, 1048 and are not covered with the second pressing walls 1054, 1055, in the horizontal direction. However, the lengths of the parts, which are included in the front surfaces of two cleaner parts 1047, 1048 and are not covered with the first pressing walls 1052, 1053, in the horizontal direction may be longer than the lengths of the parts, which are included in the rear surfaces of two cleaner parts 1047, 1048 and are not covered with the second pressing walls 1054, 1055, in the horizontal direction.

In the second embodiment, the cleaner part 1047 is the rectangular parallelepiped. The surface, of the cleaner part 1047, facing the cleaner part 1048 is orthogonal to the front and rear surfaces of the cleaner part 1047. The facing surface, however, may be inclined to the front surface and/or the rear surface of the cleaner part 1047. The same is true for the clear part 1048.

Figure 23:
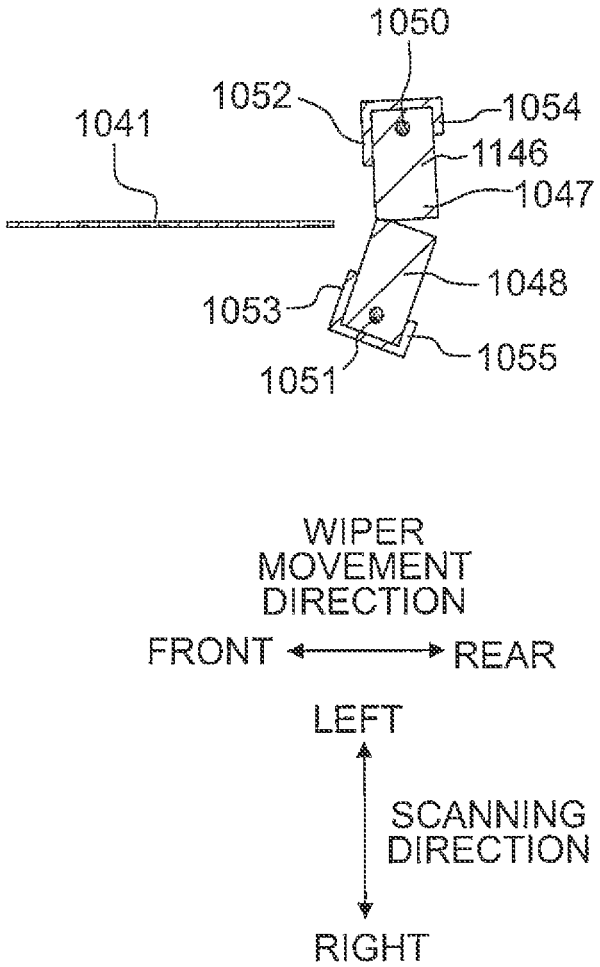
FIG. 23 is a view depicting an ink-jet printer according to a modified embodiment of the second embodiment and corresponding to FIG. 21A.

In the second embodiment, two cleaner parts 1047, 1048 are bilaterally symmetrical. However, like a wiper cleaner 1146 depicted in FIG. 23, two cleaner parts 1047, 1048 may be unsymmetrical (with respect to the straight line extending in the wiper movement direction). In FIG. 23, although two cleaner parts 1047, 1048 have the same rectangular parallelepiped shape, two cleaner parts 1047, 1048 may have different shapes.

Figure 24:
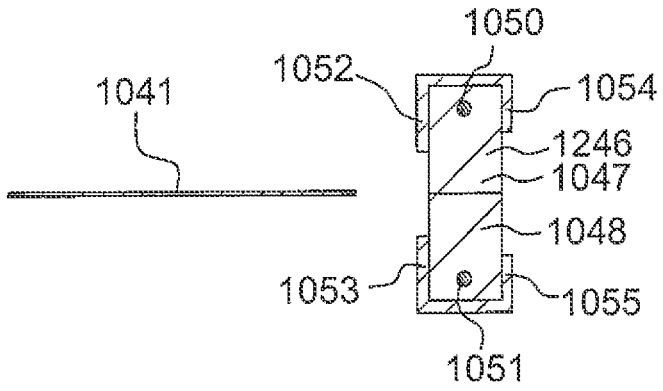
FIG. 24 is a view depicting an ink-jet printer according to a modified embodiment of the second embodiment and corresponding to FIG. 21A.
Figure 24:
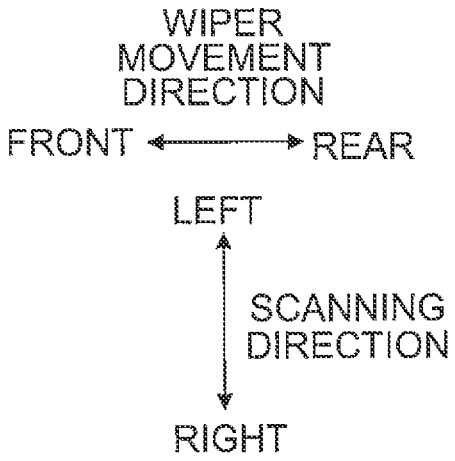

In the second embodiment, both of the facing surfaces of two cleaner parts 1047, 1048 are inclined to the front-rear direction (wiper movement direction). However, one of the facing surfaces of two cleaner parts 1047, 1048 may be parallel to the front-rear direction (wiper movement direction) and the other of the facing surfaces may be inclined to the front-rear direction. Further, like a wiper cleaner 1246 depicted in FIG. 24, both of the facing surfaces of two cleaner parts 1047, 1048 may be parallel to the front-rear direction (wiper movement direction). In the modified embodiment depicted in FIG. 24, the facing surfaces of two cleaner parts 1047, 1048 are perpendicular to the front and rear surfaces of two cleaner parts 1047, 1048. Thus, the space 1046*a* between two cleaner parts 1047, 1048 expands when two cleaner parts 1047, 1048 rotate in any of forward and rearward directions.

Figure 25:
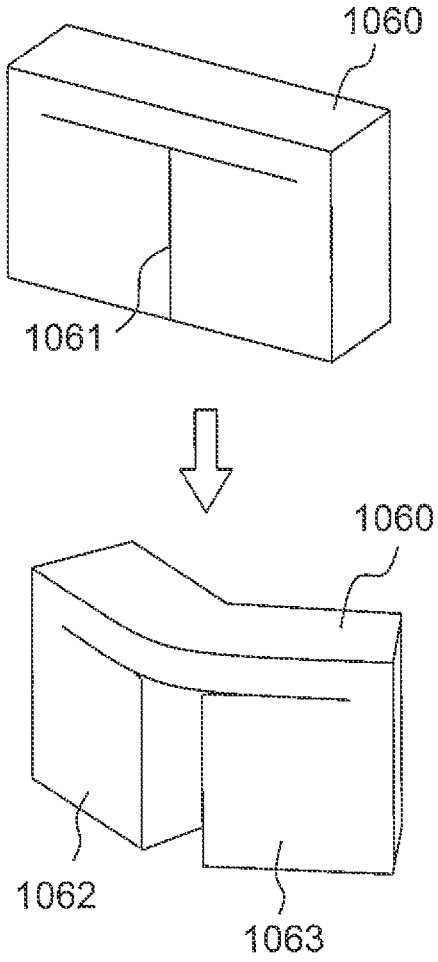
FIG. 25 is a view illustrating a process for producing a wiper cleaner of an ink-jet printer according to a modified embodiment of the second embodiment.

In the second embodiment, the wiper cleaner 1046 is formed of two members (cleaner parts 1047, 1048). The wiper cleaner 1046, however, may be formed only of a single member. For example, as depicted in FIG. 25, the wiper cleaner 1046 may be formed as follows. That is, an absorbing member 1060 in a flat plate shape is allowed to have a T-shaped cut 1061. After that, the absorbing member 1060 is bent so that parts 1062, 1063 (the second and first contact parts of the present teaching) on both sides of the cut extending in the up-down direction are disposed obliquely to the left-right direction and front-rear direction, in a similar manner to two cleaner parts 1047, 1048 in the second embodiment.

In the second embodiment, both of the two cleaner parts 1047, 1048 are rotatably held by the cleaner holder 1049. However, one of the two cleaner parts 1047, 1048 may be rotatably held by the cleaner holder 1049; and the other of the two cleaner parts 1047, 1048 may be non-rotatably fixed to the cleaner holder 1049. Noted that, the space between two cleaner parts 1047, 1048 changes more greatly in the configuration in which both of the two cleaner parts 1047, 1048 are rotatably held by the cleaner holder 1049. This allows the wiper 1041 to pass through the space 1046 more easily. Thus, the configuration in the second embodiment is more preferred.

Figure 26:
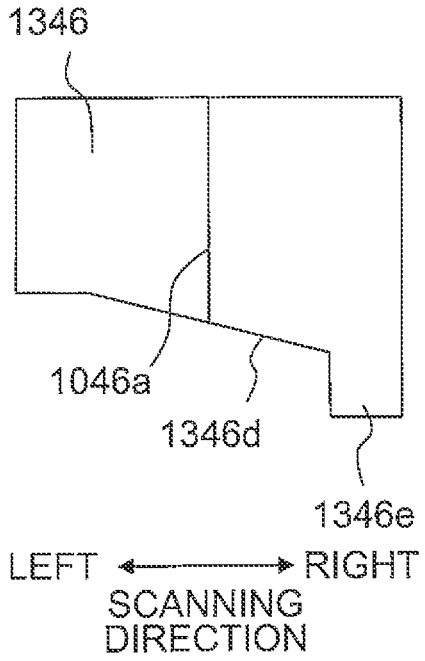
FIG. 26 is a front view of a wiper cleaner of an ink-jet printer according to a modified embodiment of the second embodiment.

In the second embodiment, the entire lower surface of the wiper cleaner 1046 is horizontal. However, as depicted in FIG. 26, at least a part (inclined surface 1346*b*), of the lower surface of a wiper cleaner 1346, close to the slit 1046*a* may be inclined to the horizontal surface to have different levels in the left-right direction. This moves the ink absorbed in the wiper cleaner 1346 downward along the inclined surface 1346*b*, so that the ink gathers at a lower part of the inclined surface 1346*b*. In FIG. 26, the wiper cleaner 1346 includes an ink discharge part 1346*c* protruding downward beyond the lowermost end of the inclined surface 1346*b*. The ink is discharged from the ink discharge part 1346*c*.

Figure 27:
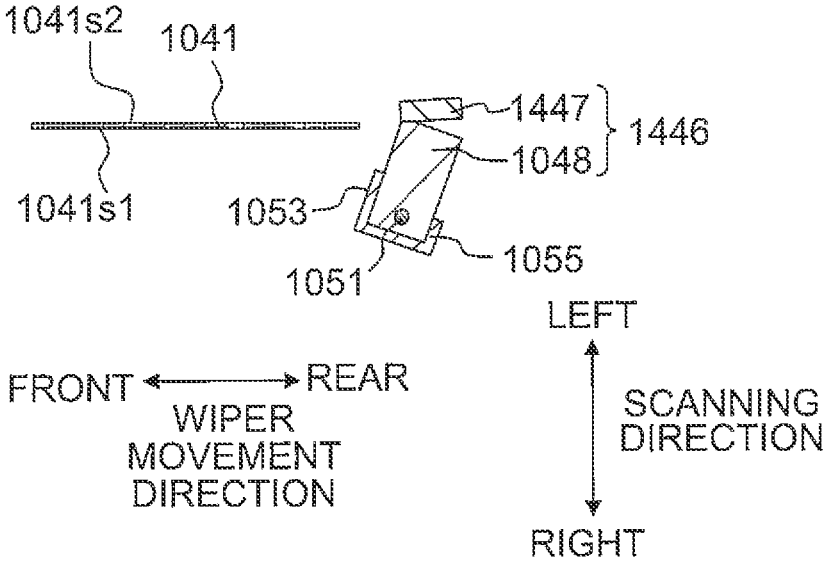
FIG. 27 is a view depicting an ink-jet printer according to a modified embodiment of the second embodiment and corresponding to FIG. 21A.

In the second embodiment, the wiper cleaner 1046 is formed only of the absorber. However, as depicted in FIG. 27, a wiper cleaner 1446 may be formed of the cleaner part 1048 (the first contact part of the present teaching) and a wiper contact part 1447 (the second contact part of the present teaching). The cleaner part 1048 is made of the absorber, and the wiper contact part 1447 is made of synthetic resin and the like to have the rigidity higher than that of the absorber. The cleaner part 1048 makes contact with the right surface 1041*s*1 of the wiper 1041 (the first surface of the present teaching), and the wiper contact part 1447 makes contact with the left surface 1041*s*2 of the wiper 1041 (the second surface of the present teaching). Although the wiper contact part 1447 is non-rotatably provided in FIG. 27, the wiper contact part 1447 may be rotatably provided. Since the ink is more likely to adhere to the right surface 1041*s*1, the wiper 1041 can be cleaned with the wiper cleaner 1446 as well. However, the wiper cleaner 1046 in the second embodiment is more preferred to improve the cleaning quality. The wiper contact part 1447 functions to ensure the contact surface pressure between the right surface 1041*s*1 of the wiper 1041 and the cleaner part 1048.

In the second embodiment, the waiting position of the wiper 1041 is on the front side of the wiping position in the sheet conveyance direction. The waiting position of the wiper 1041, however, may be on the rear side of the wiping position.

In the second embodiment, the wiper 1041 is disposed so that the longitudinal direction thereof is parallel to the ink discharge surface 4*a* and orthogonal to the scanning direction, and the wiper movement mechanism 1043 drives the wiper 1041 in the longitudinal direction of the wiper 1041. The arrangement direction and driving direction of the wiper 1041, however, are not limited to those. The longitudinal direction of the wiper 1041 may be any direction, provided that the longitudinal direction of the wiper 1041 intersects with both of the scanning direction and the direction (up-down direction) orthogonal to the ink discharge surface 4*a*. Further, the movement direction of the wiper 1041 by the wiper movement mechanism 1043 may not be perfectly parallel to the longitudinal direction of the wiper 1041, provided that the movement direction of the wiper 1041 is along the wiper 1041. In the second embodiment, the wiper 1041 is disposed so that the upper end thereof is perpendicular to the up-down direction. The wiper 1041, however, may be disposed so that the upper end thereof is inclined to the up-down direction.

Figure 28A:
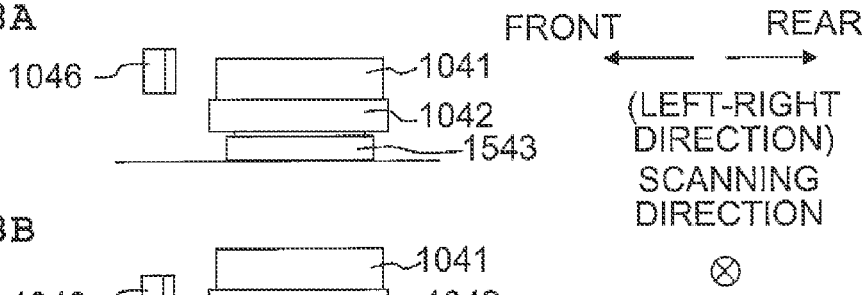
FIGS. 28A to 28G are illustrative views each illustrating an operation of an ink-jet printer according to a modified embodiment of the second embodiment.
Figure 28B:
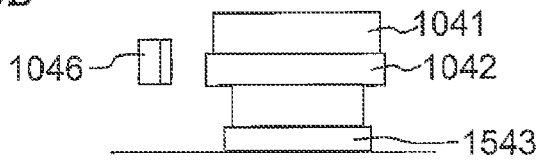
Figure 28C:
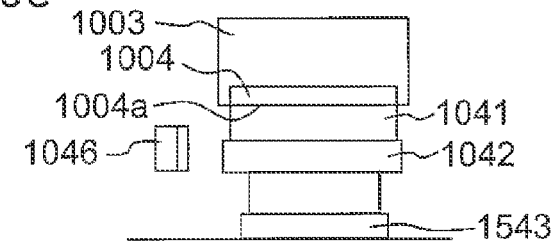
Figure 28D:
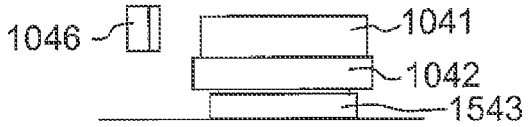
Figure 28E:
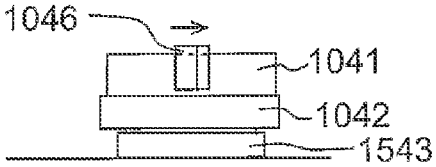
Figure 28F:
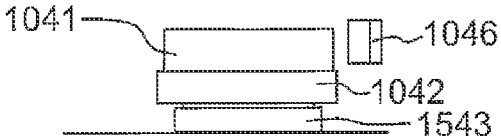
Figure 28G:
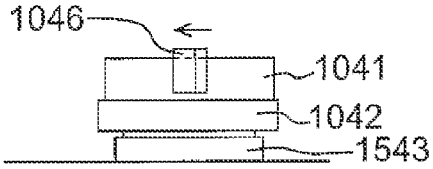
Figure 29A:
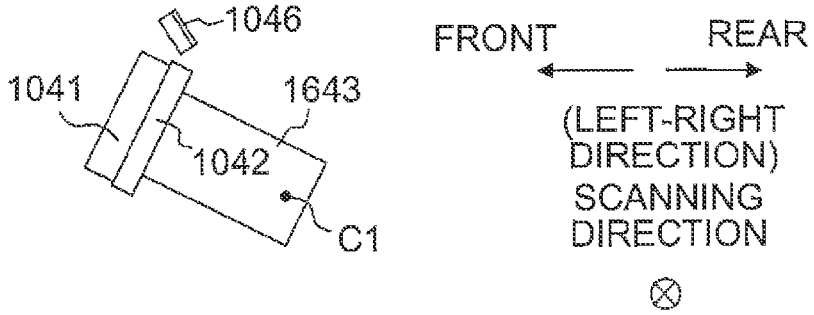
FIGS. 29A to 29E are illustrative views each illustrating an operation of an ink-jet printer according to a modified embodiment of the second embodiment.
Figure 29B:
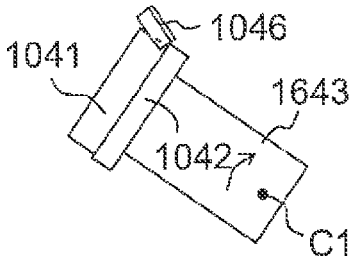
Figure 29C:
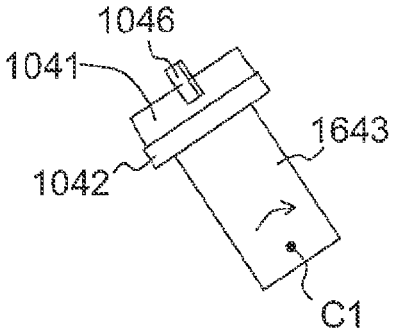
Figure 29D:
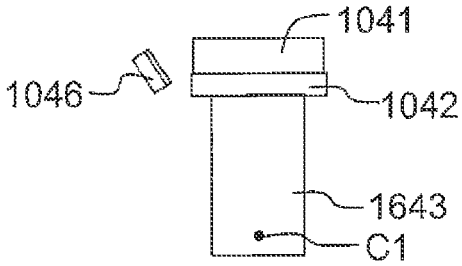
Figure 29E:
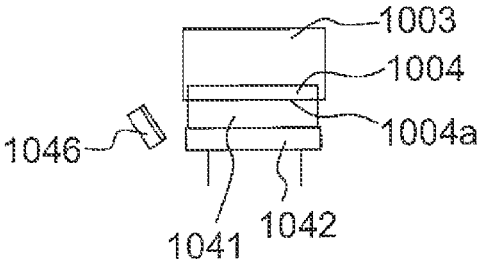

In the second embodiment, the movement of the wiper 1041 causes the relative movement between the wiper 1041 and the wiper cleaner 1046. However, as depicted in FIGS. 28D to 28G, the movement of the wiper cleaner 1046 in the front-rear direction may cause the relative movement between the wiper 1041 and the wiper cleaner 1046. In the modified embodiment depicted in FIGS. 28A to 28G, the wiper cleaner 1046 is allowed to reciprocate in the direction (front-rear direction) parallel to the ink discharge surface 4*a* and orthogonal to the scanning direction by an unillustrated movement mechanism (corresponding to a first movement mechanism of the present teaching), which is driven by a motor or the like; and the wiper 1041 is allowed to move up and down by a lifting mechanism 1543, which is driven by a motor or the like. The illustration of the cleaner holder 1049 is omitted in FIGS. 28A and 28G. When the wiper 1041 wipes off the ink on the ink discharge surface 4*a*, the wiper 1041 at first moves upward from the position depicted in FIG. 28A to the position depicted in FIG. 28B. Then, the ink-jet head 4 moves in the scanning direction as depicted in FIG. 28C in a state that the wiper 1041 is in the position depicted in FIG. 28B, thereby wiping off the ink adhering to the ink discharge surface 4*a* with the wiper 1041. After that, the wiper 1041 moves down as depicted in FIG. 28D. After the downward movement of the wiper 1041, as depicted in FIGS. 28E to 28G, the wiper cleaner 1046 reciprocates in the front-rear direction to remove the ink adhering to the wiper 1041 with the wiper cleaner 1046.

In the second embodiment, the wiper 1041 linearly moves relative to the wiper cleaner 1046 in the longitudinal direction of the wiper 1041. However, as depicted in FIGS. 29A to 29E, the wiper 1041 may move relative to the wiper cleaner 1046 in a circumferential direction around an axis C1 extending in a direction orthogonal to the wiper 1041. In this case, the wiper 1041 intersects with the wiper cleaner 1046 in the direction (up-down direction) orthogonal to the ink discharge surface 4*a*, and the wiper 1041 moves relative to the wiper cleaner 1046 in the direction intersecting with the scanning direction. In FIGS. 29A to 29E, the wiper cleaner 1046 is fixed and the wiper 1041 is rotatably moved by a wiper movement mechanism 643, which is driven by a motor or the like. However, the wiper 1041 may be fixed and the wiper cleaner 1046 may be rotated. The illustration of the cleaner holder 1049 is omitted in FIGS. 29A to 29E. Since the wiper movement mechanism 643 in this modified embodiment is larger than the wiper movement mechanism 1043 in the second embodiment, the second embodiment is more preferred in view of downsizing of the wiper movement mechanism (the first movement mechanism of the present teaching).

Figure 30:
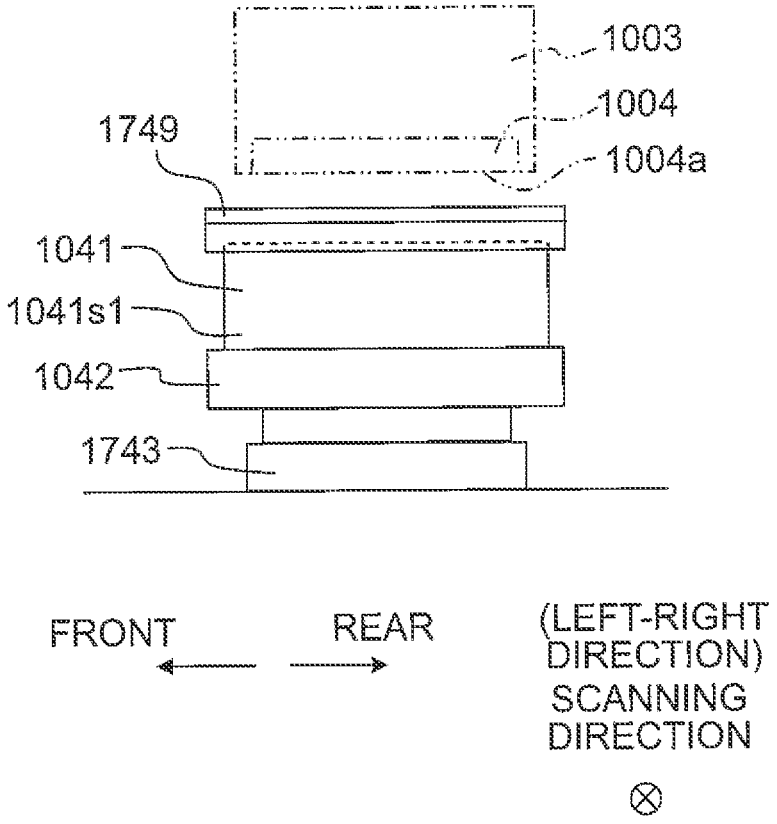
FIG. 30 is a view depicting an ink-jet printer according to a modified embodiment of the second embodiment and corresponding to FIG. 18.
Figure 31A:
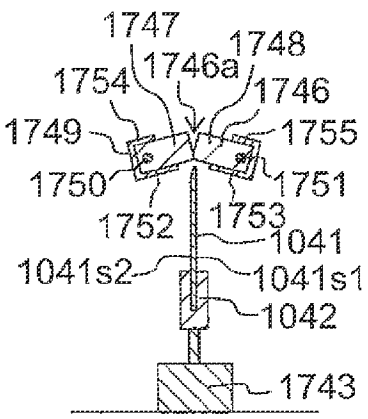
FIGS. 31A to 31D are illustrative views each illustrating an operation of the ink-jet printer depicted in FIG. 30.
Figure 31B:
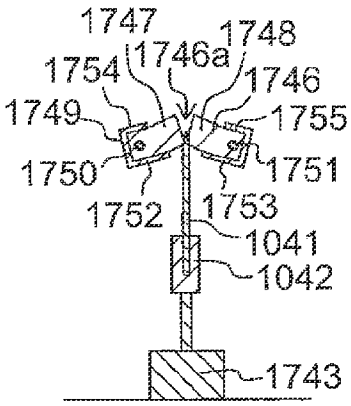
Figure 31C:
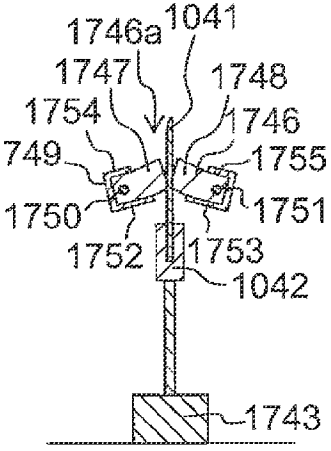
Figure 31D:
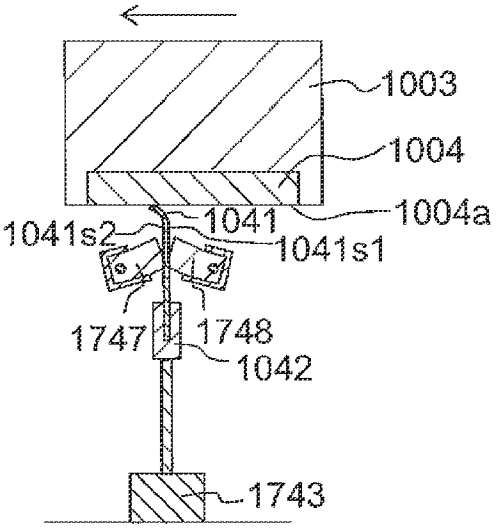

Further, as depicted in FIGS. 30 and 31A to 31D, the wiper 1041 may move relative to a wiper cleaner 1746 in the up-down direction perpendicular to the ink jetting surface 4*a*. In the modified embodiment depicted in FIGS. 30 and 31A to 31D, the wiper 1041 is allowed to move up and down by a lifting motor 743, which is driven by the motor or the like. The wiper cleaner 1746 includes two rectangular parallelepiped cleaner parts 1747, 1748 which are disposed in the left-right direction. The two cleaner parts 1747, 1748 extend in the front-rear direction. The lengths, of two cleaner parts 1747, 1748, in the front-rear direction are the same as or longer than the length, of the wiper 1041, in the front-rear direction. Further, two cleaner parts 1747, 1748 are obliquely disposed in the left-right direction and the up-down direction so that the length of a space 1746*a* in the left-right direction increases toward the upper side. The wiper cleaner 1746 is held by a cleaner holder 1749. The cleaner holder 1749 includes two shafts 1750, 1751 penetrating through two cleaner parts 1747, 1748 in the front-rear direction; two first pressing walls 1752, 1753 which cover parts of lower surfaces (each of which is the first side surface of the present teaching) of two cleaner parts 1747, 1748 respectively; and two second pressing walls 1754, 1755 which cover parts of upper surfaces (each of which is the second side surface of the present teaching) of two cleaner parts 1747, 1748 respectively. The lengths, of the first pressing walls 1752, 1753, in the left-right direction are longer than the lengths, of the second pressing walls 1754, 1755, in the left-right direction. During a normal time including the duration of time in which printing is performed, the wiper 1041 is positioned below the wiper cleaner 1746 as depicted in FIGS. 30 and 31A. When the ink on the ink discharge surface 4*a* is wiped off, the wiper 1041 at first moves upward to be inserted into the space 1746*a* of the wiper cleaner 1746, as depicted in FIGS. 31B and 31C. In this situation, two cleaner parts 1747, 1748 are rotated and deformed toward the side on which the length of the space 1746*a* in the left-right direction is longer. After the wiper 1041 reaches a predetermined position, as depicted in FIG. 31D, the ink-jet head 4 moves in the scanning direction, thereby wiping the ink discharge surface 4*a* with the wiper 1041. Then, the wiper 1041 moves down to the position depicted in FIG. 31A to remove the ink adhering to the wiper 1041 by the wiper cleaner 1746. In this situation, two cleaner parts 1747, 1748 are rotated and deformed toward the side on which the length of the space 1046*a* in the left-right direction is narrower. Since the wiper cleaner 1746 in this modified embodiment is larger than the wiper cleaner 1046 in the second embodiment, the second embodiment is more preferred in view of downsizing of the wiper cleaner.

In the second embodiment, the friction force between two cleaner parts 1047, 1048 and the wiper 1041 causes parts, of two cleaner parts 1047, 1048, which are brought into contact with the wiper 1041, to be dragged along the wiper 1041, thereby rotating two cleaner parts 1047, 1048. The method of rotating two cleaner parts 1047, 1048, however, is not limited to this. For example, the following manner is also allowable. That is, the shafts 1050, 1051 are fixed to two cleaner parts 1047, 1048 respectively, and the control unit 7 controls a motor or the like, which is provided to rotate and drive the shafts 1050, 1051, during the movement of the wiper 1041 in the wiper movement direction, thereby rotating two cleaner parts 1047, 1048 while deforming the space therebetween.

In the second embodiment, the ink-jet head 4 moves leftward to wipe the ink discharge surface 4*a* with the right surface 1041*s*1 of the wiper 1041. The ink-jet head 4, however, may move rightward to wipe the ink discharge surface 4*a* with the left surface 1041*s*2 of the wiper 1041. Alternatively, the ink-jet head 4 may reciprocate in the left-right direction to wipe the ink discharge surface 4*a* with the right and left surfaces 1041*s*1 and 1041*s*2 of the wiper 1041 in a state that the wiper 1041 is in the wiping position.

In the second embodiment, the ink-jet head 4 and the carriage 3 move in the scanning direction to wipe the ink discharge surface 4*a* with the wiper 1041. However, the following configuration is also allowable. That is, the wiper 1041 is caused to move relative to the ink-jet head 4 by a suitable means, such as a motor, thereby wiping the ink discharge surface 4*a*.

The wiping direction of the wiper 1041 (the movement direction relative to the ink discharge surface 4*a*) is not limited to the direction away from the platen 2. For example, the wiper 1041 may move in the direction close to the platen 2, or the wiper 1041 may be disposed in the direction intersecting with the sheet conveyance direction to move in the sheet conveyance direction.

The timing at which the wiper 1041 wipes off the ink adhering to the ink discharge surface 4*a* is not limited to the timing after the suction purge which is an exemplary timing in the second embodiment. For example, the wiper 1041 may wipe off the ink after printing is performed by discharging the ink onto the recording sheet P.

<Third Embodiment>

Figure 32:
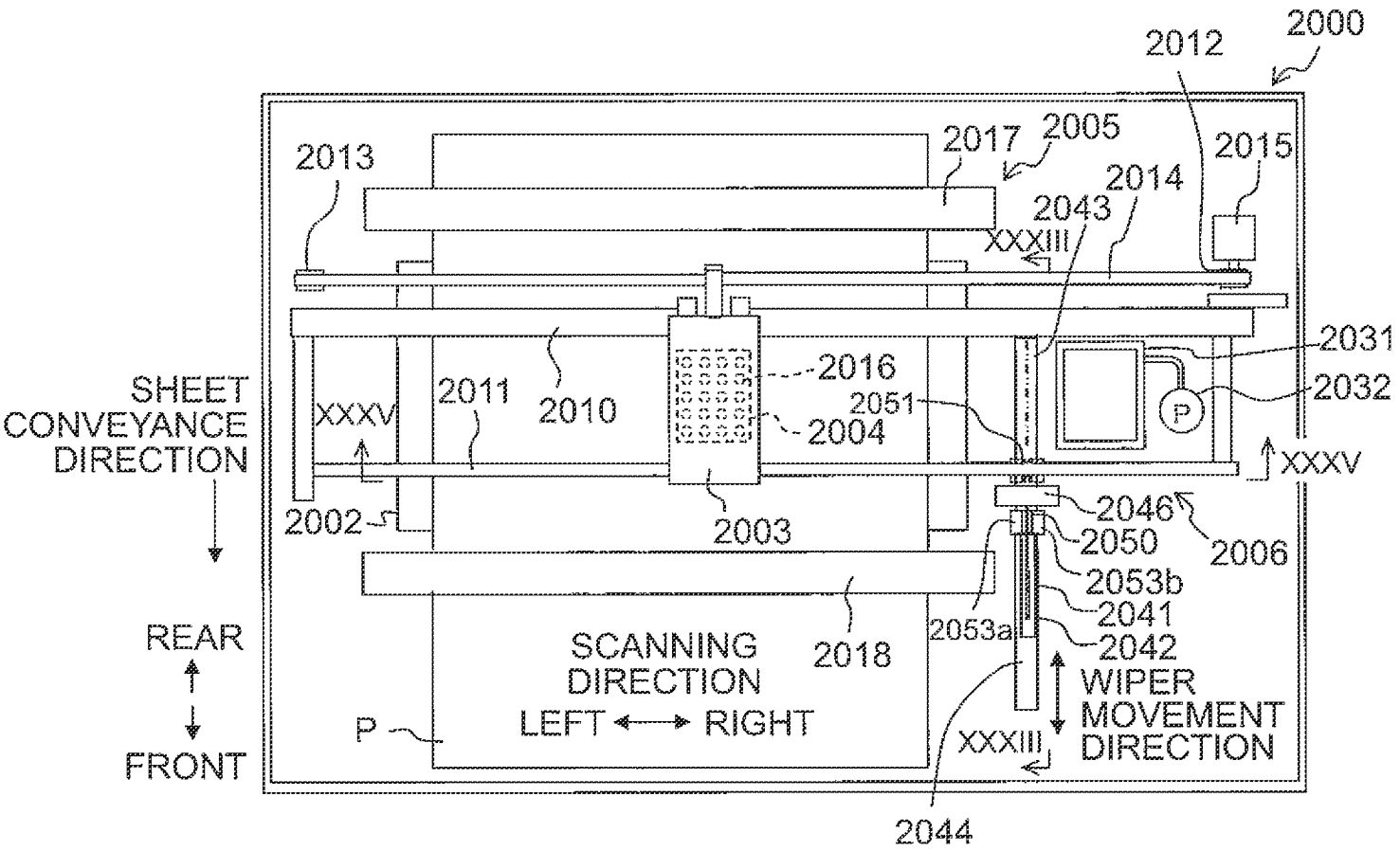
FIG. 32 is a schematic plan view depicting an ink-jet printer according to a third embodiment of the present teaching.

Next, an explanation will be made about the third embodiment of the present teaching. The constitutive parts or components, which are the same as or equivalent to those of the first and second embodiments, are designated by the same reference numerals, any explanation of which will be omitted as appropriate. As depicted in FIG. 32, an ink-jet printer 2001 (a liquid discharge apparatus of the present teaching) includes a platen 2 on which a recording sheet P is placed, a carriage 3 which is reciprocatively movable in a scanning direction (left-right direction) parallel to the platen 2, an ink-jet head 4 (a liquid discharge head of the present teaching) which is carried on the carriage 3, a conveyance mechanism 5 which conveys the recording sheet P in a sheet conveyance direction (frontward direction) perpendicular to the scanning direction, a maintenance unit 2006 which performs various maintenance operations to maintain and recover the liquid discharge performance of the ink-jet head 4, a control unit 7 (see FIG. 2) which is in charge of control of the entire parts of components of the ink-jet printer 2001, and the like.

The maintenance unit 2006 is disposed at a maintenance position, which is on the right side of the recording area of the ink-jet head 4 in the scanning direction (left-right direction). In order to remove any foreign matters, bubbles, and the like, mixed in the ink-jet head 4, the maintenance unit 2006 performs a suction purge for sucking and discharging the ink from ink discharge ports 16 and the wiping of ink adhering to an ink discharge surface 4*a* of the ink-jet head 4, when the ink-jet head 4 and the carriage 3 are positioned in the maintenance position. This makes it possible to maintain and recover the ink discharge performance of the ink-jet head 4. The maintenance unit 2006 includes a wiper 2041, a wiper cleaner 2046, a suction cap 31, a suction pump 32, and the like.

Figure 35A:
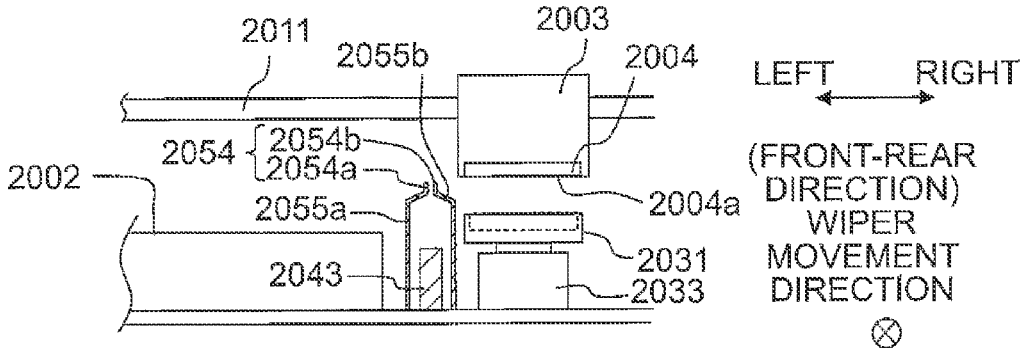
FIGS. 35A to 35D are illustrative views each illustrating an operation of a maintenance unit according to the third embodiment.
Figure 35B:
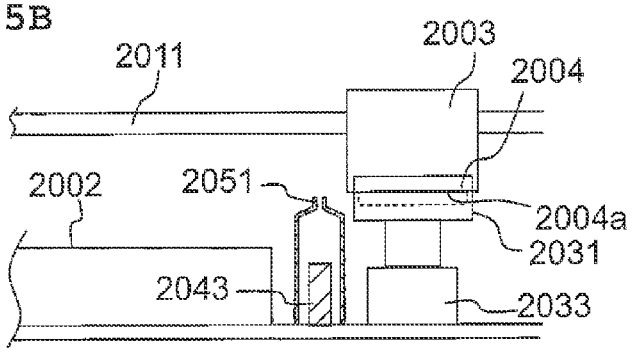

When the ink-jet head 4 is in the maintenance position, the suction cap 31 is positioned to face the ink discharge surface 4*a* of the ink-jet head 4. As depicted in FIGS. 35A and 35B, the suction cap 31 is driven by a cap lifting mechanism 33 in the up-down direction, and the cap lifting mechanism 33 is driven by a cap lifting motor 24 (see FIG. 2). The suction cap 31 is connected to the suction pump 32. FIGS. 35A to 35D are cross sectional views taken along the line XXXV-XXXV in FIG. 32.

When the suction cap 31 is driven to move upward by the cap lifting mechanism 33 in a state that the ink-jet head 4 is in the maintenance position, the suction cap 31 is brought in tight contact with the ink discharge surface 4*a* of the ink-jet head 4 to cover the ink discharge ports 16. In this situation, when the suction pump 32 connected to the suction cap 31 is driven, the pressure in the suction cap 31 is reduced. Thus, the ink in the ink-jet head 4 is sucked from the ink discharge ports 16 and discharged into the suction cap 31 (suction purge).

Figure 33:
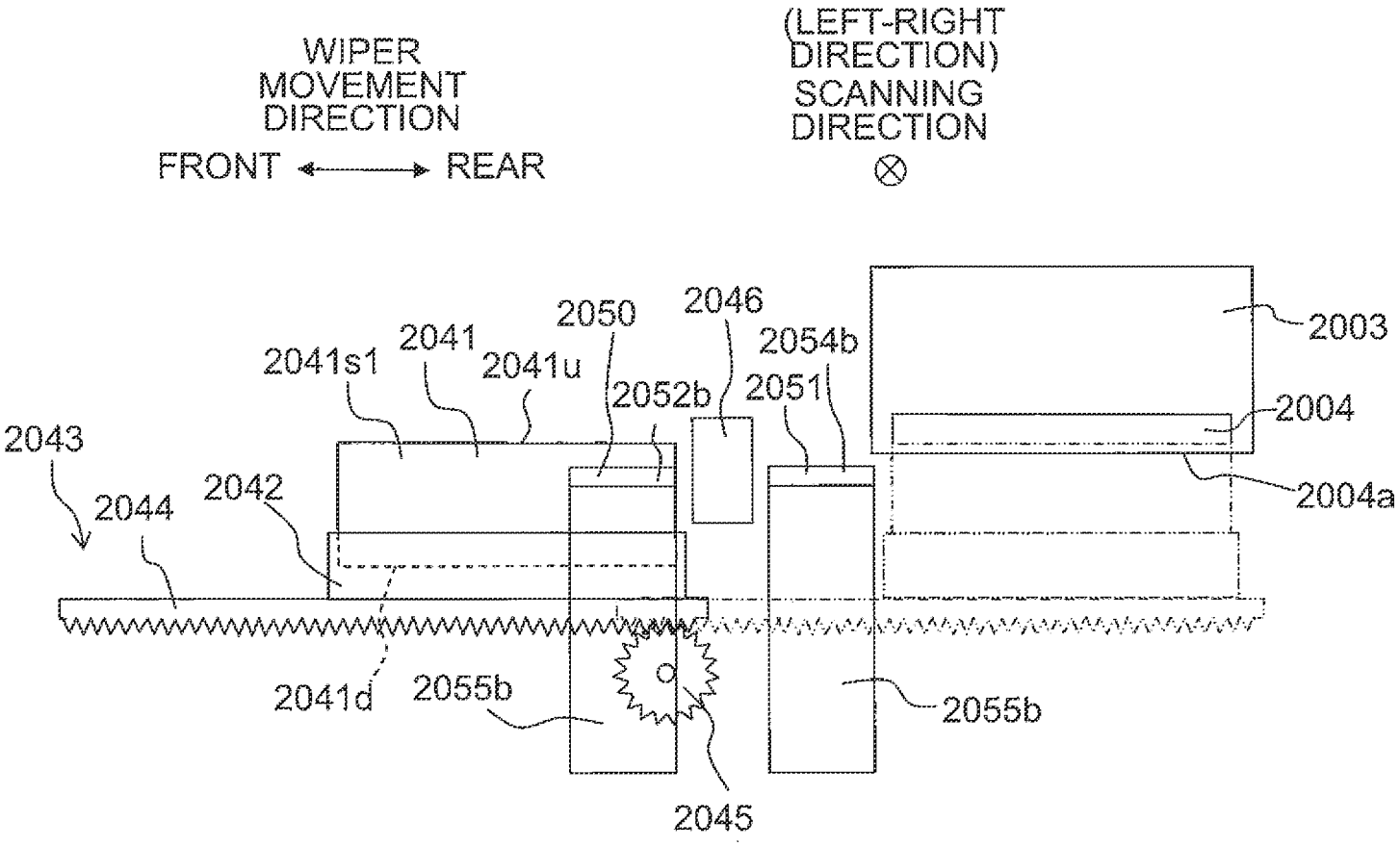
FIG. 33 is a view taken along the arrow XXXIII-XXXIII in FIG. 32.
Figure 34A:
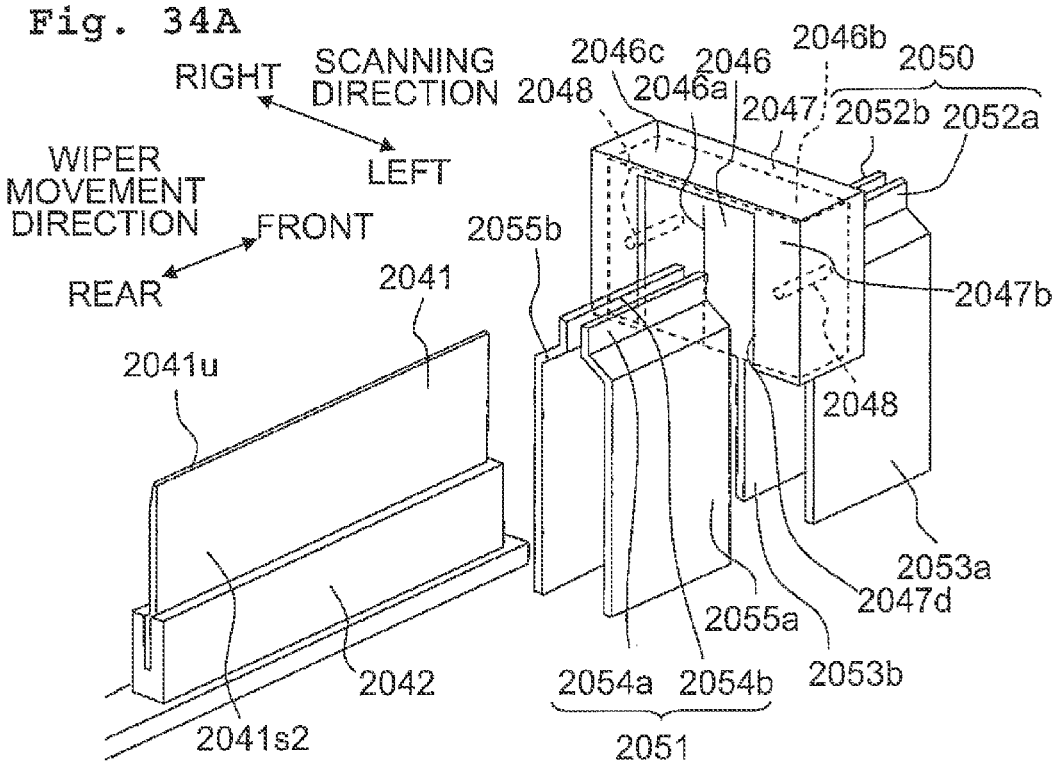
FIG. 34A is a perspective view of a wiper in a wiping position, a wiper cleaner, and a wiper guide, as viewed from the rear side of FIG. 32.

The wiper 2041 is a flat plate member made of flexible material such as rubber and synthetic resin. As depicted in FIGS. 33 and 34A, the wiper 2041 is disposed to be orthogonal to the scanning direction in a state that a terminal end (lower end) 2041*d* is held by a wiper holder 2042. The wiper 2041 is formed in a rectangular shape, and an upper end 2041*u* of the wiper 2041 extends parallel to the ink discharge surface 4*a* in a front-rear direction. The upper end 2041*u* of the wiper 2041 is parallel to the terminal end 2041*d* of the wiper 2041.

The wiper 2041 is reciprocatively and linearly driven by means of a wiper movement mechanism 2043 in a direction (hereinafter referred to as "wiper movement direction") parallel to the ink discharge surface 4*a* and orthogonal to the scanning direction. The wiper 2041 is driven between a wiping position and a waiting position. The wiping position is on the movement path of the carriage 3 in the scanning direction (indicated by alternate long and two short dashes line in FIG. 32 and FIG. 33). The waiting position is on the front side of the wiping position (indicated by solid line in FIG. 32 and FIG. 33). The wiper movement mechanism 2043 includes a rack 44 attached to the wiper holder 2042, a pinion 45 engaging with the rack 44, and a wiper drive motor 25 which drives and rotates the pinion 45. The wiper movement mechanism 2043 may have any other structure than the above.

Figure 35C:
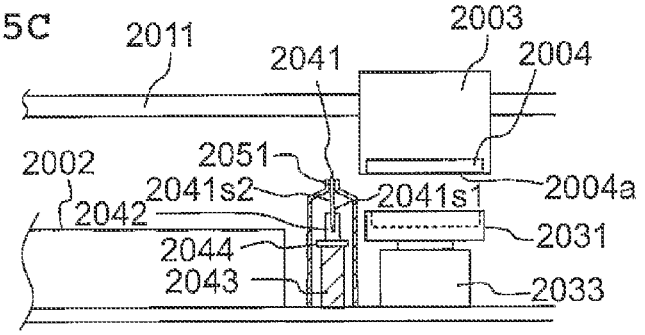
Figure 35D:
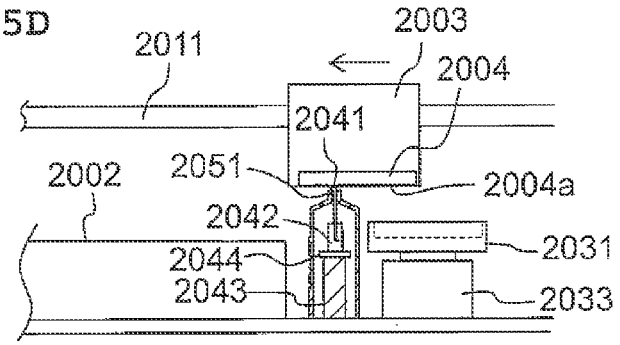

The upper end 2041*u* of the wiper 2041 is positioned above the ink discharge surface 4*a*. As depicted in FIG. 35C and FIG. 35D, when the ink-jet head 4 in the maintenance position moves in the scanning direction (in particular, leftward) with the wiper 2041 being in the wiping position, the ink adhering to the ink discharge surface 4*a* of the ink-jet head 4 is wiped with a right surface 2041*s*1 (a first surface of the present teaching) of the wiper 2041. The ink wiped is more likely to adhere to the right surface 2041*s*1 of the wiper 2041, and is less likely to adhere to a left surface 2041*s*2 (a second surface of the present teaching). The length of the wiper 2041 in the front-rear direction is substantially the same as or longer than the length of the ink discharge surface 4*a* in the front-rear direction. The wiper 2041 can wipe the entire ink discharge surface 4*a* during a single wiping operation.

The wiper 2041 is thin, of which entire thickness is, for example, about 1 mm. The upper end 2041*u* of the wiper 2041 is in a tapered shape. This allows the wiper 2041 to bend easily when the wiper 2041 makes contact with the ink discharge surface 4*a*, and thereby making it possible to wipe off the ink on the ink discharge surface 4*a* reliably. When the restoring force or resilience, by which the wiper 2041 in the bent state is restored to a normal state, is great, the force, which is transmitted from the wiper 2041 to the water-repellent film covering the ink discharge surface 4*a*, is also great. In the third embodiment, however, since the wiper 2041 has the thickness of approximately 1 mm, the resilience is relatively small. This reduces the force transmitting from the wiper 2041 to the water-repellent film, and thereby making it possible to prevent the water-repellent film from peeling off.

The wiper cleaner 2046 is held by a cleaner holder 2047 and is disposed between the waiting position and the wiper position of the wiper 2041. The illustration of the cleaner holder 2047 is omitted in FIGS. 32 and 33. The wiper cleaner 2046 is made of an elastic absorber, such as sponge, to have a cuboid form. The wiper cleaner 2046 includes a slit 2046*a* roughly in the center thereof in the left-right direction. The slit 2046*a* ranges from the lower end to the vicinity of the upper end of the wiper cleaner 2046 and extends parallel to the wiper movement direction. The slit 2046*a* is formed by cutting or slitting the absorber. The width of the slit 2046*a* is smaller than the thickness of the wiper 2041, that is, the width of the slit 2046*a* is substantially zero. A part, of the wiper cleaner 2046, on the right side of the slit 2046*a* corresponds to a first contact part of the present teaching. A part, of the wiper cleaner 2046, on the left side of the slit 2046*a* corresponds to a second contact part of the present teaching.

Figure 34B:
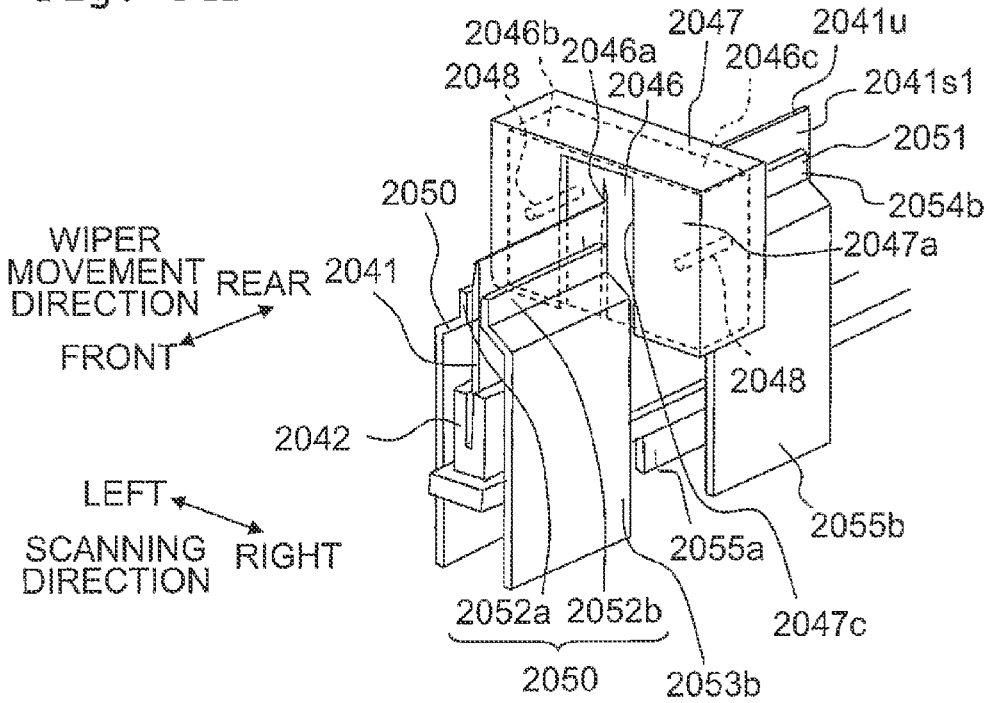
FIG. 34B is a perspective view of the wiper on the move, the wiper cleaner, and the wiper guide, as viewed from the front side of FIG. 32.

As depicted in FIGS. 34A and 34B, the cleaner holder 2047 fixes a left end 2046*b* and a right end 2046*c* of the wiper cleaner 2046. Specifically, the wiper cleaner 2046 is fixed by two fixation bars 2048. The two fixation bars 2048 penetrate through circular holes formed in the left and right ends 2046*b*, 2046*c* of the wiper cleaner 2046. The structure for fixing the left and right ends 2046*b*, 2046*c* of the wiper cleaner 2046 may be any other structure than the above. The cleaner holder 2047 covers or surrounds parts of the front and rear surfaces, the left and right surfaces, and the upper surface, of the wiper cleaner 2046. The cleaner holder 2047 is supported by an unillustrated support member in a cantilever manner. The cleaner holder 2047 includes notches 2047*c*, 2047*d* which are formed in a front wall 2047*a* (a second wall of the present teaching) and a rear wall 2047*b* (a first wall of the present teaching) of the cleaner holder 2047, respectively. The slit 2046*a* and the periphery thereof are exposed through the notches 2047*c*, 2047*d*.

The wiper cleaner 2046 is disposed at a position which allows a part, of the wiper 2041, on the upper side of the wiper holder 2042 to pass through the slit 2046*a* during the movement of the wiper 2041 between the waiting position and the wiping position.

The wiper cleaner 2046 includes a wiper guide 2050 on the front side thereof and a wiper guide 2051 on the rear side thereof. The clearance between the wiper cleaner 2046 and each of the wiper guides 2050, 2051 is shorter than the length of the wiper 2041 in the front-rear direction.

The wiper guide 2050 is formed of two plate-shaped guide pieces 2052*a*, 2052*b* arranged in the scanning direction. The lower ends of two guide pieces 2052*a*, 2052*b* are connected to ink discharge parts 2053*a*, 2053*b* respectively. The surfaces, of two guide pieces 2052*a*, 2052*b*, facing each other (hereinafter referred to as "facing surfaces" in some cases) are perpendicular to the scanning direction. The distance between the facing surfaces is longer than the thickness of the wiper 2041 (the length of the wiper 2041 in the scanning direction). The two guide pieces 2052*a*, 2052*b* are disposed at a height facing a part, of the wiper 2041, on the lower side of the upper end 2041*u*. The upper parts of two ink discharge parts 2053*a*, 2053*b* are inclined in the up-down direction so that the distance between two ink discharge parts 2053*a*, 2053*b* increases from the upper side to lower side thereof. The lower parts of two ink discharge parts 2053*a*, 2053*b* extend substantially in the vertical direction. The wiper guides 2050, 2051 are disposed symmetrically in the front-rear direction. The wiper guide 2051 includes two guide pieces 2054*a*, 2054*b* which are formed similarly to the two guide pieces 2052*a*, 2052*b* of the wiper guide 2050. The lower ends of two pieces 2054*a*, 2054*b* are respectively connected to two ink discharge parts 2055*a*, 2055*b* which are formed similarly to the two ink discharge parts 2053*a*, 2053*b*.

The wiper 2041 in the waiting position is disposed in the wiper guide 2050 (the space between two guide pieces 2052*a*, 2052*b*). The wiper 2041 in the wiping position is disposed on the rear side of the wiper guide 2051.

Figures 36A, 36B, 36C, 36D:
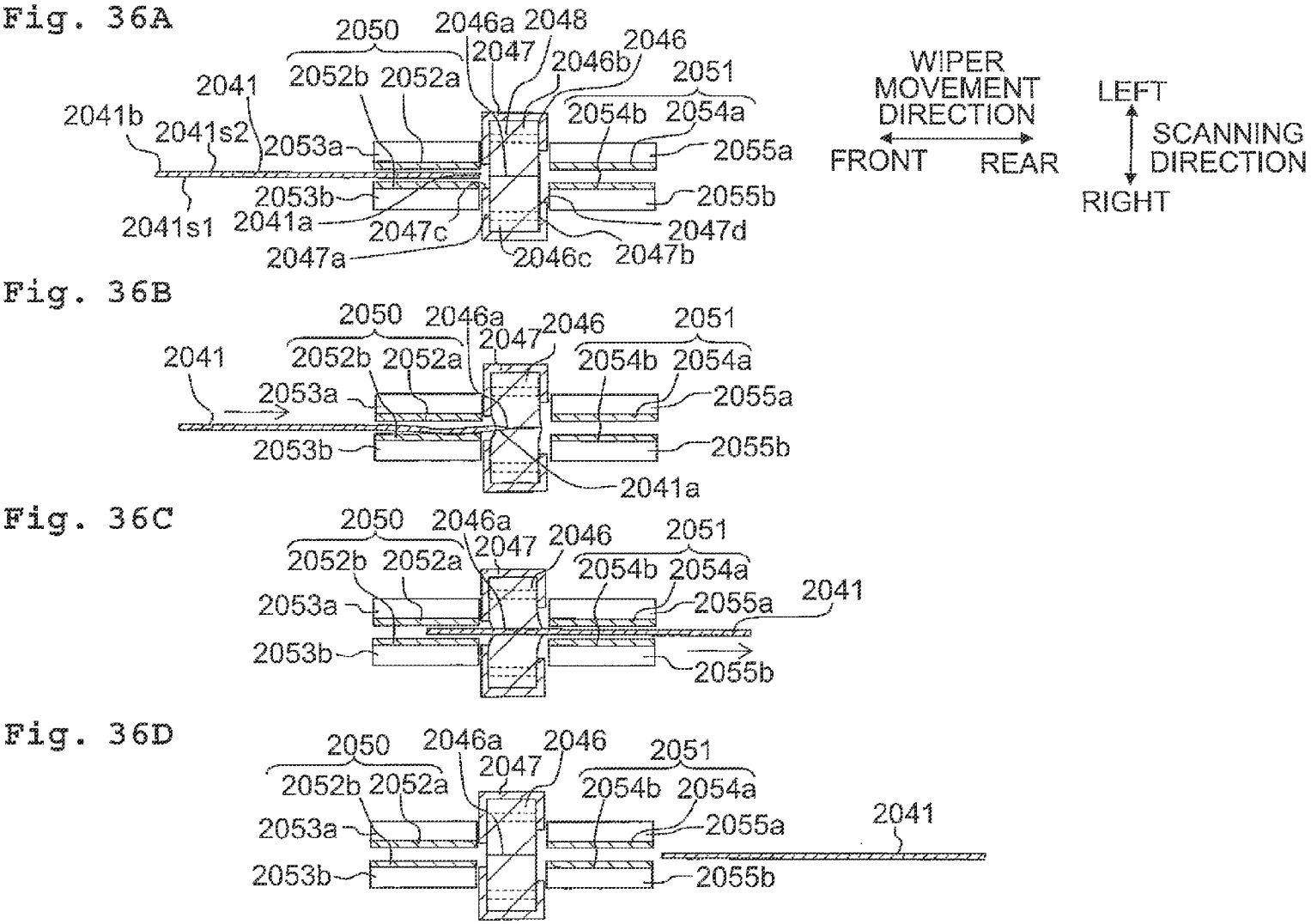
FIGS. 36A to 36D are views depicting a process, in which the wiper moves from a waiting position to the wiping position, according to the third embodiment.
Figures 37A, 37B, 37C, 37D:
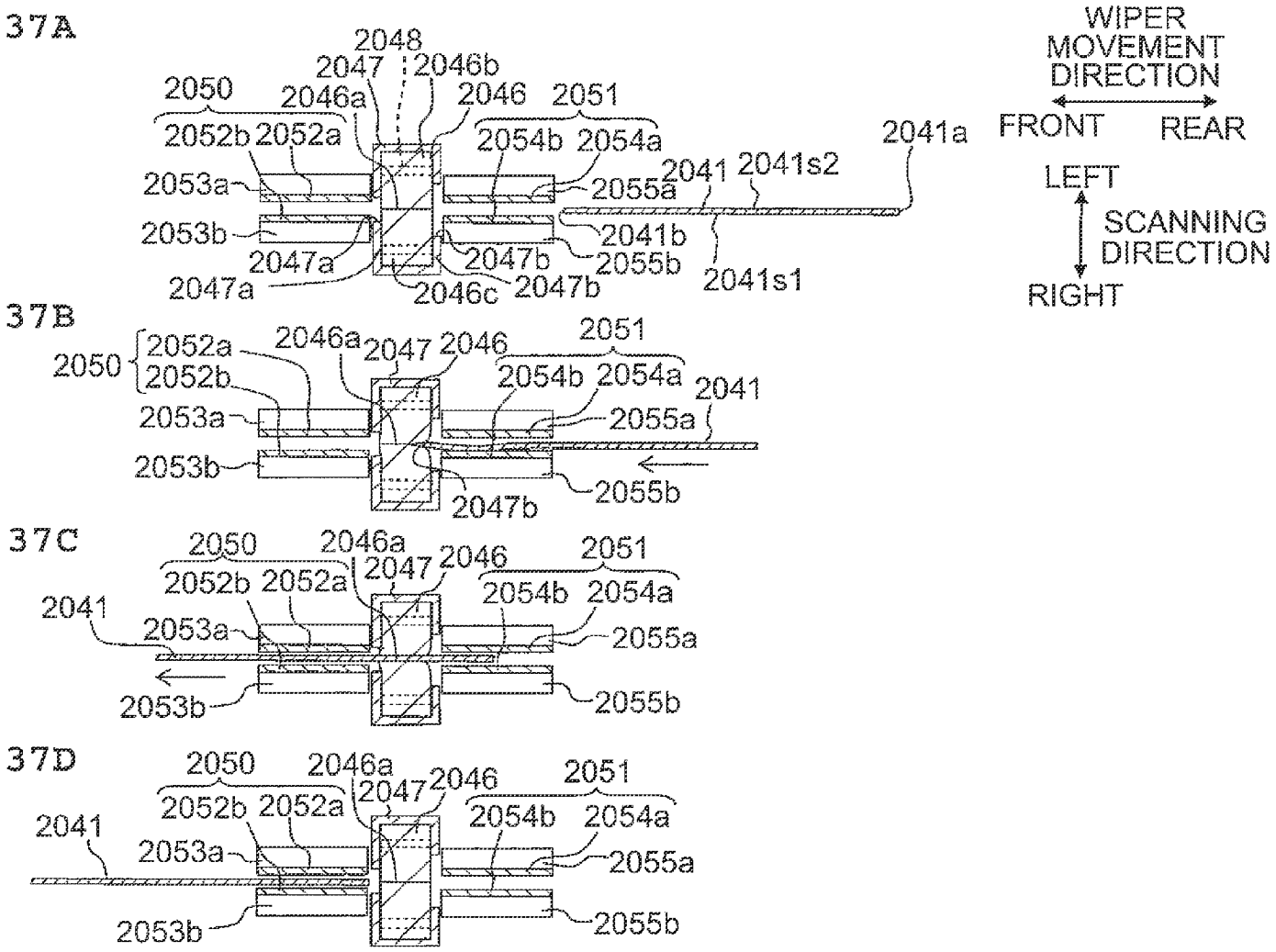
FIGS. 37A to 37D are views depicting a process, in which the wiper moves from the wiping position to the waiting position, according to the third embodiment.

As depicted in FIGS. 36A to 36D, when the wiper 2041 moves rearward from the waiting position to the wiping position, a rear end 2041*a* of the wiper 2041 is inserted first into the slit 2046*a* of the wiper cleaner 2046 in a state that the wiper 2041 is sandwiched by the wiper guide 2050. In this situation, as depicted in FIG. 36B, even when the wiper 2041 is about to be bent and deformed by being caught by the entrance of the slit 2046*a*, the deformation of the wiper 2041 is regulated because of the contact between the wiper 2041 and the wiper guide 2050. Thus, the wiper 2041 can be inserted into the slit 2046*a* easily.

As depicted in FIGS. 37A to 37D, when the wiper 2041 moves frontward from the wiping position to the waiting position, the wiper 2041 is inserted first into the wiper guide 2051 (the space between two guide pieces 2054*a*, 2054*b*). Since the distance between two guide pieces 2054*a*, 2054*b* is greater than the thickness of the wiper 2041, the wiper 2041 can be inserted into the wiper guide 2051 easily and the ink adhering to the wiper 2041 is prevented from adhering to the wiper guide 2051. Further, since the two guide pieces 2054*a*, 2054*b* of the wiper guide 2051 face parts, of the wiper 2041, on the lower side of the upper end 2041*u*, the ink adhering to the vicinity of the upper end 2041*u* of the wiper 2041 is less likely to adhere to the wiper guide 2051. Furthermore, since the lower ends of two guide pieces 2054*a*, 2054*b* are respectively connected to the ink discharge parts 2055*a*, 2055*b*, even when the ink adhering to the wiper 2041 adheres to the wiper guide 2051, the ink adhering to the wiper guide 2051 flows downward along two ink discharge parts 2055*a*, 2055*b*. This prevents the ink from staying and setting on the wiper guide 2051. For example, when the wiper 2041 has a thickness of about 1 mm, it is preferred that the distance between two guide pieces 2052*a*, 2052*b* (2054*a*, 2054*b*) facing each other be, for example, about 1.3 mm.

Subsequently, a front end 2041*b* of the wiper 2041 is inserted into the slit 2046*a* of the wiper cleaner 2046 in a state that the wiper 2041 is sandwiched by the wiper guide 2051. In this situation, the deformation of the wiper 2041 can be regulated by the wiper guide 2051, and thus the wiper 2041 can be inserted into the slit 2046*a* easily, as with the case in which the wiper 2041 moves rearward. After that, the wiper cleaner 2046 makes contact with both surfaces of the wiper 2041. This allows the wiper cleaner 2046 to remove the ink, which adhered to the wiper 2041 during the wiping operation for the ink discharge surface 4*a*.

As described above, the ink is less likely to adhere to the left surface 2041*s*2 (the second surface of the present teaching) of the wiper 2041. Thus, a part (the second contact part of the present teaching), of the wiper cleaner 2046, which makes contact with the left surface 2041*s*2 has little association with the cleaning for the wiper 2041 in some cases. In both of the case where the ink adheres to the left surface 2041*s*2 and the case where no ink adheres to the left surface 2041*s*2, the part (the second contact part of the present teaching), of the wiper cleaner 2046, which makes contact with the left surface 2041*s*2 functions to ensure the contact surface pressure between the right surface 2041*s*1 (the first surface of the present teaching) of the wiper 2041 and the wiper cleaner 2046.

Both of the ends 2046*b*, 2046*c* of the wiper cleaner 2046 are fixed by the fixation bars 2048. Thus, when the wiper 2041 is inserted into the slit 2046*a*, the wiper cleaner 2046 is deformed to bend in the travelling direction of the wiper 2041, with the ends 2046*b*, 2046*c* as the fulcrums. This allows the slit 2046*a* to expand more easily, as compared with the case where the entire upper surface of the wiper cleaner 2046 is fixed by the cleaner holder 2047. Thus, the wiper 2041 can pass through the slit 2046*a* smoothly.

As depicted in FIGS. 36A to 36D, when the wiper 2041 moves rearward through the slit 2046*a*, the rear surface of the wiper cleaner 2046 is pressed against the rear wall 2047*b* of the cleaner holder 2047 to regulate the deformation of the wiper cleaner 2046 toward the rear side. As depicted in FIGS. 37A to 37D, when the wiper 2041 moves frontward through the slit 2046*a*, the front surface of the wiper cleaner 2046 is pressed against the front wall 2047*a* of the cleaner holder 2047 to regulate the deformation of the wiper cleaner 2046 toward the front side. The notch 2047*c* formed in the front wall 2047*a* of the cleaner holder 2047 has a length in the scanning direction (left-right direction), which is shorter than that of the notch 2047*d* formed in the rear wall 2047*b* of the cleaner holder 2047. Thus, the contact area between the front wall 2047*a* of the cleaner holder 2047 and the wiper cleaner 2046 is larger than the contact area between the rear wall 2047*b* of the cleaner holder 2047 and the wiper cleaner 2046. In this structure or configuration, the wiper cleaner 2046 is less likely to be deformed when the wiper 2041 moves frontward from the wiping position to pass through the slit 2046*a*, as compared with the case where the wiper 2041 moves rearward from the waiting position to pass through the slit 2046*a*. Therefore, the wiper cleaner 2046 can be brought in contact stronger with the wiper 2041 to improve the cleaning accuracy, when the wiper 2041 moves frontward from the wiping position to pass through the slit 2046*a*. Meanwhile, when the wiper 2041 moves from the waiting position to the wiping position, it is possible to reduce the loads on the wiper 2041 and the wiper cleaner 2046. This elongates the service lives of the wiper 2041 and the wiper cleaner 2046.

An explanation will be made in detail about the action or motion of the maintenance unit 2006. The control unit 7 controls the maintenance unit 2006 to move, in a case that the suction purge for the ink-jet head 4 is required to be performed. The case includes, for example, the timing immediately after power is applied to the ink-jet printer 1 and the case in which a purge command is inputted by a user.

At first, as depicted in FIG. 35A, the ink-jet head 4 is positioned in the maintenance position to face the suction cap 31. Next, the cap lifting motor 24 is driven to move the suction cap 31 upward from the waiting position depicted in FIG. 35A. Then, the suction cap 31 is brought into tight contact with the ink discharge surface 4*a* of the ink-jet head 4 as depicted in FIG. 35B. In this state, the suction pump 32 is driven to reduce the pressure in the suction cap 31. In this way, foreign matters and bubbles mixed in the ink-jet head 4 are sucked and discharged, together with the ink, from the ink discharge ports 16 covered with the suction cap 31 (suction purge).

After the suction purge for a certain period of time, the suction cap 31 is moved down to return to the waiting position. In this situation, a part of the ink, which was discharged from the ink discharge ports 16 during the suction purge, is adhering to the ink discharge surface 4*a*. Thus, subsequent to the suction purge, the wiper 2041 wipes off the ink on the ink discharge surface 4*a*. As depicted in FIG. 35C and FIGS. 36A to 36D, the wiper drive motor 25 is at first driven to move the wiper 2041 from the waiting position to the wiping position. During this movement, the wiper 2041 passes through the slit 2046*a* of the wiper cleaner 2046.

Next, as depicted in FIG. 35D, the carriage 3 moves in a direction closer to the platen 2 to bring the ink discharge surface 4*a* of the ink-jet head 4 into contact with the upper end of the wiper 2041. This allows the wiper 2041 to wipe off the ink adhering to the ink discharge surface 4*a*. After that, the wiper 2041 is moved from the wiping position to the waiting position by the wiper drive motor 25. During this movement, the wiper 2041 passes through the space 2046*a* of the wiper cleaner 2046, and thus the ink, which adhered to the wiper 2041 during the wiping operation for the ink discharge surface 4*a*, is removed by the wiper cleaner 2046, and thereby cleaning the wiper 2041.

In the third embodiment, the scanning direction (left-right direction) corresponds to a first direction of the present teaching, the up-down direction perpendicular to the ink discharge surface 4*a* corresponds to a second direction of the present teaching, and the wiper movement direction (front-rear direction) corresponds to a third direction of the present teaching.

<Modified Embodiments of Third Embodiment>

Although the third embodiment of the present teaching has been explained above, the present teaching is not restricted to the third embodiment and various changes may be made within the scope of the claims.

Figure 38:
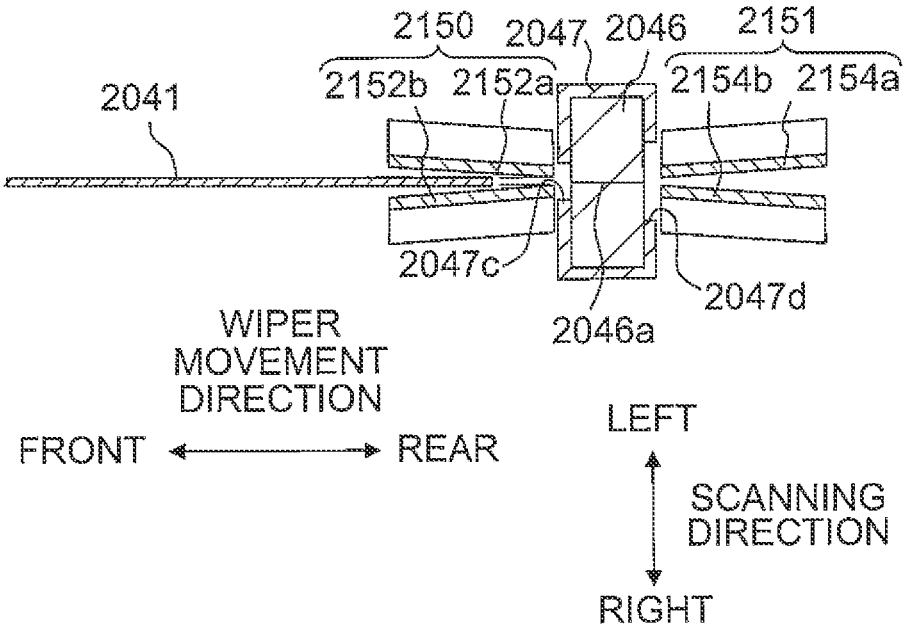
FIG. 38 is a view depicting an ink-jet printer according to a modified embodiment of the third embodiment and corresponding to FIG. 36A.

In the third embodiment, the space between two guide pieces 2052*a*, 2052*b* facing each other in the left-right direction and the space between two guide pieces 2054*a*, 2054*b* facing each other in the left-right direction are constant in length in the front-rear direction. However, as depicted in FIG. 38, a space, of a wiper guide 2150, between two guide pieces 2152*a*, 2152*b* in the left-right direction and a space, of a wiper guide 2151, between two guide pieces 2154*a*, 2154*b* in the left-right direction may be smaller toward the sides closer to the wiper cleaner 2046, respectively. This structure allows the wiper 2041 to be easily inserted into the spaces of the wiper guides 2150, 2151 and further allows the wiper 2041 to be easily inserted into the slit 2046*a* of the wiper cleaner 2046.

In the third embodiment, the space between two guide pieces 2052*a*, 2052*b* facing each other in the left-right direction and the space between two guide pieces 2054*a*, 2054*b* facing each other in the left-right direction are greater than the thickness of the wiper 2041. However, like the wiper guide(s) 2050 (2051) depicted in FIG. 38, a space between the end, of the guide piece 2152*a* (2154*a*), closest to the wiper cleaner 2046 in the front-rear direction and the end, of the guide piece 2152*b* (2154*b*), closest to the wiper cleaner 2046 in the front-rear direction may at least have the same length as the thickness of the wiper 2041. This structure reliably prevents the wiper 2041 from being deformed and bent when the wiper 2041 is inserted into the slit 2046*a* of the wiper cleaner 2046, and consequently can insert the wiper 2041 into the slit 2046*a* more easily.

Figure 39:
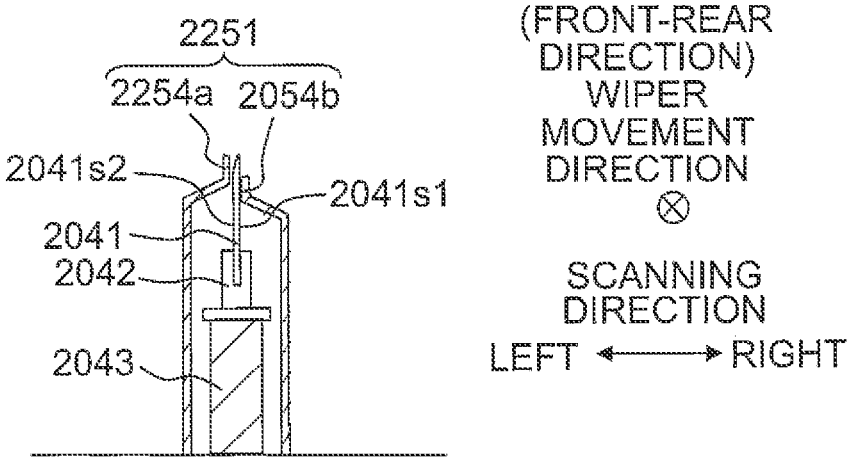
FIG. 39 is a view depicting an ink-jet printer according to a modified embodiment of the third embodiment and corresponding to FIG. 35C.

In the third embodiment, two wiper guides 2050, 2051 may not be disposed symmetrically in the front-rear direction. Further, two guide pieces 2052*a*, 2052*b* (2054*a*. 2054*b*) constituting the wiper guide 2050 (2051) may not be disposed symmetrically in the left-right direction. For example, like a wiper guide 2251 depicted in FIG. 39, two guide pieces 2254*a*, 2254*b* may have mutually different heights. As described above, the ink is more likely to adhere to the right surface 2041*s*1 (the first surface of the present teaching) of the wiper 2041 as compared with the left surface 2041*s*2 (the second surface of the present teaching). Thus, as depicted in FIG. 39, the guide piece 2254*a* (a second guide piece of the present teaching) facing the left surface 2041*s*2 is disposed above the guide piece 2254*b* (a first guide piece of the present teaching) facing the right surface 2041*s*1 to prevent the ink adhering to the wiper 2041 from adhering to the wiper guide 2251. In FIG. 39, since the guide piece 2254*a* faces the upper end 2041*u* of the wiper 2041, it is possible to reliably prevent the bending and deformation of the vicinity of the upper end 2041*u* of the wiper 2041. Noted that both of two guide pieces constituting one wiper guide may face the upper end 2041*u* of the wiper 2041.

Figure 40:
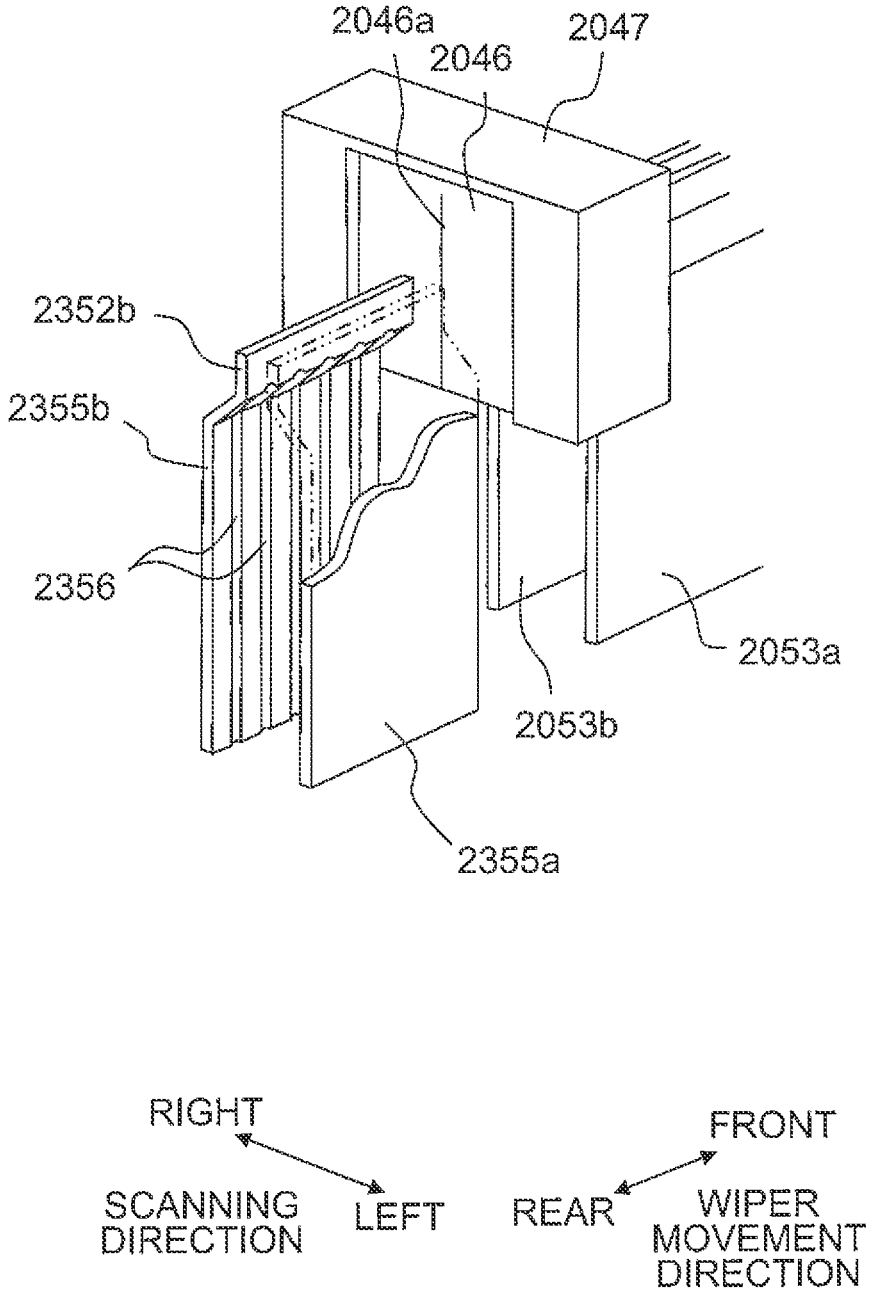
FIG. 40 is a perspective view of a wiper cleaner and a wiper guide of an ink-jet printer according to a modified embodiment of the third embodiment.

For example, as depicted in FIG. 40, two ink discharge parts 2355*a*, 2355*b* may include, on facing surfaces thereof, grooves 2356 extending in the up-down direction (FIG. 40 depicts only the grooves 2356 formed in the ink discharge part 2355*b*). The two ink discharge parts 2355*a*, 2355*b* are disposed on the rear side (the wiping position side) of the wiper cleaner 2046. This structure allows the ink adhering to the guide pieces 2054*a*, 2054*b* to easily flow downward along the grooves 2356 of two ink discharge parts 2355*a*, 2355*b*. Thus, the ink adhering to the guide pieces 2054*a*, 2054*b* is prevented from staying and setting on the guide pieces 2054*a*. 2054*b*. The grooves 2356 may extend to the guide pieces 2054*a*, 2054*b*. Two ink discharge parts 2353*a*, 2353*b*, which are disposed on the front side (the waiting position side) of the wiper cleaner 2046, may include grooves as well.

In the third embodiment, the guide piece 2052*a* (2052*b*, 2054*a*, 2054*b*) and the ink discharge part 2053*a* (2053*b*, 2055*a*, 2055*b*) connected to the lower end of the guide piece 2052*a* (2052*b*, 2054*a*, 2054*b*) are formed of one plate-like member. The guide piece 2052*a* (2052*b*, 2054*a*, 2054*b*), however, may be formed of a member independently of the ink discharge part 2053*a* (2053*b*, 2055*a*, 2055*b*). Alternatively, the guide piece 2052*a* (2052*b*, 2054*a*, 2054*b*) may be formed of bar-like or plate-like members arranged in the front-rear direction. The same is true for the ink discharge part 2053*a* (2053*b*, 2055*a*, 2055*b*). Further, no ink discharge part may be provided.

Figure 41:
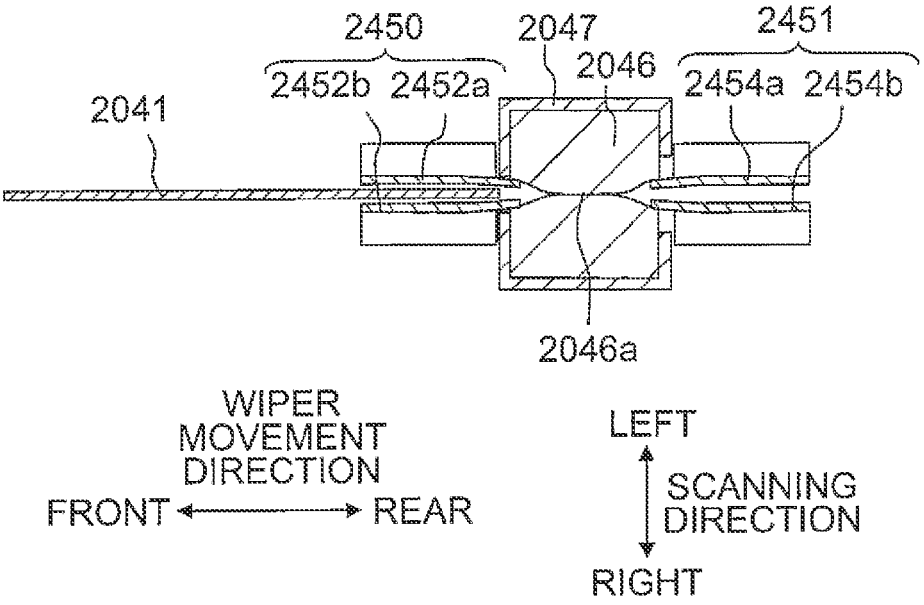
FIG. 41 is a view depicting an ink-jet printer according to a modified embodiment of the third embodiment and corresponding to FIG. 36A.

For example, as depicted in FIG. 41, parts of wiper guides 2450, 2451 may penetrate the slit 2046*a* of the wiper cleaner 2046. This structure more reliably prevents the wiper 2041 from being caught by the wiper cleaner 2046, and thus the wiper 2041 can be inserted into the slit 2046*a* more easily. Although both of two guide pieces 2452*a*, 2452*b* (2454*a*, 2454*b*) constituting the wiper guide 2450 (2451) penetrate the slit 2046*a* in FIG. 41, one of the guide pieces may penetrate the slit 2046*a*.

Figure 42:
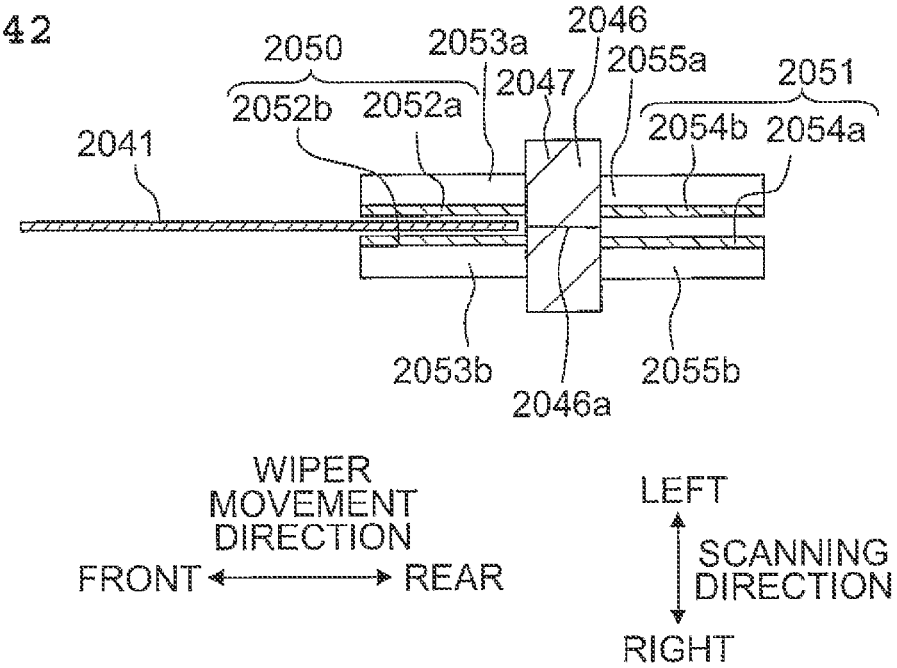
FIG. 42 is a view depicting an ink-jet printer according to a modified embodiment of the third embodiment and corresponding to FIG. 36A.

In the third embodiment, the cleaner holder 2047 makes contact with the front and rear surfaces of the wiper cleaner 2046. For example, as depicted in FIG. 42, the wiper guides (2050, 2051) may contact with the front and/or rear surface(s) of the wiper cleaner 2046.

Figure 43:
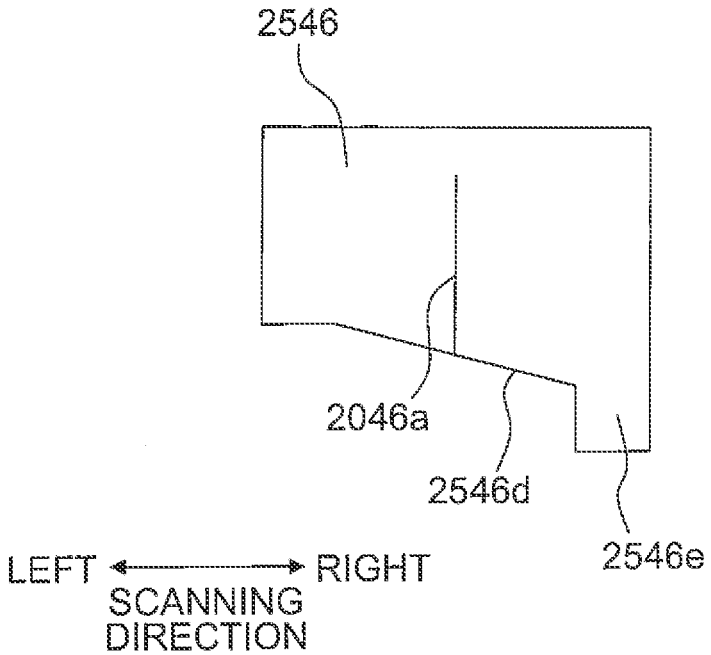
FIG. 43 is a front view depicting a wiper cleaner of an ink-jet printer according to a modified embodiment of the third embodiment.

In the third embodiment, the entire lower surface of the wiper cleaner 2046 is horizontal. However, as depicted in FIG. 43, at least a part (inclined surface 2546*d*), of the lower surface of a wiper cleaner 2546, directly beneath the slit 2046*a* may be inclined to the horizontal surface to have different levels in the left-right direction. This moves the ink absorbed in the wiper cleaner 2546 downward along the inclined surface 2546*d*, so that the ink gathers at a lower part of the inclined surface 2546*d*. In FIG. 43, the wiper cleaner 2546 includes an ink discharge part 2546*e* protruding downward beyond the lowermost end of the inclined surface 2546*d*. The ink is discharged from the ink discharge part 2546*e*.

Figure 44:
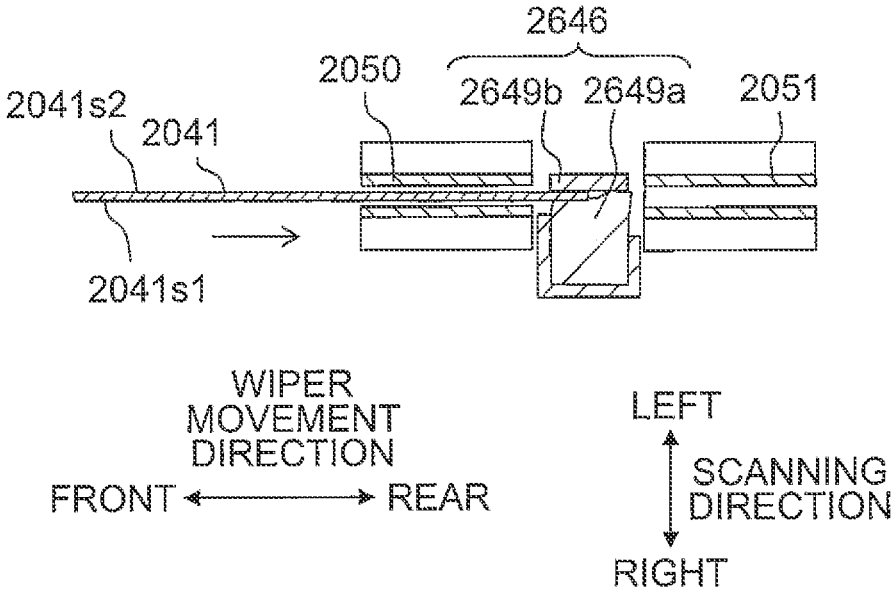
FIG. 44 is a view depicting an ink-jet printer according to a modified embodiment of the third embodiment and corresponding to FIG. 36B.

In the third embodiment, the wiper cleaner 2046 is formed only of the absorber. However, as depicted in FIG. 44, a wiper cleaner 2646 may be formed of an ink absorbing part 2649*a* (the first contact part of the present teaching) and a wiper contact part 2649*b* (the second contact part of the present teaching). The ink absorbing part 2649*a* is made of the absorber, and the wiper contact part 2649*b* is made of synthetic resin and the like to have the rigidity higher than that of the absorber. The ink absorbing part 2649*a* makes contact with the right surface 2041*s*1 of the wiper 2041 (the first surface of the present teaching), and the wiper contact part 2649*b* makes contact with the left surface 2041*s*2 of the wiper 2041 (the second surface of the present teaching). Since the ink is more likely to adhere to the right surface

2041*s*1, the wiper 2041 can be cleaned with the wiper cleaner 2646 as well. However, the wiper cleaner 2046 in the third embodiment is more preferred to improve the cleaning quality. The wiper contact part 2649*b* functions to ensure the contact surface pressure between the right surface 2041*s*1 of the wiper 2041 and the ink absorbing part 2649*a*.

In the third embodiment, the rear end 2041*a* of the wiper 2041 is disposed between two guide pieces 2052*a*, 2052*b* of the wiper guide 2050, in a state that the wiper 2041 is in the waiting position. The waiting position of the wiper 2041, however, may be on the front side of the wiper guide 2050. Noted that the configuration of the third embodiment is more preferred to reduce a space where the wiper 2041 is provided.

In the third embodiment, the waiting position of the wiper 2041 is on the front side of the wiping position in the sheet conveyance direction. The waiting position of the wiper 2041, however, may be on the rear side of the wiping position.

In the third embodiment, the movement of the wiper 2041 causes the relative movement between the wiper 2041 and the wiper cleaner 2046. However, as depicted in FIGS. 45D to 45G and FIGS. 46D to 46G, the movement of the wiper cleaner 2046 in the front-rear direction may cause the relative movement between the wiper 2041 and the wiper cleaner 2046. In this modified embodiment, two wiper guides 2050, 2051 may move integrally with or independently of the wiper cleaner 2046, provided that the positions, of two wiper guides 2050, 2051 relative to the wiper cleaner 2046, taken when the wiper 2041 is inserted into the slit 2046*a* of the wiper cleaner 2046 are same as those of the third embodiment.

Figure 45A:
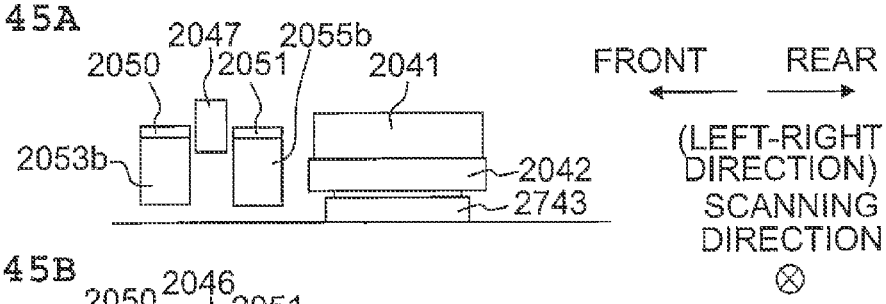
FIGS. 45A to 45G are illustrative views each illustrating an operation of an ink-jet printer according to a modified embodiment of the third embodiment.
Figure 45B:
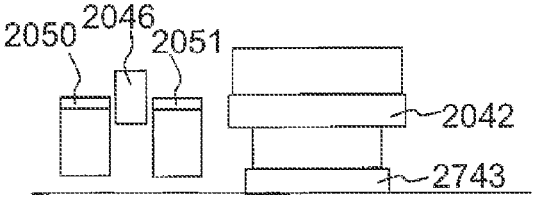
Figure 45C:
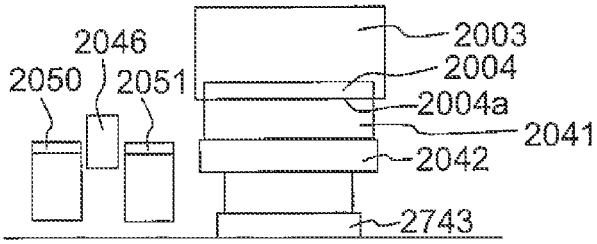
Figure 45D:
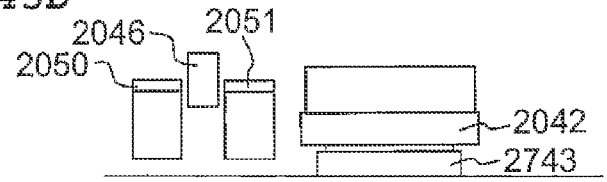
Figure 45E:
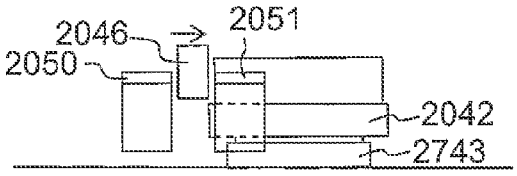
Figure 45F:
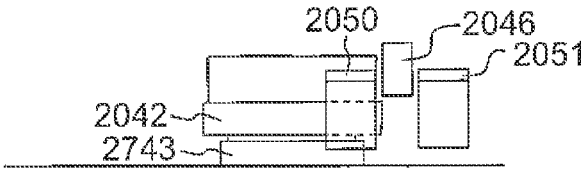
Figure 45G:
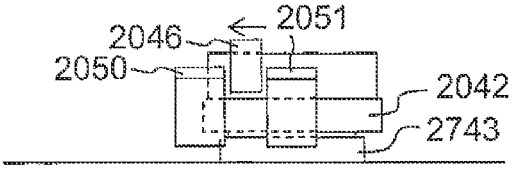
Figure 46A:
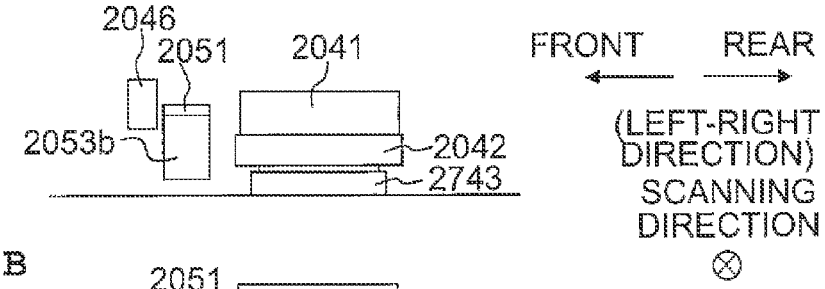
FIGS. 46A to 46G are illustrative views each illustrating an operation of an ink-jet printer according to a modified embodiment of the third embodiment.
Figure 46B:
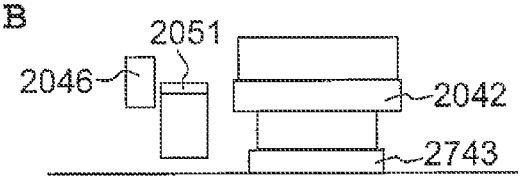
Figure 46C:
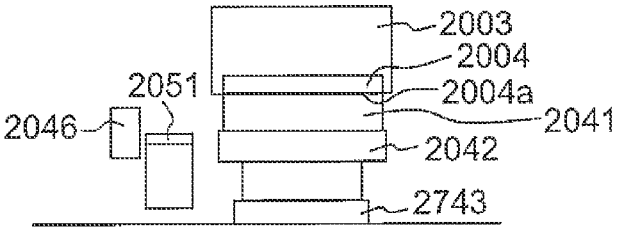
Figure 46D:
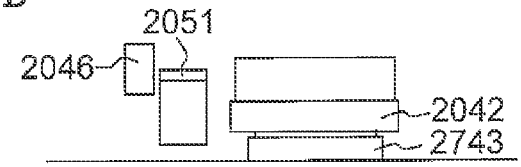
Figure 46E:
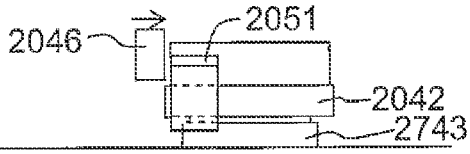

The modified embodiments depicted in FIGS. 45A to 45G and FIGS. 46A to 46G will be explained in detail as follows. The wiper 2041 is allowed to move up and down by a lifting motor 743, which is driven by a motor or the like. The wiper cleaner 2046 and two wiper guides 2050, 2051 are allowed to reciprocate in a direction (front-rear direction) parallel to the ink discharge surface 4*a* and orthogonal to the scanning direction by an unillustrated movement mechanism (corresponding to a movement mechanism of the present teaching), which is driven by a motor or the like. When the wiper 2041 wipes off the ink on the ink discharge surface 4*a*, the wiper 2041 at first moves upward from the position depicted in FIGS. 45A and 46A to the position depicted in FIGS. 45B and 46B. Then, the ink-jet head 4 moves in the scanning direction as depicted in FIGS. 45C and 46C in a state that the wiper 2041 is in the position depicted in FIGS. 45B and 46B, thereby wiping off the ink adhering to the ink discharge surface 4*a* with the wiper 2041. After that, the wiper 2041 moves down as depicted in FIGS. 45D and 46D. After the downward movement of the wiper 2041, as depicted in FIGS. 45E to 45G and FIGS. 46E to 46G, the wiper cleaner 2046 and two wiper guides 2050, 2051 reciprocate in the front-rear direction to remove the ink adhering to the wiper 2041.

Figure 46F:
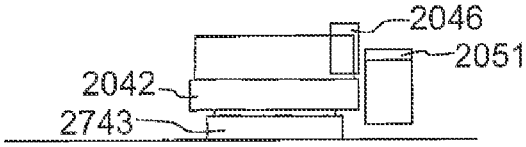
Figure 46G:
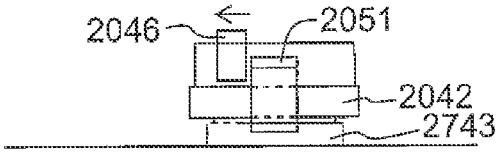
Figure 47A:
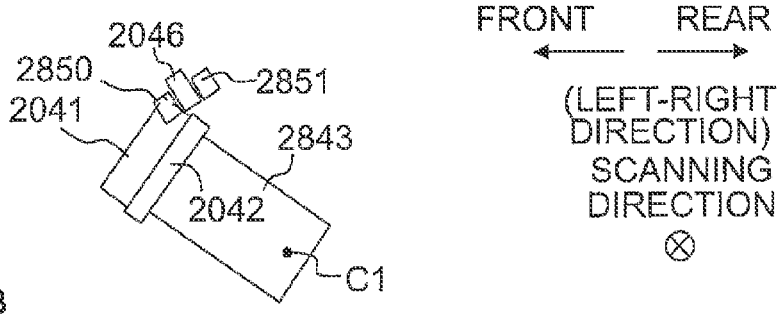
FIGS. 47A to 47E are illustrative views each illustrating an operation of an ink-jet printer according to a modified embodiment of the third embodiment.
Figure 47B:
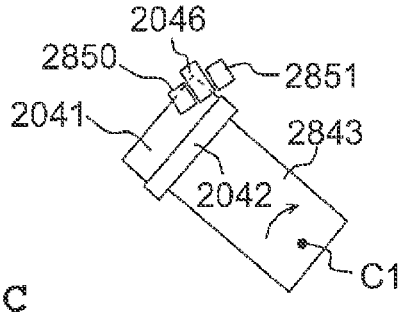
Figure 47C:
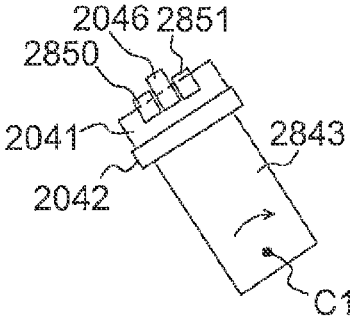
Figure 47D:
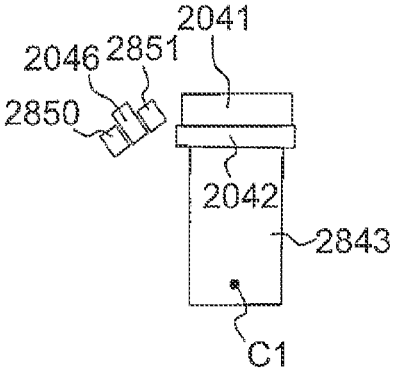
Figure 47E:
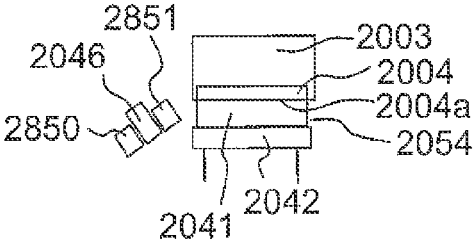

In the third embodiment, the wiper 2041 passes through the slit 2046*a* when moving to the wiper cleaner 2046 toward either side in the front-rear direction. However, as depicted in FIG. 46F, the wiper 2041 may not pass through the slit 2046*a* when moving relative to the wiper cleaner 2046 toward any one side in the front-rear direction. In this case, the wiper guide (wiper guide 2051 in FIG. 46F) is disposed on only one side of the wiper cleaner 2046 in the front-rear direction. In other words, the wiper guide may not be disposed on the other side of the wiper cleaner 2046 in front-rear direction.

In the third embodiment, the wiper 2041 is disposed so that the longitudinal direction thereof is parallel to the ink discharge surface 4*a* and orthogonal to the scanning direction, and the wiper movement mechanism 2043 drives the wiper 2041 in the longitudinal direction of the wiper 2041. The arrangement direction and driving direction of the wiper 2041, however, are not limited to those. The longitudinal direction of the wiper 2041 may be any direction, provided that the longitudinal direction of the wiper 2041 intersects with both of the scanning direction and the direction (up-down direction) orthogonal to the ink discharge surface 4*a*. Further, the movement direction of the wiper 2041 by the wiper movement mechanism 2043 may not be perfectly parallel to the longitudinal direction of the wiper 2041, provided that the movement direction of the wiper 2041 is along the wiper 2041. In the third embodiment, the wiper 2041 is disposed so that the upper end 2041*u* is perpendicular to the up-down direction. The wiper 2041, however, may be disposed so that the upper end 2041*u* is inclined to the up-down direction.

In the third embodiment, the wiper 2041 linearly moves relative to the wiper cleaner 2046 in the longitudinal direction of the wiper 2041. However, as depicted in FIGS. 47A to 47E, the wiper 2041 may move relative to the wiper cleaner 2046 in a circumferential direction around an axis C1 extending in a direction orthogonal to the wiper 2041. In this case, the wiper 2041 intersects with the wiper cleaner 2046 in the direction (up-down direction) orthogonal to the ink discharge surface 4*a*, and the wiper 2041 moves relative to the wiper cleaner 2046 in the direction intersecting with the scanning direction. Wiper guides 2850, 2851 are disposed on both sides of the wiper cleaner 2046 in the circumferential direction with the axis C1 as the center. In FIGS. 47A to 47E, the wiper cleaner 2046 is fixed and the wiper 2041 is rotatably moved by a wiper movement mechanism 2843, which is driven by a motor or the like. However, the wiper 2041 may be fixed and the wiper cleaner 2046 may be rotated.

Figure 48A:
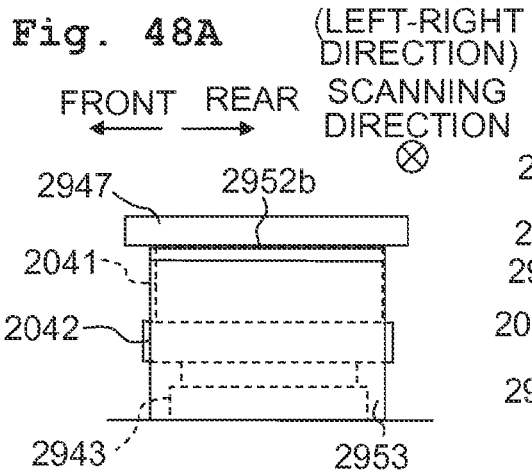
FIGS. 48A to 48H are illustrative views each illustrating an operation of an ink-jet printer according to a modified embodiment of the third embodiment.
Figure 48B:
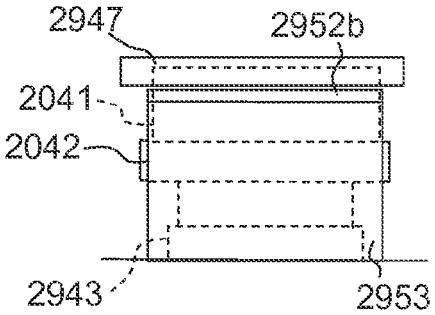
Figure 48C:
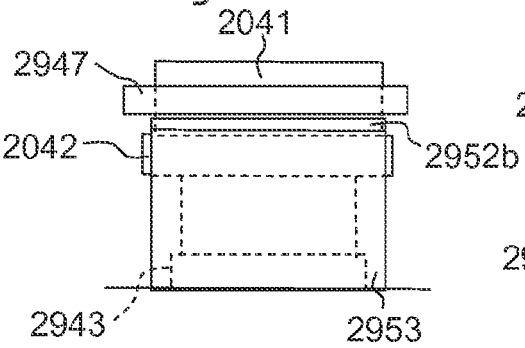
Figure 48D:
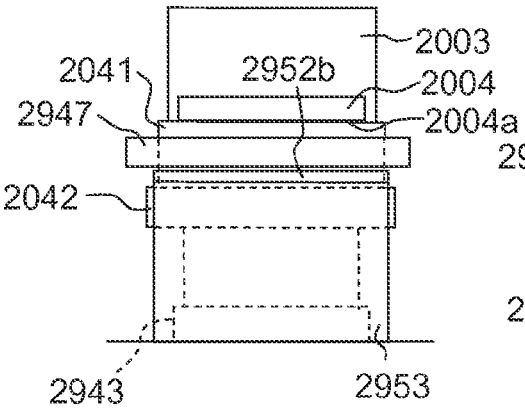
Figure 48E:
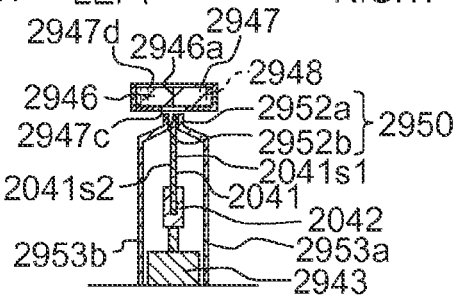
Figure 48F:
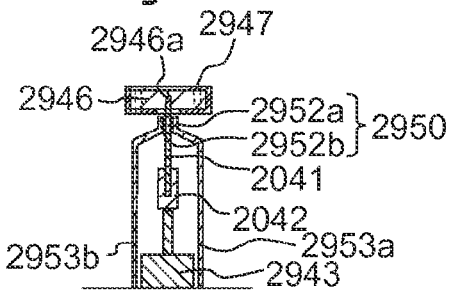
Figure 48G:
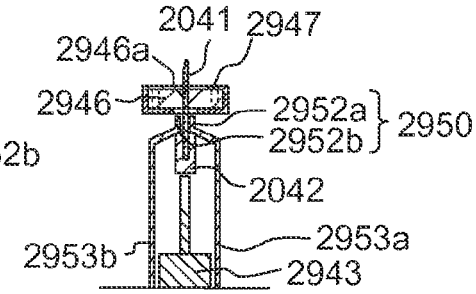

Further, as depicted in FIGS. 48A to 48H, the wiper 2041 may move relative to a wiper cleaner 2946 in the direction (up-down direction) orthogonal to the ink discharge surface 4*a* and coincident with the longitudinal direction of the wiper 2041. FIGS. 48A to 48D are views as viewed from the scanning direction; and FIGS. 48E to 48H are cross-sectional views being cut at the center of the wiper 2041 in the longitudinal direction thereof and corresponding to FIGS. 48A to 48D respectively. The modified embodiments depicted in FIGS. 48A to 48H will be explained in detail as follows. Namely, the wiper 2041 is allowed to move up and down by a wiper movement mechanism 2943, which is driven by a motor or the like. The wiper cleaner 2946 includes a slit 2946*a*, of which length in the front-rear direction is slightly longer than the length of the wiper 2041 in the front-rear direction. The wiper cleaner 2946 is disposed to overlap with the wiper 2041 as viewed from the up-down direction. The left and right ends of the wiper cleaner 2946 are fixed to a cleaner holder 2947 by means of two fixation bars 2948. A wiper guide 2950 is disposed on the lower side of the wiper cleaner 2946. The wiper guide 2950 includes two guide pieces 2952*a*, 2952*b* which are disposed on both sides of the wiper 2041 in the scanning direction (the thickness direction of the wiper 2041). The lower ends of two guide pieces 2952*a*. 2952*b* are connected to two ink discharge parts 2953*a*, 2953*b* respectively. During a normal time including the duration of time in which printing is performed, the wiper 2041 is positioned below the wiper cleaner 2946 as depicted in FIGS. 48A and 48E.

Figure 48H:
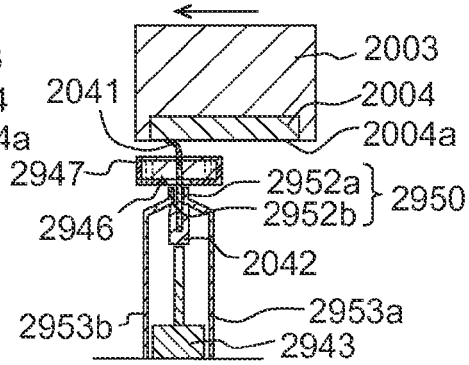

When the ink on the ink discharge surface 4*a* is wiped off, the wiper 2041 at first moves upward as depicted in FIGS. 48B, 48C, 48F, and 48G. In this situation, even when the wiper 2041 is caught by the entrance of the slit 2946*a* of the wiper cleaner 2946 to be bent and deformed, the deformation of the wiper 2041 is regulated because of the contact between the wiper 2041 and the guide pieces 2952*a*, 2952*b*. Thus, the wiper 2041 can be inserted into the slit 2946*a* easily. Next, the ink-jet head 4 moves in the scanning direction as depicted in FIGS. 48D and 48H, thereby wiping the ink discharge surface 4*a* with the wiper 2041. After that, the wiper 2041 moves down to the position as depicted in FIG. 48A. During the downward movement of the wiper 2041, the ink adhering to the wiper 2041 is removed by the wiper cleaner 2946. The cleaner holder 2947 includes a notch 2947*c*, which is disposed on a lower wall of the cleaner holder 2947 and through which the slit 2946*a* is exposed, and a notch 2947*d* disposed on an upper wall of the cleaner holder 2947. In FIGS. 48A to 48H, the notch 2947*c* has a length in the scanning direction (left-right direction), which is shorter than that of the notch 2947*d*. Thus, the wiper cleaner 2946 can be brought in contact stronger with the wiper 2041 moving downward rather than the wiper 2041 moving upward.

In the third embodiment, the ink-jet head 4 moves leftward to wipe the ink discharge surface 4*a* with the right surface 2041*s*1 of the wiper 2041. The ink-jet head 4, however, may move rightward to wipe the ink discharge surface 4*a* with the left surface 2041*s*2 of the wiper 2041. Alternatively, the ink-jet head 4 may reciprocate in the left-right direction to wipe the ink discharge surface 4*a* with the right and left surfaces 2041*s*1 and 2041*s*2 of the wiper 2041 in a state that the wiper 2041 is in the wiping position.

In the third embodiment, the ink-jet head 4 and the carriage 3 move in the scanning direction to wipe the ink discharge surface 4*a* with the wiper 2041. However, the following configuration is also allowable. That is, the wiper 2041 is caused to move relative to the ink-jet head 4 by a suitable means, such as a motor, thereby wiping the ink discharge surface 4*a*.

The wiping direction of the wiper 2041 (the movement direction relative to the ink discharge surface 4*a*) is not limited to the direction away from the platen 2. For example, the wiper 2041 may move in the direction close to the platen 2, or the wiper 2041 may be disposed in the direction intersecting with the sheet conveyance direction to move in the sheet conveyance direction.

The timing at which the wiper 2041 wipes off the ink adhering to the ink discharge surface 4*a* is not limited to the timing after the suction purge which is an exemplary timing in the third embodiment. For example, the wiper 2041 may wipe off the ink after printing is performed by discharging the ink onto the recording sheet P.

<Fourth Embodiment>

Figure 49:
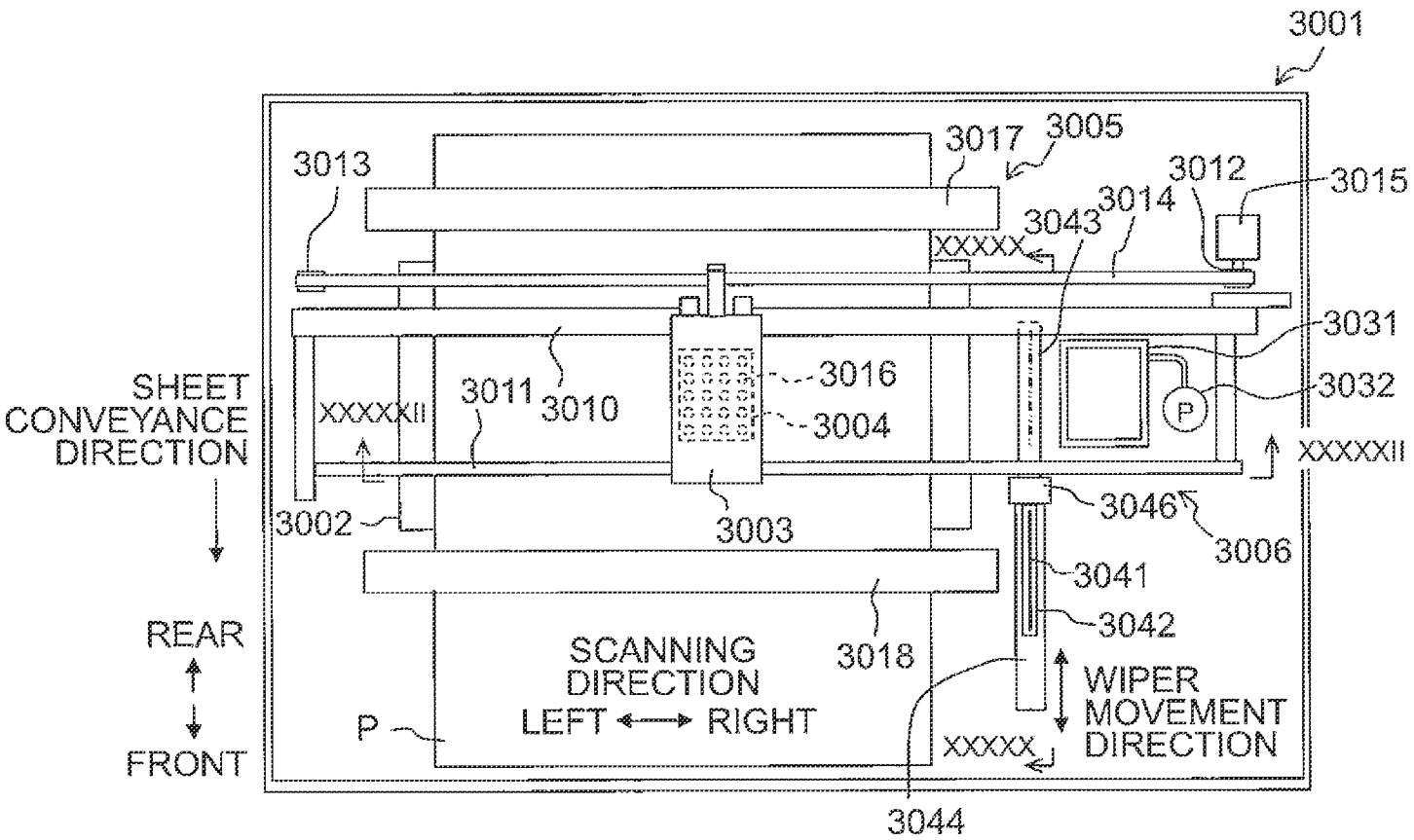
FIG. 49 is a schematic plan view depicting an ink-jet printer according to a fourth embodiment of the present teaching.

Next, an explanation will be made about the fourth embodiment of the present teaching. The constitutive parts or components, which are the same as or equivalent to those of the first to third embodiments, are designated by the same reference numerals, any explanation of which will be omitted as appropriate. As depicted in FIG. 49, an ink-jet printer 3001 (a liquid discharge apparatus of the present teaching) includes a platen 2 on which a recording sheet P is placed, a carriage 3 which is reciprocatively movable in a scanning direction (left-right direction) parallel to the platen 2, an ink-jet head 4 (a liquid discharge head of the present teaching) which is carried on the carriage 3, a conveyance mechanism 5 which conveys the recording sheet P in a sheet conveyance direction (frontward direction) perpendicular to the scanning direction, a maintenance unit 3006 which performs various maintenance operations to maintain and recover the liquid discharge performance of the ink-jet head 4, a control unit 7 (see FIG. 2) which is in charge of control of the entire parts of components of the ink-jet printer 3001, and the like.

The maintenance unit 3006 is disposed at a maintenance position, which is on the right side of the recording area of the ink-jet head 4 in the scanning direction (left-right direction). In order to remove any foreign matters, bubbles, and the like, mixed in the ink-jet head 4, the maintenance unit 3006 performs a suction purge for sucking and discharging the ink from ink discharge ports 16 and the wiping of ink adhering to an ink discharge surface 4*a* of the ink-jet head 4, when the ink-jet head 4 and the carriage 3 are positioned in the maintenance position. This makes it possible to maintain and recover the ink discharge performance of the ink-jet head 4. The maintenance unit 3006 includes a wiper 3041, a wiper cleaner 3046, a suction cap 31, a suction pump 32, and the like.

Figure 50:
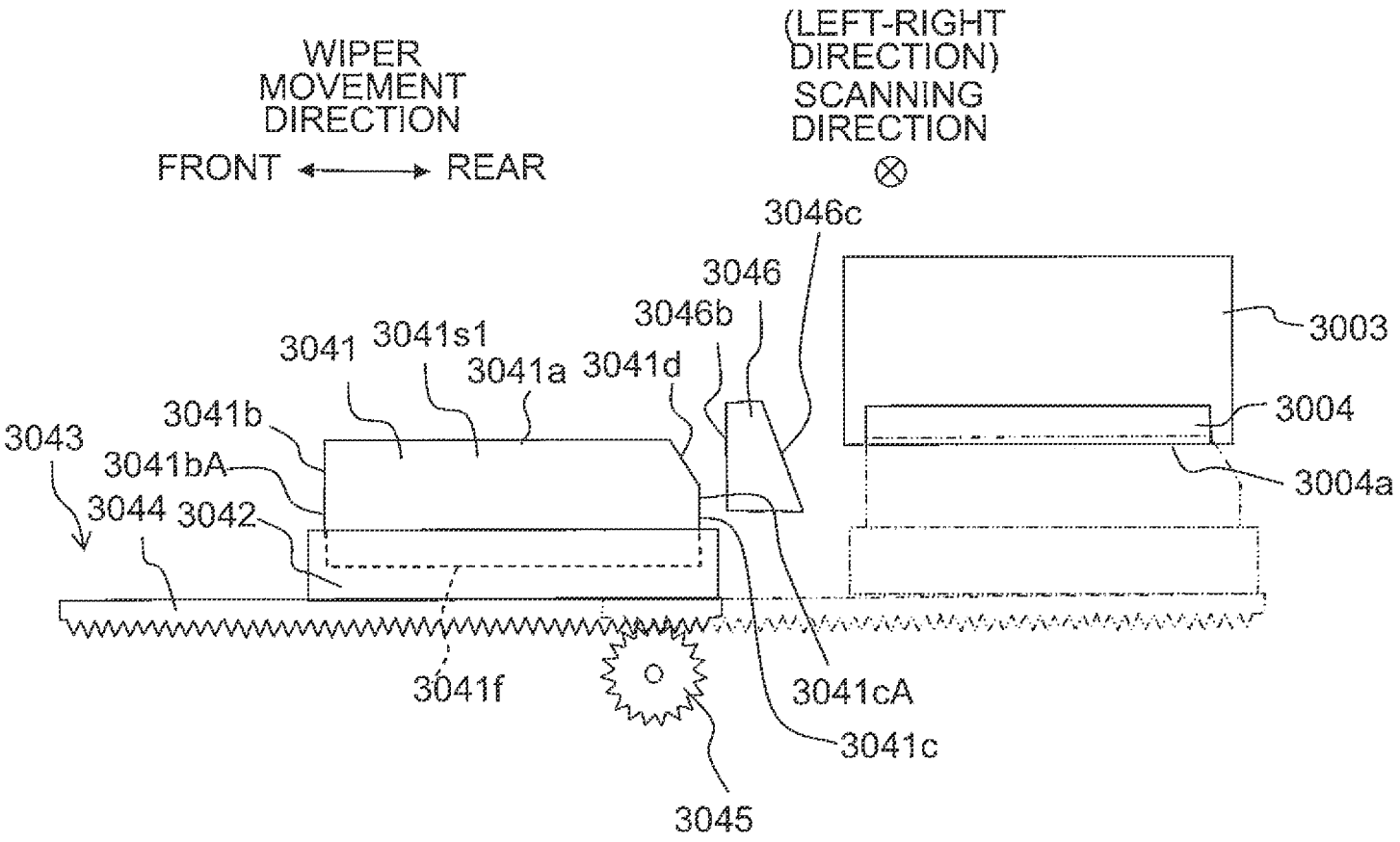
FIG. 50 is a view taken along the arrow XXXXX-XXXXX in FIG. 49.

The wiper 3041 is a flat plate member made of flexible material such as rubber and synthetic resin. As depicted in FIG. 50, the wiper 3041 is disposed to be orthogonal to the scanning direction in a state that a terminal end (lower end) 3041*f* is held by a wiper holder 3042. The upper end of the wiper holder 3042 is parallel to the terminal end 3041*f* of the wiper 3041.

The wiper 3041 is reciprocatively and linearly driven by means of a wiper movement mechanism 3043 in a direction (hereinafter referred to as "wiper movement direction") parallel to the ink discharge surface 4*a* and orthogonal to the scanning direction. The wiper 3041 is driven between a wiping position and a waiting position. The wiping position is on the movement path of the carriage 3 in the scanning direction (indicated by alternate long and two short dashes line in FIG. 49 and FIG. 50). The waiting position is on the front side of the wiping position (indicated by solid line in FIG. 49 and FIG. 50). The wiper movement mechanism 3043 includes a rack 44 attached to the wiper holder 3042, a pinion 45 engaging with the rack 44, and a wiper drive motor 25 which drives and rotates the pinion 45. The wiper movement mechanism 3043 may have any other structure than the above. The upper end of the wiper holder 3042 is parallel to the terminal end 3041*f* of the wiper 3041.

The wiper 3041 has a shape in which the corner on the upper rear side is cut from the rectangular shape. An upper end 3041*a* of the wiper 3041 extends parallel to the wiper movement direction. The wiper 3041 has a constant length ranging from the upper surface of the wiper holder 3042 to the upper end 3041*a*. A front end 3041*b* and a rear end 3041*c* of the wiper 3041 are orthogonal to the ink discharge surface 4*a*. An inclined end 3041*d* is formed between the upper end 3041*a* and the rear end 3041*c* so that the portion, of the inclined end 3041*d*, farthest from the rear end 3041*c*, has the longest length from the wiper holder 3042 in the up-down direction.

The upper end 3041*a* of the wiper 3041 is positioned above the ink discharge surface 4*a*. As depicted in FIG. 52C and FIG. 52D, when the ink-jet head 4 in the maintenance position moves in the scanning direction (in particular, leftward) with the wiper 3041 being in the wiping position, the ink adhering to the ink discharge surface 4*a* of the ink-jet head 4 is wiped with a right surface 3041*s*1 (a first surface of the present teaching) of the wiper 3041. The ink wiped is more likely to adhere to the right surface 3041*s*1 of the wiper 3041, and is less likely to adhere to a left surface 3041*s*2 (a second surface of the present teaching). The length of the wiper 3041 in the front-rear direction is substantially the same as or longer than the length of the ink discharge surface 4*a* in the front-rear direction. The wiper 3041 can wipe the entire ink discharge surface 4*a* during a single wiping operation.

The wiper 3041 is thin, of which entire thickness is, for example, about 1 mm. The upper end of the wiper 3041 is in a tapered shape. This allows the wiper 3041 to bend easily when the wiper 3041 makes contact with the ink discharge surface 4*a*, and thereby making it possible to wipe off the ink on the ink discharge surface 4*a* reliably. When the restoring force or resilience, by which the wiper 3041 in the bent state is restored to a normal state, is great, the force, which is transmitted from the wiper 3041 to the water-repellent film covering the ink discharge surface 4*a*, is also great. In the fourth embodiment, however, since the wiper 3041 has the thickness of approximately 1 mm, the resilience is relatively small. This reduces the force transmitting from the wiper 3041 to the water-repellent film, and thereby making it possible to prevent the water-repellent film from peeling off. Since the upper end 3041*a* of the wiper 3041 extends in the front-rear direction, the force transmitting from the wiper 3041 to the ink discharge surface 4*a* can be uniformized.

The wiper cleaner 3046 is held by a cleaner holder 3047 and is disposed between the waiting position and the wiper position of the wiper 3041. The illustration of the cleaner holder 3047 is omitted in the drawings depicting the wiper cleaner 3046, except for FIGS. 51A and 51B. The wiper cleaner 3046 is made of an elastic absorber, such as sponge, to have an approximately cuboid form. The wiper cleaner 3046 includes a slit 3046*a* roughly in the center thereof in the left-right direction. The slit 3046*a* ranges from the lower end to the vicinity of the upper end of the wiper cleaner 3046 and extends parallel to the wiper movement direction. The slit 3046*a* is formed by cutting or slitting the absorber. The width of the slit 3046*a* is smaller than the thickness of the wiper 3041, that is, the width of the slit 3046*a* is substantially zero. In the fourth embodiment, a part, of the wiper cleaner 3046, on the right side of the slit 3046*a* corresponds to a first contact part of the present teaching and a part, of the wiper cleaner 3046, on the left side of the slit 3046*a* corresponds to a second contact part of the present teaching.

A front surface 3046*b* of the wiper cleaner 3046 (hereinafter referred to as "vertical surface 3046*b*" in some cases) is perpendicular to the wiper movement direction (front-rear direction). A rear surface 3046*c* of the wiper cleaner 3046 (hereinafter referred to as "inclined surface 3046*c*" in some cases) is inclined to the direction perpendicular to the wiper movement direction so that the lowermost portion of the rear surface 3046*c* (the portion, of the rear surface 3046*c*, closest to the wiper holder 3042) has the longest length from the vertical surface 3046*b* in the front-rear direction.

Figure 51A:
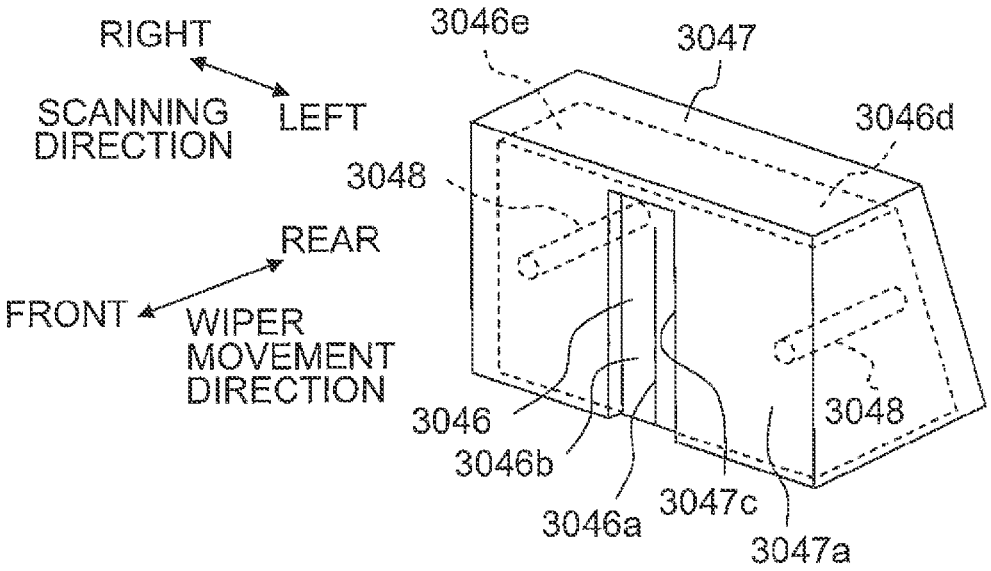
FIG. 51A is a perspective view of a wiper cleaner as viewed from the rear side of FIG. 49.
Figure 51B:
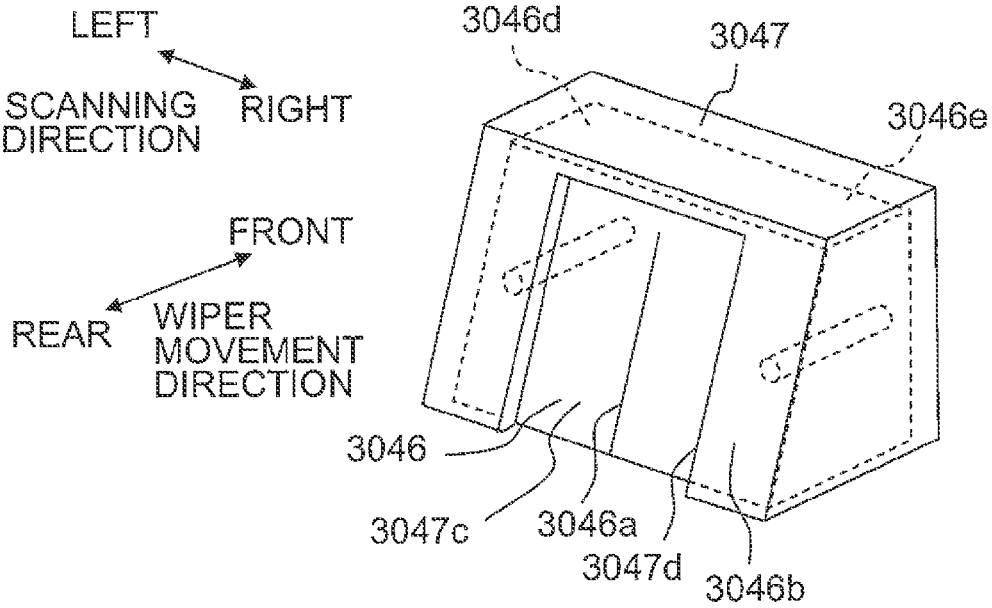
FIG. 51B is a perspective view of the wiper cleaner as viewed from the front side of FIG. 49.

As depicted in FIGS. 51A and 51B, the cleaner holder 3047 fixes a left end 3046*d* and a right end 3046*e* of the wiper cleaner 3046. Specifically, the wiper cleaner 3046 is fixed by two fixation bars 3048. The two fixation bars 3048 penetrate through circular holes formed in the left and right ends 3046*d*, 3046*e* of the wiper cleaner 3046. The structure for fixing the left and right ends 3046*d*, 3046*e* of the wiper cleaner 3046 may be any other structure than the above. The cleaner holder 3047 covers or surrounds parts of the front and rear surfaces 3046*b*, 3046*c*, the left and right surfaces, and the upper surface, of the wiper cleaner 3046. The cleaner holder 3047 is supported by an unillustrated support member in a cantilever manner. The cleaner holder 3047 includes notches 3047*c*, 3047*d* which are formed in a front wall 3047*a* (a second wall of the present teaching) and a rear wall 3047*b* (a first wall of the present teaching) of the cleaner holder 3047, respectively. The slit 3046*a* and the periphery thereof are exposed through the notches 3047*c*, 3047*d*.

The wiper cleaner 3046 is disposed at a position which allows a part, of the wiper 3041, on the upper side of the wiper holder 3042 to pass through the slit 3046*a* during the movement of the wiper 3041 between the waiting position and the wiping position.

Figure 54A:
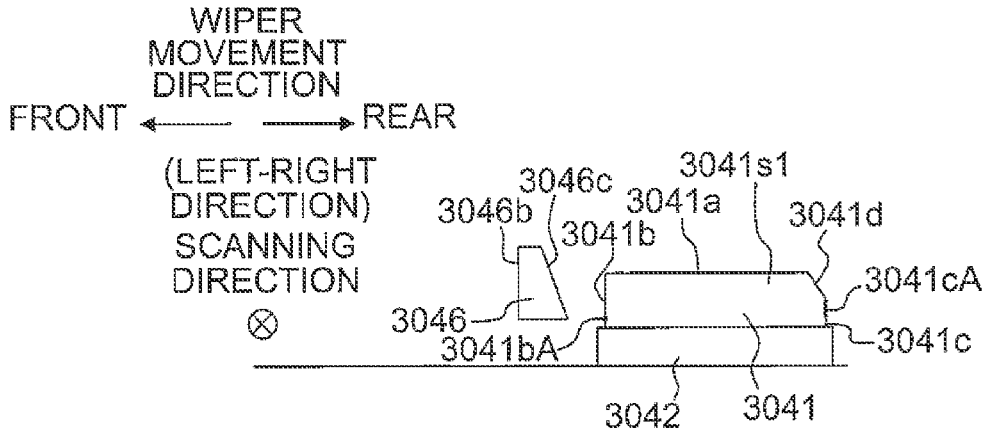
FIGS. 54A to 54D are views depicting a process, in which the wiper moves from the wiping position to the waiting position, according to the fourth embodiment.
Figure 54B:
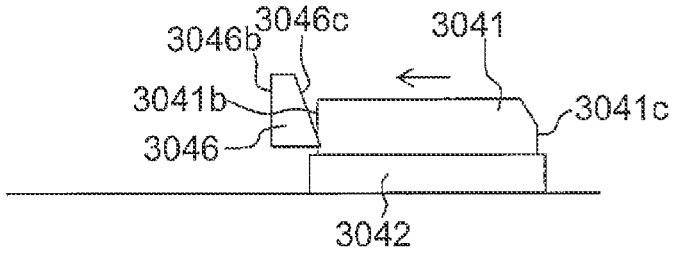
Figure 54C:
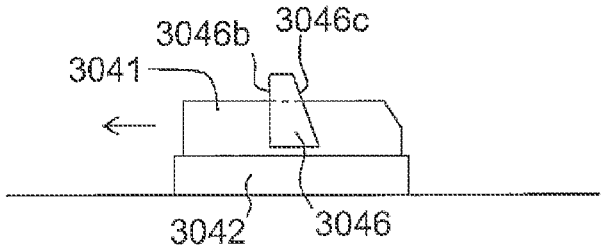
Figure 54D:
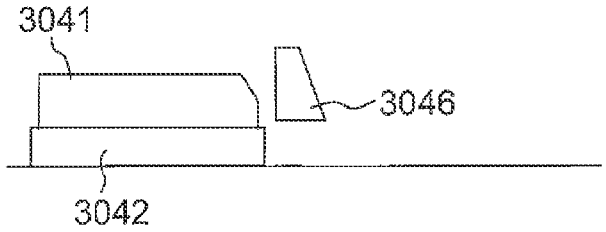

As depicted in FIGS. 53A to 53D, when the wiper 3041 moves rearward from the waiting position to the wiping position, the rear end 3041*c* of the wiper 3041 is inserted first into the slit 3046*a* of the wiper cleaner 3046 from the vertical surface 3046*b* side. Since the vertical surface 3046*b* of the wiper cleaner 3046 is parallel to the rear end 3041*c* of the wiper 3041, a part 3041*c*A (indicated by thick lines in FIGS. 50, 53A, and 54A), of the rear end 3041*c*, aligned with the wiper cleaner 3046 in the front-rear direction and a different part of the rear end 3041*c* are simultaneously brought into contact with the vertical surface 3046*b* to enter the slit 3046*a*. The part 3041*c*A of the rear end 3041*c* has a distance from the wiper holder 3042 in the up-down direction, which is shorter than that of the upper end 3041*a* of the wiper 3041. Thus, the part 3041*c*A is less likely to be bent than the upper end 3041*a*. This can insert the wiper 3041 into the slit 3046*a* easily, and thereby making it possible to prevent the wiper 3041 from being caught by the slit 3046*a*.

As depicted in FIGS. 54A to 54D, when the wiper 3041 moves frontward from the wiping position to the waiting position, the front end 3041*b* of the wiper 3041 is inserted first into the slit 3046*a* of the wiper cleaner 3046 from the inclined surface 3046*c* side. Since the inclined surface 3046*c* of the wiper cleaner 3046 is inclined rearward and downward, a part 3041*b*A (an intermediate part of the present teaching), of the front end 3041*b*, which has the same height as the lower end of the inclined surface 3046*c* is brought first into contact with the inclined surface 3046*c* to enter the slit 3046*a*. The part 3041*b*A of the front end 3041*b* has a distance from the wiper holder 3042 in the up-down direction, which is shorter than that of the upper end 3041*a* of the wiper 3041. Thus, the part 3041*b*A is less likely to be bent than the upper end 3041*a*. This can insert the wiper 3041 into the slit 3046*a* easily, and thereby making it possible to prevent the wiper 3041 from being caught by the slit 3046*a*. After that, the upper end 3041*a* of the wiper 3041 is inserted into the slit 3046*a* of the wiper cleaner 3046, which brings both surfaces of the wiper 3041 into contact with the wiper cleaner 3046. This makes it possible to remove the ink, which adhered to the wiper 3041 during the wiping of the ink discharge surface 4*a*, by use of the wiper cleaner 3046.

As described above, the ink is less likely to adhere to the left surface 3041*s*2 (the second surface of the present teaching) of the wiper 3041. Thus, a part (the second contact part of the present teaching), of the wiper cleaner 3046, which makes contact with the left surface 3041*s*2 has little association with the cleaning for the wiper 3041 in some cases. In both of the case where the ink adheres to the left surface 3041*s*2 and the case where no ink adheres to the left surface 3041*s*2, the part (the second contact part of the present teaching), of the wiper cleaner 3046, which makes contact with the left surface 3041*s*2 functions to ensure the contact surface pressure between the right surface 3041*s*1 (the first surface of the present teaching) of the wiper 3041 and the wiper cleaner 3046.

Both of the left and right ends 3046*d*, 3046*e* of the wiper cleaner 3046 are fixed by the fixation bars 3048. Thus, when the wiper 3041 is inserted into the slit 3046*a*, the wiper cleaner 3046 is deformed to bend in the travelling direction of the wiper 3041, with the ends 3046*d*, 3046*e* as the fulcrums. This allows the slit 3046*a* to expand more easily, as compared with the case where the entire upper surface of the wiper cleaner 3046 is fixed by the cleaner holder 3047. Thus, the wiper 3041 can pass through the slit 3046*a* smoothly.

As depicted in FIGS. 54A to 54D, when the wiper 3041 moves frontward through the slit 3046*a*, the front surface 3046*b* of the wiper cleaner 3046 is pressed against the front wall 3047*a* of the cleaner holder 3047 to regulate the deformation of the wiper cleaner 3046 toward the front side. As depicted in FIGS. 53A to 53E, when the wiper 3041 moves rearward through the slit 3046*a*, the rear surface 3046*c* of the wiper cleaner 3046 is pressed against the rear wall 3047*b* of the cleaner holder 3047 to regulate the deformation of the wiper cleaner 3046 toward the rear side. The notch 3047*c* formed in the front wall 3047*a* of the cleaner holder 3047 has a length in the scanning direction (left-right direction), which is shorter than that of the notch 3047*d* formed in the rear wall 3047*b* of the cleaner holder 3047. Thus, the contact area between the front wall 3047*a* of the cleaner holder 3047 and the wiper cleaner 3046 is larger than the contact area between the rear wall 3047*b* of the cleaner holder 3047 and the wiper cleaner 3046. In this structure or configuration, the wiper cleaner 3046 is less likely to be deformed when the wiper 3041 moves frontward from the wiping position to pass through the slit 3046*a*, as compared with the case where the wiper 3041 moves rearward from the waiting position to pass through the slit 3046*a*. Therefore, the wiper cleaner 3046 can be brought in contact stronger with the wiper 3041 to improve the cleaning accuracy, when the wiper 3041 moves frontward from the wiping position to pass through the slit 3046*a*. Meanwhile, when the wiper 3041 moves from the waiting position to the wiping position, it is possible to reduce the loads on the wiper 3041 and the wiper cleaner 3046. This elongates the service lives of the wiper 3041 and the wiper cleaner 3046.

An explanation will be made in detail about the action or motion of the maintenance unit 3006. The control unit 7 controls the maintenance unit 3006 to move, in a case that the suction purge for the ink-jet head 4 is required to be performed. The case includes, for example, the timing immediately after power is applied to the ink-jet printer 1 and the case in which a purge command is inputted by a user.

Figure 52A:
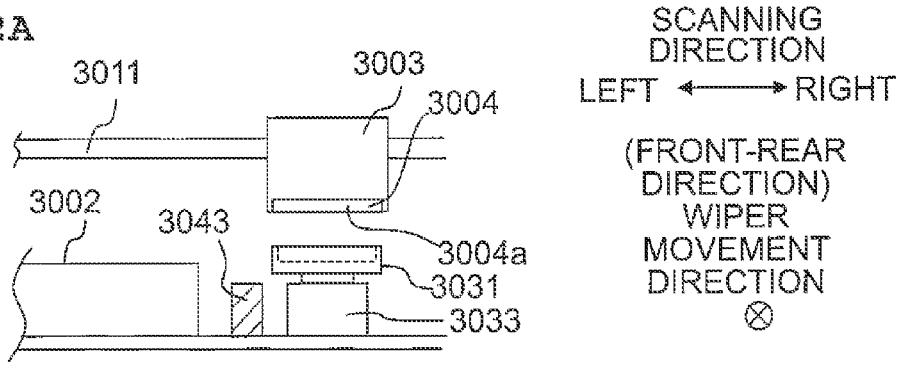
FIGS. 52A to 52D are illustrative views each illustrating an operation of a maintenance unit according to the fourth embodiment.
Figure 52B:
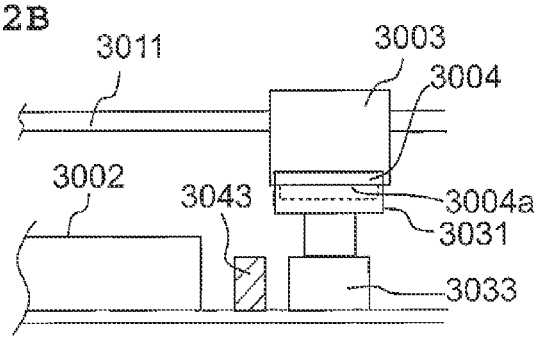
Figure 52C:
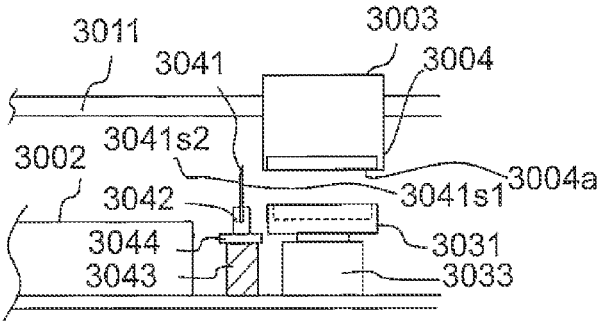
Figure 52D:
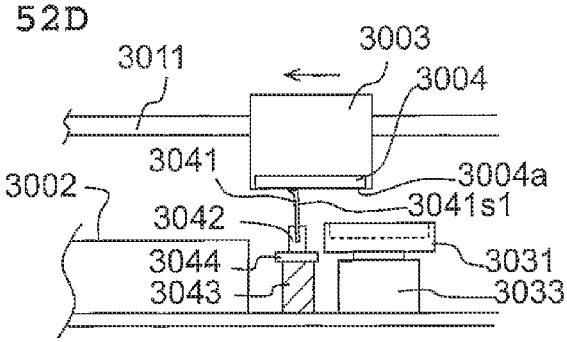

At first, as depicted in FIG. 52A, the ink-jet head 4 is positioned in the maintenance position to face the suction cap 31. Next, the cap lifting motor 24 is driven to move the suction cap 31 upward from the waiting position depicted in FIG. 52A. Then, the suction cap 31 is brought into tight contact with the ink discharge surface 4*a* of the ink-jet head 4 as depicted in FIG. 52B. In this state, the suction pump 32 is driven to reduce the pressure in the suction cap 31. In this way, foreign matters and bubbles mixed in the ink-jet head 4 are sucked and discharged, together with the ink, from the ink discharge ports 16 covered with the suction cap 31 (suction purge).

After the suction purge for a certain period of time, the suction cap 31 is moved down to return to the waiting position. In this situation, a part of the ink, which was discharged from the ink discharge ports 16 during the suction purge, is adhering to the ink discharge surface 4*a*. Thus, subsequent to the suction purge, the wiper 3041 wipes off the ink on the ink discharge surface 4*a*. As depicted in FIG. 52C and FIGS. 53A to 53D, the wiper drive motor 25 is at first driven to move the wiper 3041 from the waiting position to the wiping position. During this movement, the wiper 3041 passes through the slit 3046*a* of the wiper cleaner 3046.

Figure 53A:
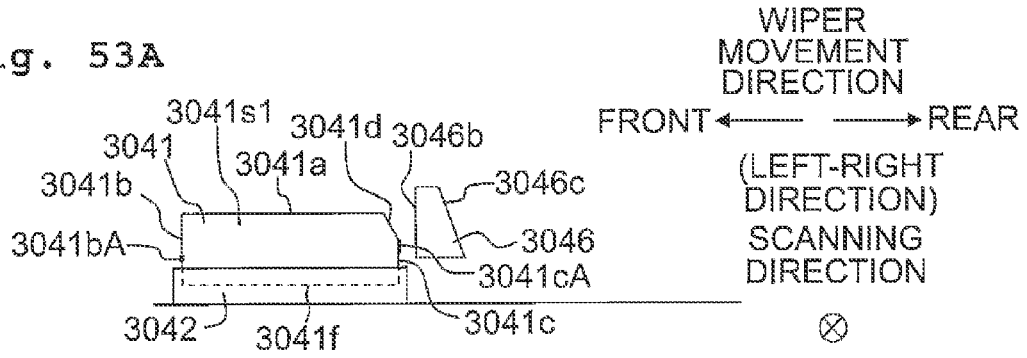
FIGS. 53A to 53E are views depicting a process, in which the wiper moves from a waiting position to a wiping position, according to the fourth embodiment.
Figure 53B:
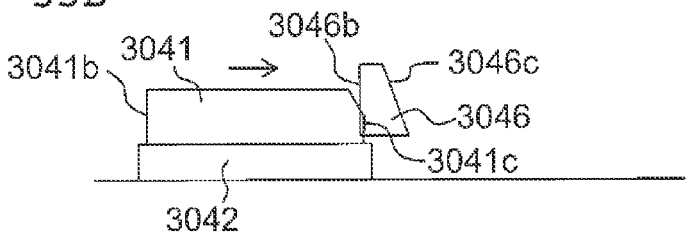
Figure 53C:
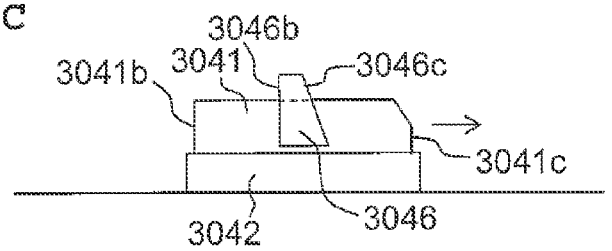
Figure 53D:
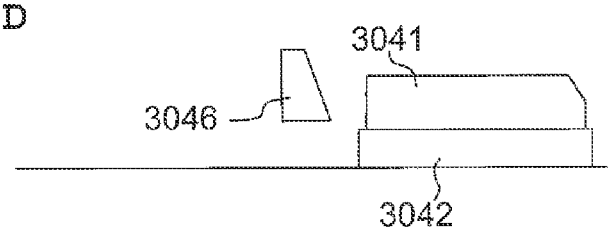
Figure 53E:
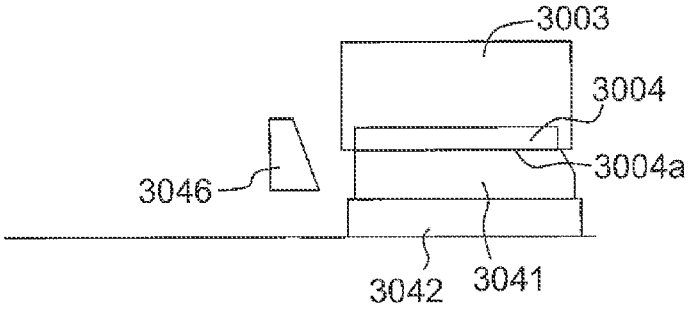

Next, as depicted in FIGS. 52D and 53E, the carriage 3 moves in a direction closer to the platen 2 to bring the ink discharge surface 4*a* of the ink-jet head 4 into contact with the upper end of the wiper 3041. This allows the wiper 3041 to wipe off the ink adhering to the ink discharge surface 4*a*. After that, as depicted in FIGS. 54A to 54D, the wiper 3041 moves from the wiping position to the waiting position. During this movement, the wiper 3041 passes through the slit 3046*a* of the wiper cleaner 3046, and thus the ink, which adhered to the wiper 3041 during the wiping operation for the ink discharge surface 4*a*, is removed by wiper cleaner 3046.

In the fourth embodiment, the scanning direction (left-right direction) corresponds to a first direction of the present teaching, the up-down direction perpendicular to the ink discharge surface 4*a* corresponds to a second direction of the present teaching, and the wiper movement direction (front-rear direction) corresponds to a third direction of the present teaching. The upper end 3041*a* of the wiper 3041 corresponds to an upper end of the present teaching. Each of the part 3041*b*A of the front end 3041*b* and the part 3041*c*A of the rear end 3041*c* of the wiper 3041 corresponds to the intermediate part of the present teaching. The inclined end 3041*d* of the wiper 3041 corresponds to an inclined end of the present teaching.

<Fifth Embodiment>

Next, an explanation will be made about the fifth embodiment of the present teaching. The constitutive parts or components, which are the same as or equivalent to those of the first to fourth embodiments, are designated by the same reference numerals, any explanation of which will be omitted as appropriate. The constitutive parts or components of an ink-jet printer (a liquid discharge apparatus of the present teaching) of the fifth embodiment are the same as those of the fourth embodiment, except for a wiper 3141 and a wiper movement mechanism 3143.

Figure 55A:
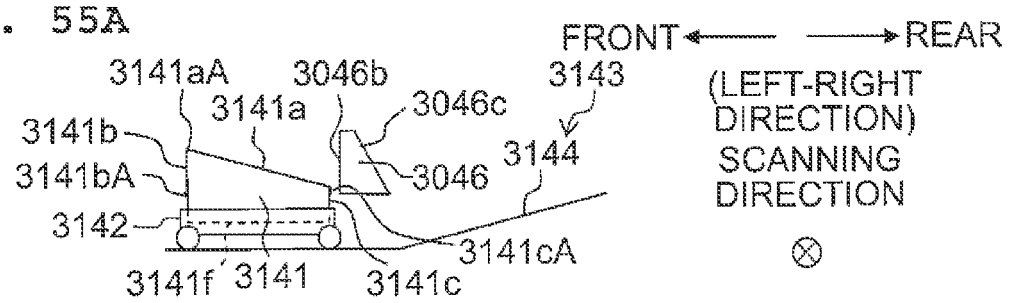
FIGS. 55A to 55E are illustrative views each illustrating an operation of an ink-jet printer according to a fifth embodiment.
Figure 55B:
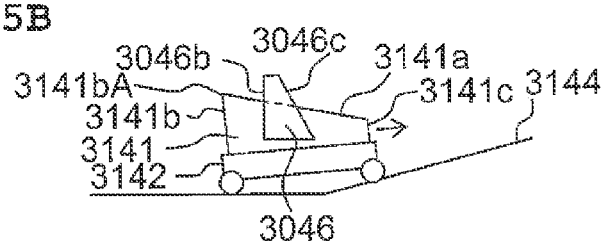
Figure 55C:
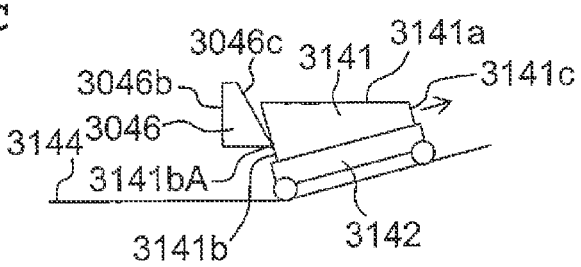
Figure 55D:
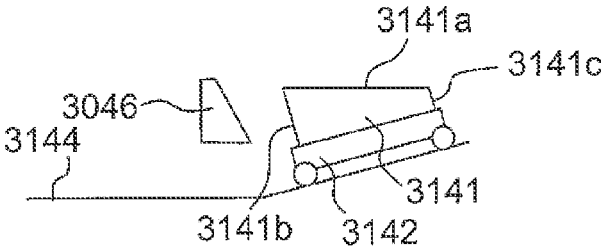
Figure 55E:
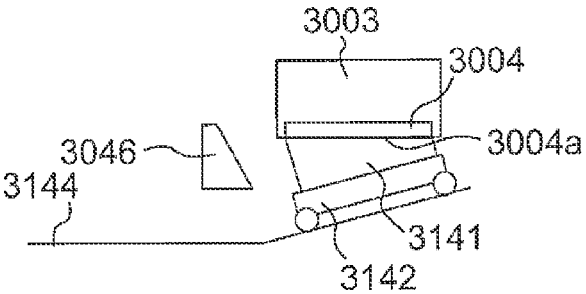
Figure 56A:
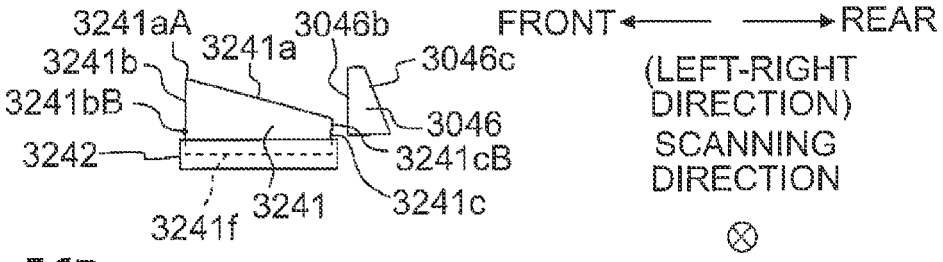
FIGS. 56A to 56E are illustrative views each illustrating an operation of an ink-jet printer according to a sixth embodiment.
Figure 56B:
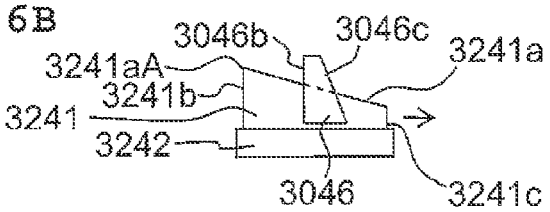
Figure 56C:
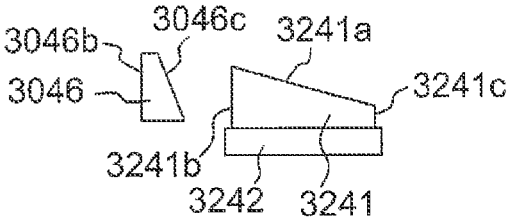
Figure 56D:
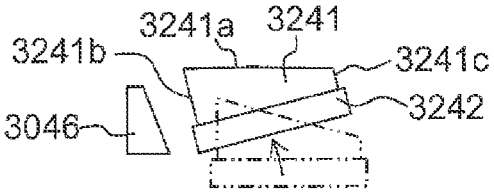
Figure 56E:
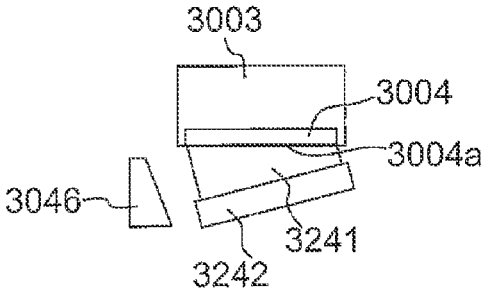

As depicted in FIG. 55A, the wiper 3141 is disposed to be orthogonal to the scanning direction in a state that a terminal end (lower end) 3141*f* is held by a wiper holder 3142. The material and thickness of the wiper 3141 are the same as those of the wiper 3041 of the fourth embodiment. The wiper 3141 has a trapezoidal shape in which a front end 3141*b* is longer than a rear end 3141*c*. The front end 3141*b* and the rear end 3141*c* are perpendicular to the terminal end 3141*f*. An inclined end 3141*a* connects the upper end of the front end 3141*b* and the upper end of the rear end 3141*c*. The length of the inclined end 3141*a* from the wiper holder 3142 in the up-down direction increases toward the side of the front end 3141*b*. Namely, an uppermost front end portion 3141*a*A (a portion connected to the front end 3141*b*) of the inclined end 3141*a* has the longest length from the wiper holder 3142 in the up-down direction. The length of the inclined end 3141*a* in the front-rear direction is the same as or longer than the length of the ink discharge surface 4*a* in the front-rear direction. In the fifth embodiment, the inclined end 3141*a* of the wiper 3141 corresponds to an inclined end of the present teaching, and the uppermost front end portion 3141*a*A of the inclined end 3141*a* corresponds to an upper end of the present teaching.

As depicted in FIGS. 55A to 55D, the wiper movement mechanism 3143 changes the tilt of the wiper 3141 in the up-down direction while moving the wiper 3141 between the wiping position and the waiting position in the front-rear direction. The wiper movement mechanism 3143 moves the wiper 3141 along a guide rail 3144 extending in the front-rear direction and being inclined in the up-down direction. The wiper movement mechanism 3143 may have any other structure than the above. The movement directions of the wiper 3141 by the wiper movement mechanism 3143 vary depending on the position, of the wiper 3141 in the movement area, in the front-rear direction. Specifically, when the wiper 3141 moves from the waiting position to the wiping position, the wiper 3141 moves parallel to the ink discharge surface 4*a* on the front side of the movement area; the wiper 3141 tilts further upward as it moves rearward in the center of the movement area (for example, FIG. 55B); and the wiper 3141 moves rearward and obliquely upward on the rear side of the movement area (from FIG. 55C to FIG. 55D). When the wiper 3141 is in the waiting position, the wiper 3141 is disposed so that the terminal end 3141*f* is parallel to the ink discharge surface 4*a* (i.e., the inclined end 3141*a* is inclined to the ink discharge surface 4*a*). When the wiper 3141 is in the wiping position, the wiper 3141 is disposed so that the inclined end 3141*a* is positioned parallel to and above the ink discharge surface 4*a*.

As depicted in FIGS. 55A to 55D, when the wiper 3141 moves rearward from the waiting position to the wiping position, the rear end 3141*c* of the wiper 3141 is inserted first into the slit 3046*a* of the wiper cleaner 3046 from the vertical surface 3046*b* side. In this situation, a part 3141*c*A (corresponding to an intermediate part of the present teaching), of the rear end 3141*c*, aligned with the vertical surface 3046*b* in the front-rear direction and a different part of the rear end 3141*c* enter the slit 3046*a* simultaneously. Since the rear end 3141*c* is shorter than the front end 3141*b*, the rear end 3141*c* is less likely to be bent than the front end 3141*b*. This can insert the wiper 3141 into the slit 3046*a* easily.

When the wiper 3141 moves frontward from the wiping position to the waiting position, the front end 3141*b* of the wiper 3141 is inserted first into the slit 3046*a* of the wiper cleaner 3046 from the inclined surface 3046*c* side. In this situation, similar to the fourth embodiment, since the front end 3141*b* is inclined to the inclined surface 3046*c*, a part 3141*b*A (corresponding the intermediate part of the present teaching), of the front end 3141*b*, on the lower side of the inclined end 3141 is inserted first into the slit 3046*a*. This can insert the wiper 3141 into the slit 3046*a* easily.

In the fifth embodiment, the inclined end 3141*a* of the wiper 3141 is inclined to the wiper holder 3142 to wipe the ink discharge surface 4*a* with the inclined end 3141*a*. Thus, in the fifth embodiment, the length of the wiper 3141 in the front-rear direction can be shorter than the case, like the fourth embodiment, in which the wiper 3041 includes the inclined end 3041*d* and the upper end 3041*a* wiping the ink discharge surface 4*a* which are connected with each other.

<Sixth Embodiment>

Next, an explanation will be made about the sixth embodiment of the present teaching. The constitutive parts or components, which are the same as or equivalent to those of the first to fifth embodiments, are designated by the same reference numerals, any explanation of which will be omitted as appropriate. An ink-jet printer (a liquid discharge apparatus of the present teaching) of the sixth embodiment includes a wiper movement mechanism, which is different from those of the ink-jet printers of the fourth and fifth embodiments. A wiper 3241 of the sixth embodiment has the same shape as that of the wiper 3141 of the fifth embodiment. The wiper 3241 is held by a wiper holder 3242.

As depicted in FIGS. 56A to 56D, the wiper movement mechanism of the sixth embodiment reciprocatively and linearly drives the wiper 3241 between the wiping position and the waiting position in the front-rear direction, and at the same time, the wiper movement mechanism changes the tilt of the wiper 3241, which is positioned in the wiping position, in the up-down direction. The wiper movement mechanism may have any other structure than the above. The wiper 3241 is configured so that a terminal end 3241*f* of the wiper 3241 is parallel to the ink discharge surface 4*a* (i.e., an inclined end 3241*a* is inclined to the ink discharge surface 4*a*), when the wiper 3241 is in the waiting position and when the wiper 3241 is moving in the front-rear direction. The wiper movement mechanism changes the tilt of the wiper 3241 when the wiper 3241 is in the wiping position. This allows the inclined end 3241*a* of the wiper 3241 to switch between the state in which the inclined end 3241*a* is inclined to the ink discharge surface 4*a* and the state in which the inclined end 3241*a* is parallel to the ink discharge surface 4*a*. When the wiper 3241 is in the wiping position with the inclined end 3241*a* being parallel to the ink discharge surface 4*a*, the inclined end 3241*a* is positioned above the ink discharge surface 4*a*. In the sixth embodiment, the inclined end 3241*a* of the wiper 3241 corresponds to an inclined end of the present teaching; and an uppermost front end portion 3241 aA of the inclined end 3241*a* corresponds to a front end of the present teaching.

As depicted in FIGS. 56A to 56D, when the wiper 3241 moves rearward from the waiting position to the wiping position, a rear end 3241*c* of the wiper 3241 is inserted first into the slit 3046*a* of the wiper cleaner 3046 from the vertical surface 3046*b* side. In this situation, similar to the fifth embodiment, a part 3241*c*B (corresponding to an intermediate part of the present teaching), of the rear end 3241*c*, aligned with the vertical surface 3046*b* in the front-rear direction and a different part of the rear end 3241*c* enter the slit 3046*a* simultaneously. This can insert the wiper 3241 into the slit 3046*a* easily.

When the wiper 3241 moves frontward from the wiping position to the waiting position, a front end 3241*b* of the wiper 3241 is inserted first into the slit 3046*a* of the wiper cleaner 3046 from the inclined surface 3046*c* side. In this situation, similar to the fifth embodiment, a part 3241*b*B (corresponding the intermediate part of the present teaching), of the front end 3241*b*, on the lower side of the inclined end 3241*a* is inserted first into the slit 3046*a*. This can insert the wiper 3241 into the slit 3046*a* easily.

<Modified Embodiments of Fourth to Sixth Embodiments>

Although the fourth to sixth embodiments of the present teaching have been explained above, the present teaching is not restricted to the fourth to sixth embodiments and various changes may be made within the scope of the claims.

Figure 57:
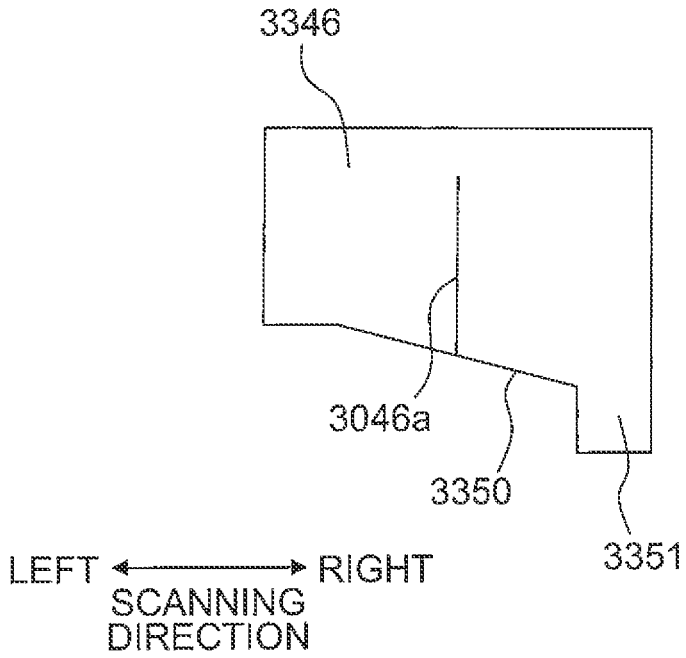
FIG. 57 is a front view depicting a wiper cleaner of an ink-jet printer according to a modified embodiment of the fourth to sixth embodiments.

In the fourth to sixth embodiments, the entire lower surface of the wiper cleaner 3046 is horizontal. However, as depicted in FIG. 57, at least a part (inclined surface 3350), of the lower surface of a wiper cleaner 3346, directly beneath the slit 3046*a* may be inclined to the horizontal surface to have different levels in the left-right direction. This moves the ink absorbed in the wiper cleaner 3346 downward along the inclined surface 3350, so that the ink gathers at a lower part of the inclined surface 3350. In FIG. 57, the wiper cleaner 3346 includes an ink discharge part 3351 protruding downward beyond the lowermost end of the inclined surface 3350. The ink is discharged from the ink discharge part 3351.

Figure 58:
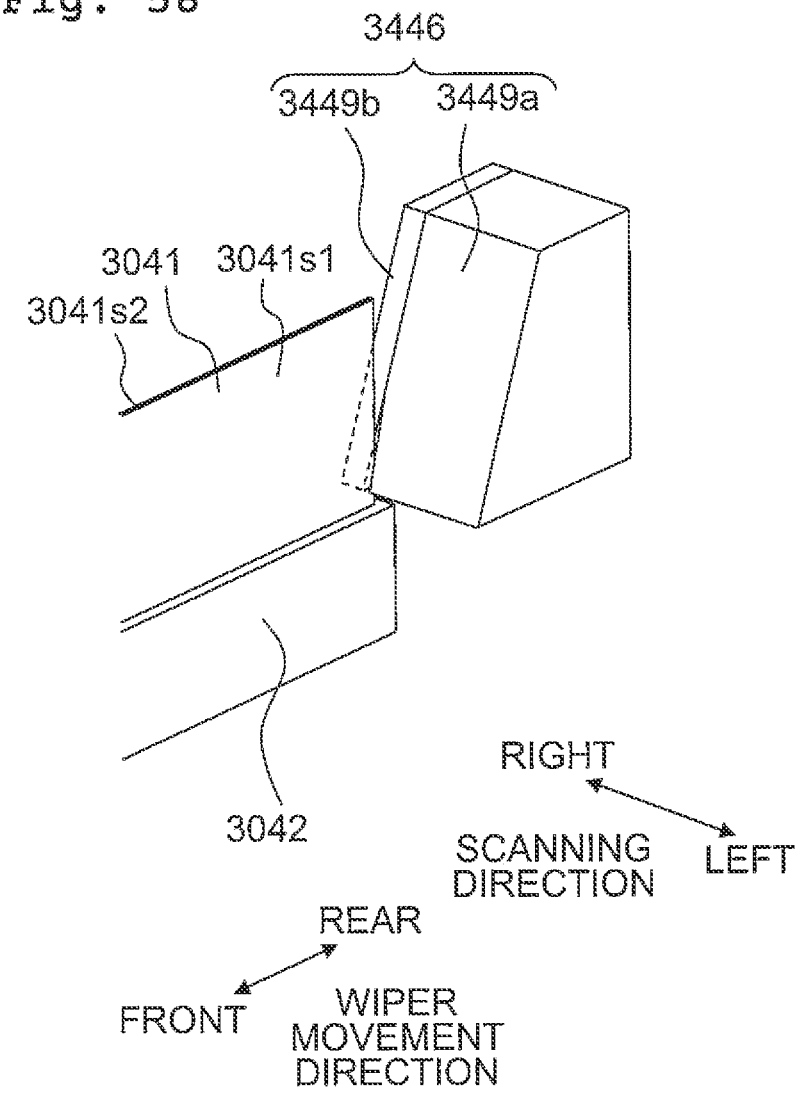
FIG. 58 is a perspective view depicting a wiper and a wiper cleaner of an ink-jet printer according to a modified embodiment of the fourth to sixth embodiments.

In the fourth to sixth embodiments, the wiper cleaner 3046 is formed only of the absorber. However, as depicted in FIG. 58, a wiper cleaner 3446 may be formed of an ink absorbing part 3449*a* (the first contact part of the present teaching) and a wiper contact part 3449*b* (the second contact part of the present teaching). The ink absorbing part 3449*a* is made of the absorber, and the wiper contact part 3449*b* is made of synthetic resin and the like to have the rigidity higher than that of the absorber. The ink absorbing part 3449*a* makes contact with the right surface 3041*s*1 of the wiper 3041 (the first surface of the present teaching), and the wiper contact part 3449*b* makes contact with the left surface 3041*s*2 of the wiper 3041 (the second surface of the present teaching). Since the ink is more likely to adhere to the right surface 3041*s*1 and less likely to adhere to the left surface 3041*s*2, the wiper 3041 can be cleaned with the wiper cleaner 3446 as well. However, the wiper cleaner 3046 in each of the fourth to sixth embodiments is more preferred to improve the cleaning quality. The wiper contact part 3449*b* functions to ensure the contact surface pressure between the right surface 3041*s*1 of the wiper 3041 and the ink absorbing part 3449*a*.

Figure 59:
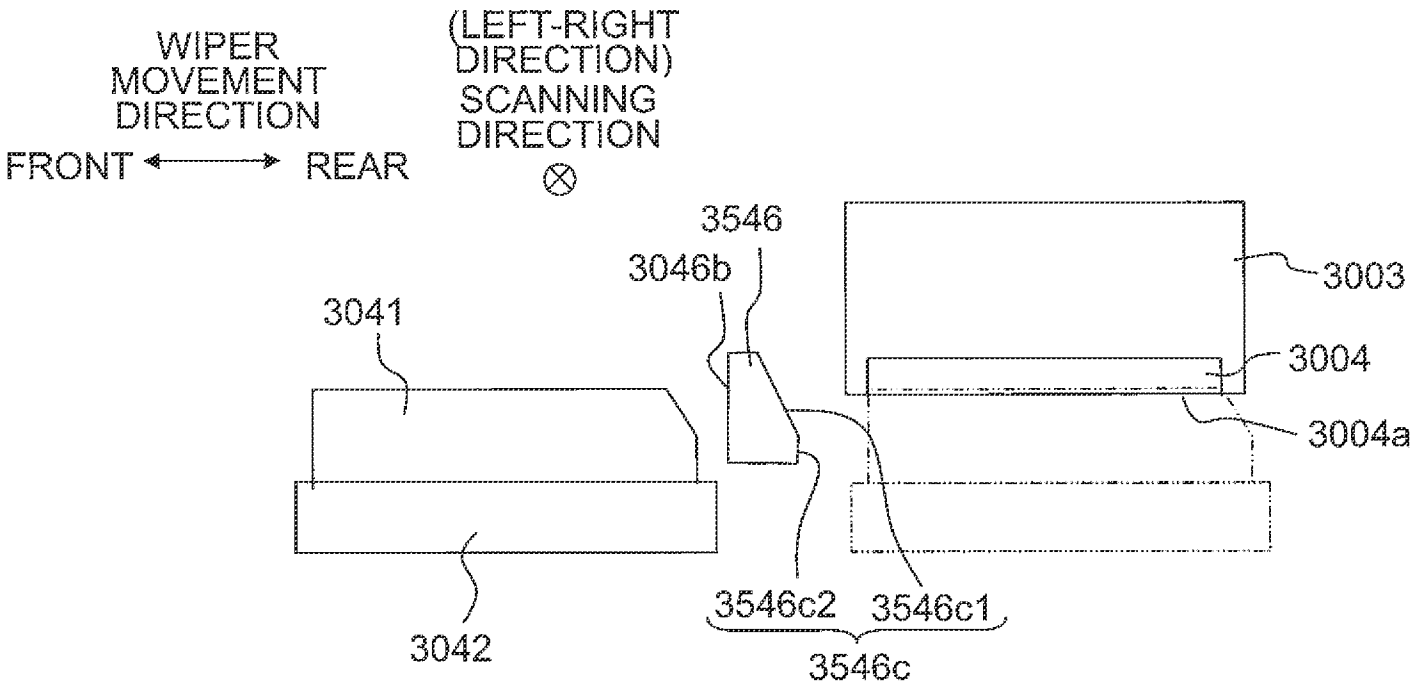
FIG. 59 is a view depicting an ink-jet printer according to a modified embodiment of the fourth to sixth embodiments and corresponding to FIG. 50.

In the fourth to sixth embodiments, the entire rear surface 3046*c* of the wiper cleaner 3046 is inclined in the up-down direction. For example, like a wiper cleaner 3546 depicted in FIG. 59, only an upper part 3546*c*1 of a rear surface 3546*c* may be inclined in the up-down direction, and a lower part 3546*c*2 of the rear surface 3546*c* may extend in a direction perpendicular to the movement direction of the wiper 3041.

As a modified embodiment of the fourth and sixth embodiments, the wiper cleaner 3046 and each of the wipers 3041, 3141, and 3241 may be arranged symmetrically, in the front-rear direction, to the arrangement of the fourth embodiment. In a case of applying this modified embodiment to the sixth embodiment, however, a direction in which the tilt of the wiper 3241 is changed is different from that of the sixth embodiment.

Figure 60:
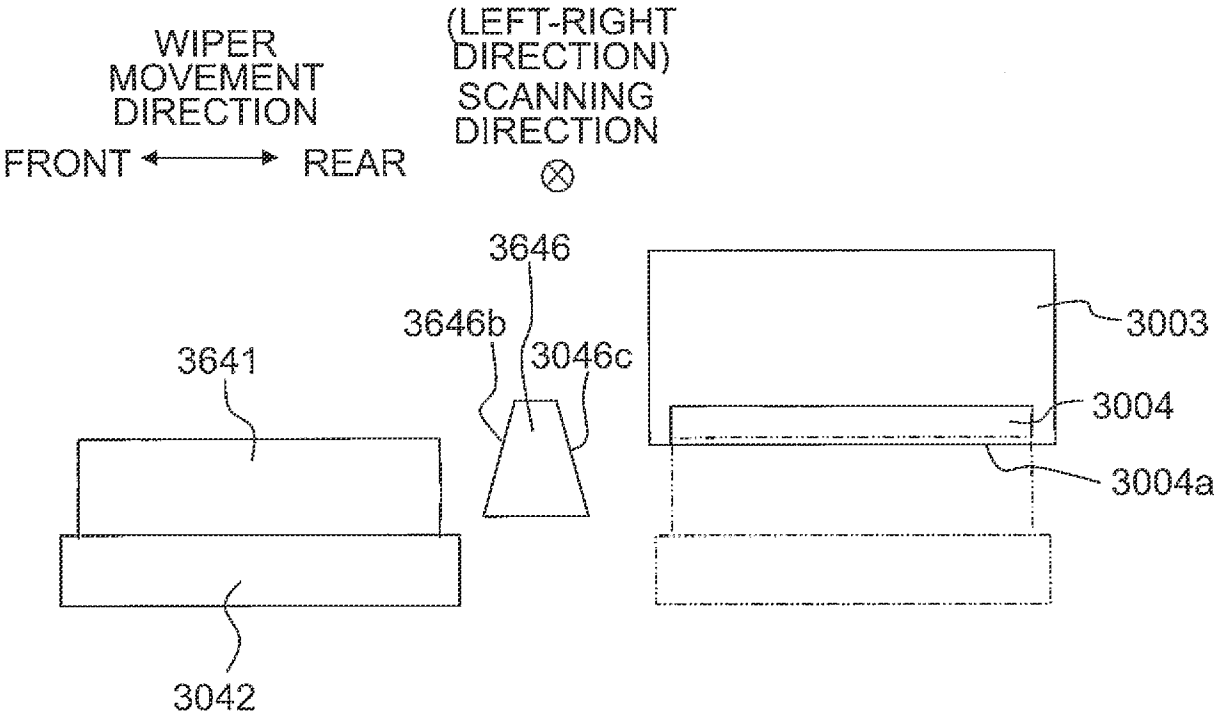
FIG. 60 is a view depicting an ink-jet printer according to a modified embodiment of the fourth embodiment and corresponding to FIG. 50.

As a modified embodiment of the fourth embodiment, for example, as depicted in FIG. 60, a wiper cleaner 3646 may be disposed so that front and rear surfaces 3646*b*, 3646*c* are inclined in the direction perpendicular to the front-rear direction to increase the distance between the surfaces 3646*b*, 3646*c* toward the wiper holder 3042. This structure allows the wiper 3641 to have a rectangular shape, which makes it possible to reduce the width of the wiper 3641. Noted that, since the length of the wiper cleaner 3646 in the front-rear direction is longer than that of the wiper cleaner 3046 of the fourth embodiment, the wiper cleaner 3046 of the fourth embodiment is more preferred in view of the downsizing of the wiper cleaner in the front-rear direction.

Figure 61:
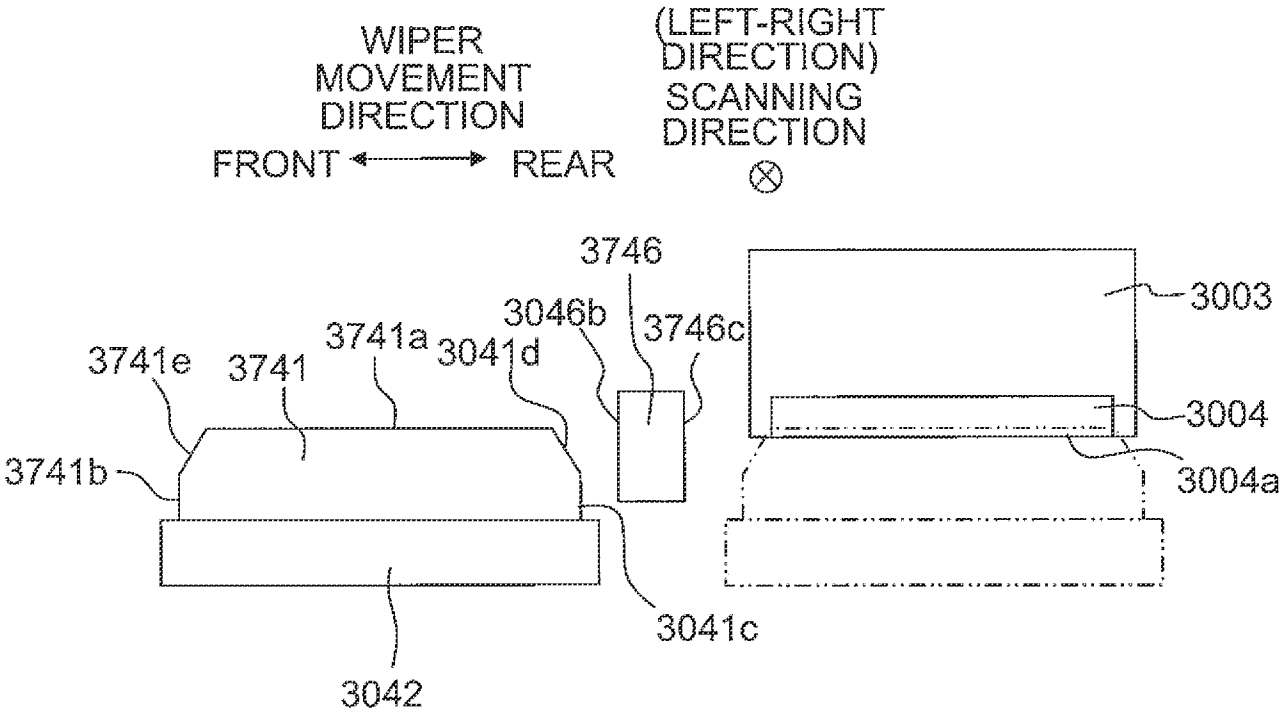
FIG. 61 is a view depicting an ink-jet printer according to a modified embodiment of the fourth embodiment and corresponding to FIG. 50.

As a modified embodiment of the fourth embodiment, for example, as depicted in FIG. 61, front and rear surfaces 3746*b*, 3746*c* of a wiper cleaner 3746 may be perpendicular to the front-rear direction, and a wiper 3741 may include an inclined end 3741*e* between a front end 3741*b* and an upper end 3741*a* and an inclined end 3741*d* between a rear end 3741*c* and the upper end 3741*a*. Regarding each of the inclined ends 3741*e*, 3741*d*, the length from the wiper holder 3042 in the up-down direction becomes longer toward the upper end 3741*a*. This structure can reduce the length of the wiper cleaner 3746 in the front-rear direction. Further, according to this structure, front and rear walls of a cleaner holder (not depicted), which are brought in contact with the front and rear surfaces 3746*b*, 3746*c* of the wiper cleaner 3746, are also perpendicular to the front-rear direction. Thus, it is possible to prevent the deformation and downward movement of the wiper cleaner 3746 along the front or rear wall of the cleaner holder, which would be otherwise caused when the wiper 3741 is passing through the slit of the wiper cleaner 3746. Noted that, since the length of the wiper 3741 in the front-rear direction is longer than that of the wiper 3041 of the fourth embodiment, the wiper 3041 of the fourth embodiment is more preferred in view of the downsizing of the wiper in the front-rear direction.

In the fourth to sixth embodiments, the waiting position of each of the wipers 3041, 3141, and 3241 is on the front side of the wiping position in the sheet conveyance direction. The waiting position of each of the wipers 3041, 3141, and 3241, however, may be on the rear side of the wiping position.

Figure 62A:
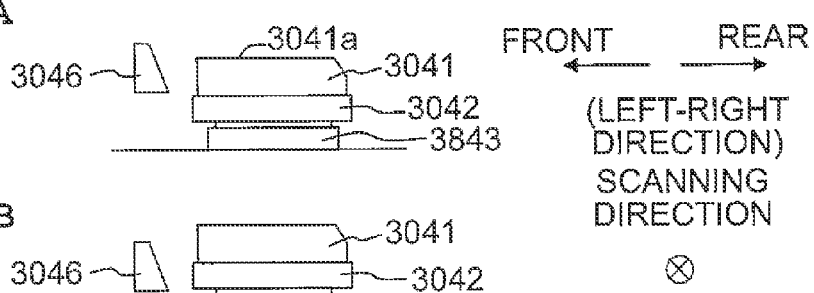
FIGS. 62A to 62G are illustrative views each illustrating an operation of an ink-jet printer according to a modified embodiment of the fourth to sixth embodiments.
Figure 62B:
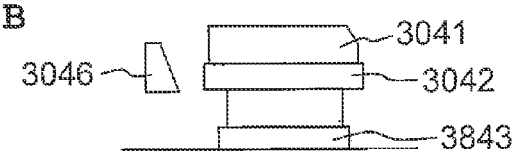
Figure 62C:
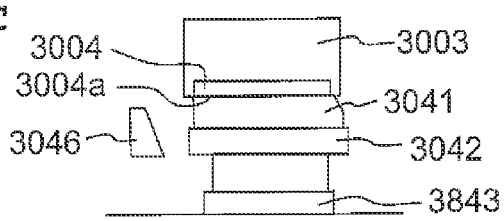
Figure 62D:
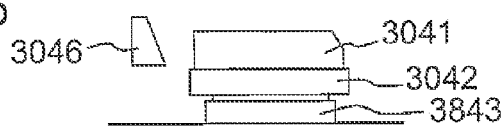
Figure 62E:
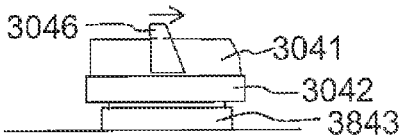
Figure 62F:
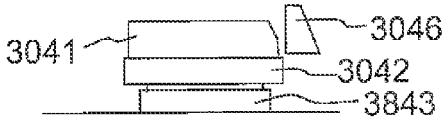
Figure 62G:
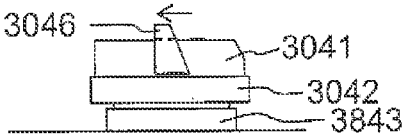
Figure 63A:
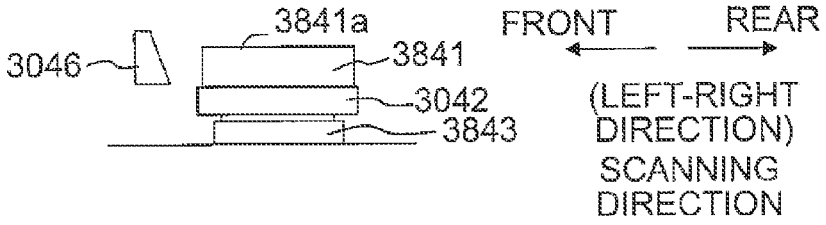
FIGS. 63A to 63G are illustrative views each illustrating an operation of an ink-jet printer according to a modified embodiment of the fourth to sixth embodiments.
Figure 63B:
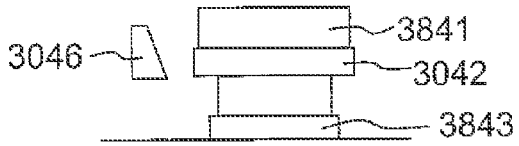
Figure 63C:
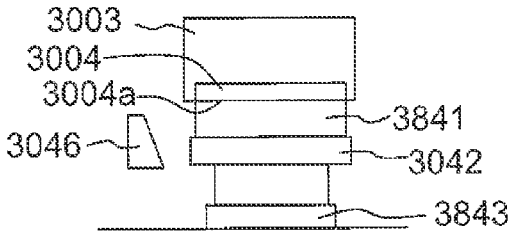
Figure 63D:
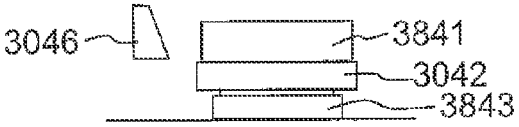
Figure 63E:
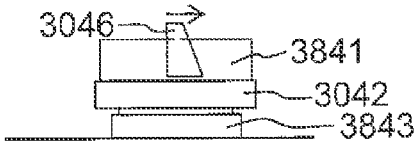

In the fourth to sixth embodiments, the movement of each of the wipers 3041, 3141, and 3241 causes the relative movement between each of the wipers 3041, 3141, and 3241 and the wiper cleaner 3046. However, as depicted in FIGS. 62D to 62G and FIGS. 63D to 63G, the movement of wiper cleaner 3046 may cause the relative movement between each of the wipers 3041 and 3841 and the wiper cleaner 3046. The modified embodiments depicted in FIGS. 62A to 62G and FIGS. 63A to 63G will be explained in detail as follows. Each of the wipers 3041 and 3841 is allowed to move up and down by a lifting motor 3843, which is driven by a motor or the like. The wiper cleaner 3046 is allowed to reciprocate in a direction parallel to the ink discharge surface 4*a* and orthogonal to the scanning direction by an unillustrated movement mechanism (corresponding to a movement mechanism of the present teaching), which is driven by a motor or the like. When each of the wipers 3041 and 3841 wipes off the ink on the ink discharge surface 4*a*, each of the wipers 3041 and 3841 at first moves from the position depicted in FIGS. 62A and 63A to the position depicted in FIGS. 62B and 63B. Then, the ink-jet head 4 moves in the scanning direction as depicted in FIGS. 62C and 63C, in a state that each of the wipers 3041 and 3841 is in the position depicted in FIGS. 62B and 63B, thereby wiping off the ink adhering to the ink discharge surface 4*a* with each of the wipers 3041 and 3841. After that, each of the wipers 3041 and 3841 moves down as depicted in FIGS. 62D and 63D. After the downward movement of each of the wipers 3041 and 3841, as depicted in FIGS. 62E to 62G and FIGS. 63E to 63G, the wiper cleaner 3046 reciprocates in the front-rear direction to remove the ink adhering to each of the wipers 3041 and 3841.

Figure 63F:
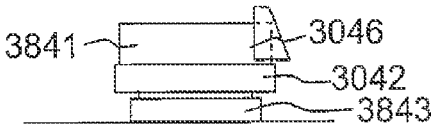
Figure 63G:
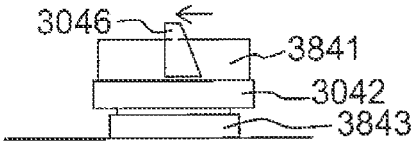
Figure 64A:
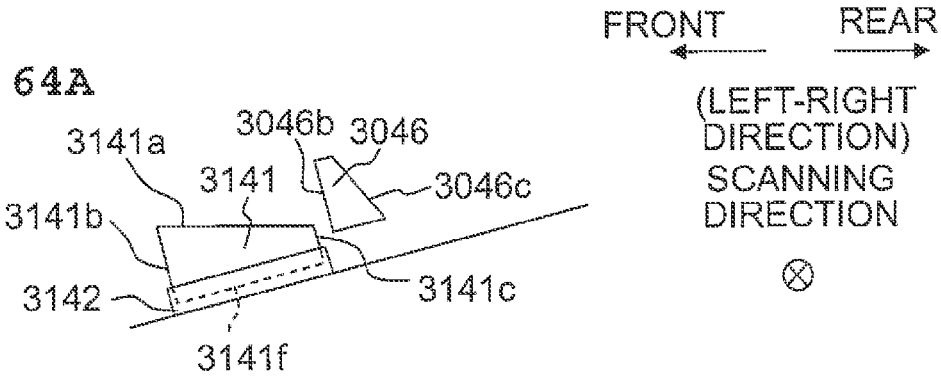
FIGS. 64A to 64D are illustrative views each illustrating an operation of an ink-jet printer according to a modified embodiment of the fifth and sixth embodiments.
Figure 64B:
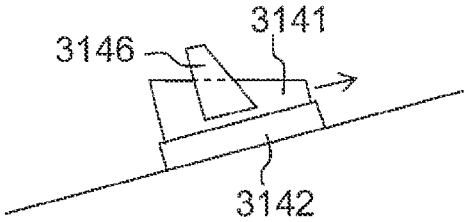
Figure 64C:
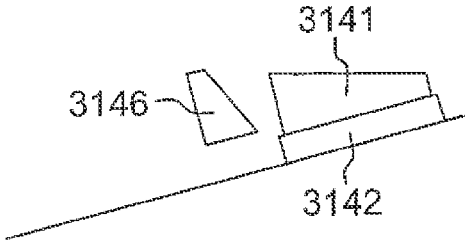
Figure 64D:
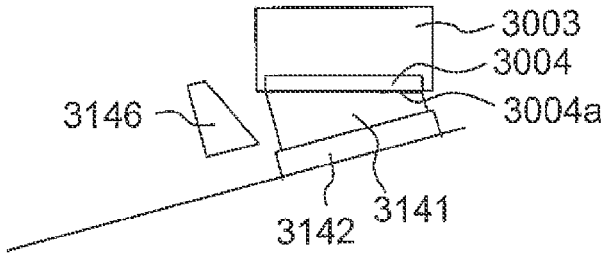

In the fourth to sixth embodiments, each of the wipers 3041, 3141, and 3241 passes through the slit 3046*a* when moving toward either side in the front-rear direction. However, as depicted in FIG. 63F, the wiper 3841 may not pass through the slit 3046*a* when moving relative to the wiper cleaner 3046 toward any one side in the front-rear direction. In this modified embodiment, an upper end 3841*a* of the wiper 3841 may extend to an end (the rear end of the wiper 3841 in FIG. 63F) which is farther away from the wiper cleaner 3046 when the wiper 3841 is in the wiping position. A surface (the front surface of the wiper cleaner 3046 in FIG. 63F), of the front and rear surfaces of the wiper cleaner 3046, which is farther away from the wiper 3841 when the wiper 3841 is in the wiping position may be orthogonal to the front-rear direction, regardless of the shape of the wiper.

In the fifth embodiment, the wiper movement mechanism 3143 moves the wiper 3141 in the front-rear direction so that the tilt of the wiper 3141 is changed only in the center of the movement area of the wiper 3141. The wiper movement mechanism 3143, however, may move the wiper 3141 in the front-rear direction so that the tilt of the wiper 3141 is changed over the entire movement area of the wiper 3141. For example, the wiper 3141 may swing around an axis which extends in the scanning direction on the upper side of the wiper cleaner 3046.

For example, as depicted in FIGS. 64A to 64D, the wiper 3141 having the same shape as those of the fifth and sixth embodiments may be disposed so that the inclined end 3141*a* is parallel to the ink discharge surface 4*a*. Then, the wiper 3141 may move relative to the wiper cleaner 3046 linearly and substantially parallelly to the terminal end 3141*f* of the wiper 3141. In this modified embodiment, the wiper cleaner 3046 is preferably disposed so that the rear surface 3046*c* is inclined to the front end 3141*b* and the rear end 3141*c* of the wiper 3141 and that the front surface 3046*b* is parallel to the front end 3141*b* and the rear end 3141*c* of the wiper 3141.

In the fourth to sixth embodiments, each of the wipers 3041, 3141, and 3241 is disposed so that the longitudinal direction thereof is the direction (front-rear direction) parallel to the ink discharge surface 4*a* and orthogonal to the scanning direction. The longitudinal direction of the wiper, however, may be any direction, provided that the longitudinal direction of the wiper intersects with both of the direction (up-down direction) orthogonal to the ink discharge surface 4*a* and the scanning direction.

In the fourth to sixth embodiments, each of the wipers 3041, 3141, and 3241 is formed to extend vertically upward from one of the terminal ends 3041*f*, 3141*f*, and 3241*f*. Each of the wipers 3041, 3141, and 3241, however, may be formed to be inclined to the up-down direction.

In the fourth to sixth embodiments, the ink-jet head 4 moves leftward to wipe the ink discharge surface 4*a* with the right surface 3041*s*1 of the wiper 3041. The ink-jet head 4, however, may move rightward to wipe the ink discharge surface 4*a* with the left surface 3041*s*2 of the wiper 3041. Alternatively, the ink-jet head 4 may reciprocate in the left-right direction to wipe the ink discharge surface 4*a* with the right and left surfaces 3041*s*1 and 3041*s*2 of the wiper 3041 in a state that the wiper 3041 is in the wiping position.

In the fourth to sixth embodiments, the ink-jet head 4 and the carriage 3 move in the scanning direction to wipe the ink discharge surface 4*a* with the wiper 3041. However, the following configuration is also allowable. That is, the wiper 3041 is caused to move relative to the ink-jet head 4 by a suitable means, such as a motor, thereby wiping the ink discharge surface 4*a*.

The wiping direction of the wiper 3041 (the movement direction relative to the ink discharge surface 4*a*) is not limited to the direction away from the platen 2. For example, the wiper 3041 may move in the direction close to the platen 2, or the wiper 3041 may be disposed in the direction intersecting with the sheet conveyance direction to move in the sheet conveyance direction.

The timing at which the wiper 3041 wipes off the ink adhering to the ink discharge surface 4*a* is not limited to the timing after the suction purge which is an exemplary timing in the above embodiments. For example, the wiper 3041 may wipe off the ink after printing is performed by discharging the ink onto the recording sheet P.

In the embodiments and the modified embodiments as described above, the present teaching is applied to an ink discharge apparatus, such as the ink-jet printer, which discharges ink on a recording sheet to print an image etc. The present teaching, however, can be also applied to a liquid jetting apparatus used in various uses other than the printing of the image etc. For example, the present teaching can be also applied to a liquid jetting apparatus which jets a conductive liquid on a board to form a conductive pattern on the surface of the board.

What is claimed is:

1. A liquid discharge apparatus configured to discharge a liquid, comprising:

a liquid discharge head having a liquid discharge surface formed with liquid discharge ports from which the liquid is discharged;

a wiper configured to move relative to the liquid discharge head in a first direction, the wiper including:

a first surface; and a second surface;

the wiper being configured to wipe the liquid discharge surface with the first surface;

a wiper cleaner configured to clean the liquid adhering to the first surface of the wiper and including:

a first contact part, which is configured to make contact with the first surface of the wiper; and a second contact part, which is disposed to face the first contact part and is configured to make contact with the second surface of the wiper;

a movement mechanism configured to move the wiper and the wiper cleaner relative to each other in a third direction, which intersects with the first direction and a second direction orthogonal to the liquid discharge surface; and a space expansion part configured to expand a space between the first contact part and the second contact part;

the space expansion part being configured to move integrally with the wiper relative to the wiper cleaner; the space expansion part being disposed on at least one side, of the wiper, in the third direction;

the space expansion part having rigidity higher than that of the wiper; and the space expansion part being configured to be inserted first into a space between the first contact part and the second contact part to expand the space, in the case that the wiper and the wiper cleaner move relative to each other in the third direction.

2. The liquid discharge apparatus according to claim 1;

wherein a distance between the first contact part and the second contact part in the first direction is not more than a length of the wiper in the first direction.

3. The liquid discharge apparatus according to claim 2;

wherein a length of the space expansion part in the first direction is longer than the length of the wiper in the first direction.

4. The liquid discharge apparatus according to claim 3;

wherein the space expansion part includes two space expansion parts disposed on both sides, of the wiper, in the third direction.

5. The liquid discharge apparatus according to claim 4;

wherein the two space expansion parts are formed of a first space expansion part and a second space expansion part, the first space expansion part being disposed to be inserted first into the space between the first contact part and the second contact part after the liquid discharge surface is wiped with the wiper, the second space expansion part being disposed on a side, of the wiper, opposite to the first space expansion part in the third direction; and wherein a length of the second space expansion part in the third direction is shorter than a length of the first contact part in the third direction and a length of the first space expansion part in the third direction.

6. The liquid discharge apparatus according to claim 2;
wherein the space expansion part is disposed to face, in the third direction, an end of the wiper in the third direction.

7. The liquid discharge apparatus according to claim 6, further comprising:
a wiper holder configured to hold an end, of the wiper, on a side opposite to the liquid discharge surface in the second direction;
wherein a length of the space expansion part in the second direction is shorter than a length, of the wiper in the second direction, ranging from the end on the side opposite to the liquid discharge surface in the second direction to an upper end, in a state that the wiper is not brought into contact with the liquid discharge surface; and
wherein the space expansion part is separated from the liquid discharge surface in the second direction, in a case that the wiper is brought into contact with the liquid discharge surface.

8. The liquid discharge apparatus according to claim 6, further comprising:
a wiper holder configured to hold an end, of the wiper, on a side opposite to the liquid discharge surface in the second direction;
wherein a length of the space expansion part in the second direction is not less than a length, of the wiper in the second direction, ranging from the end on the side opposite to the liquid discharge surface in the second direction to an upper end, in a state that the wiper is not brought into contact with the liquid discharge surface; and
wherein a length of the wiper in the third direction is longer than a length of the liquid discharge surface in the third direction.

9. The liquid discharge apparatus according to claim 2;
wherein an end, of the space expansion part, on a side opposite to the wiper in the third direction is formed to be tapered in a direction away from the wiper in the third direction.

10. The liquid discharge apparatus according to claim 1;
wherein the second contact part is made of an absorber absorbing the liquid.

11. The liquid discharge apparatus according to claim 10, further comprising:
a cleaner holder configured to fix both ends of the wiper cleaner in the first direction;
wherein the wiper cleaner is configured to be deformed and bent in the third direction with the both ends of the wiper cleaner in the first direction as fulcrums, in a case that the space expansion part is inserted into the space of the wiper cleaner.

12. The liquid discharge apparatus according to claim 11;
wherein the cleaner holder includes:
a first wall being positioned on a side close to the wiper in a case that the wiper wipes the liquid discharge surface; and
a second wall being positioned on a side opposite to the first wall in the third direction;
wherein the first wall includes a first notch through which the space of the wiper cleaner is exposed;
wherein the second wall includes a second notch through which the space of the wiper cleaner is exposed; and
wherein a length of the second notch in the first direction is shorter than a length of the first notch in the first direction.

13. A liquid discharge apparatus configured to discharge a liquid, comprising:
a liquid discharge head having a liquid discharge surface formed with liquid discharge ports from which the liquid is discharged;
a wiper configured to move relative to the liquid discharge head in a first direction, the wiper including:
a first surface; and
a second surface;
the wiper being configured to wipe the liquid discharge surface with the first surface;
a wiper cleaner configured to clean the liquid adhering to the first surface of the wiper, the wiper cleaner including:
a first contact part, which is made of an absorber absorbing the liquid and is configured to make contact with the first surface of the wiper; and
a second contact part, which is disposed to face the first contact part and is configured to make contact with the second surface of the wiper;
a wiper holder holding an end, of the wiper, on a side opposite to the liquid discharge surface in the second direction; and
a movement mechanism configured to move the wiper and the wiper cleaner relative to each other in a third direction, which intersects with the first direction and a second direction orthogonal to the liquid discharge surface;
wherein one end of the wiper in the third direction is parallel to the second direction;
wherein one end of the wiper cleaner in the third direction is inclined so that one side, in the second direction, of the one end of the wiper cleaner is more projected in the third direction than the other side, in the second direction, of the one end of the wiper cleaner, the one side of the one end of the wiper cleaner being a near side close to the wiper holder, and the other side of the one end of the wiper cleaner being a far side farther from the wiper holder; and
wherein the one end of the wiper in the third direction is inserted into a space, in the one end of the wiper cleaner in the third direction, between the first contact part and the second contact part to expand the space, in the case that the wiper and the wiper cleaner move relative to each other in the third direction.

14. The liquid discharge apparatus according to claim 13;
wherein an end, of the wiper, on at least one side in the third direction has rigidity higher than that of any other part of the wiper; and
wherein the wiper is configured such that the end on the at least one side in the third direction is inserted first into the space between the first contact part and the second contact part to expand the space, in the case that the wiper and the wiper cleaner move relative to each other in the third direction.

15. The liquid discharge apparatus according to claim 13;
wherein the wiper includes an upper end on a side close to the liquid discharge surface, a terminal end which is farthest from the upper end in the second direction perpendicular to the liquid discharge surface, and an intermediate part between the upper end and the terminal end; and
wherein the wiper is configured so that the intermediate part is inserted first into the space between the first contact part and the second contact part in the case that the wiper and the wiper cleaner move relative to each other in the third direction.

16. The liquid discharge apparatus according to claim 13;

wherein the other end of the wiper cleaner in the third direction is inclined so that one side of the other end of the wiper cleaner in the second direction is more projected in the third direction than the other side of the other end of the wiper cleaner in the second direction;

wherein the other end of the wiper in the third direction is parallel to the second direction; and wherein the other end of the wiper in the third direction is inserted into a space, in the other end of the wiper cleaner in the third direction, between the first contact part and the second contact part to expand the space, in the case that the wiper and the wiper cleaner move relative to each other in the third direction.

17. The liquid discharge apparatus according to claim 13;

wherein the other end of the wiper cleaner is parallel to the second direction;

wherein one end, in the second direction, of the other end of the wiper in the third direction is chamfered; and wherein the other end of the wiper in the third direction is inserted into a space, in the other end of the wiper cleaner in the third direction, between the first contact part and the second contact part to expand the space, in the case that the wiper and the wiper cleaner move relative to each other in the third direction.

18. A liquid discharge apparatus configured to discharge a liquid, comprising:

a liquid discharge head having a liquid discharge surface formed with liquid discharge ports from which the liquid is discharged;

a wiper configured to move relative to the liquid discharge head in a first direction, the wiper including:

a first surface; and a second surface;

the wiper being configured to wipe the liquid discharge surface with the first surface;

a wiper cleaner configured to clean the liquid adhering to the first surface of the wiper, the wiper including:

a first contact part, which is made of an absorber absorbing the liquid and is configured to make contact with the first surface of the wiper; and a second contact part, which is disposed to face the first contact part and is configured to make contact with the second surface of the wiper;

a movement mechanism configured to move the wiper and the wiper cleaner relative to each other in a third direction, which intersects with the first direction and a second direction orthogonal to the liquid discharge surface; and a wiper guide configured to reduce deformation of the wiper in a case that the wiper is inserted into a space between the first contact part and the second contact part, thereby allowing the wiper to pass through the space easily;

wherein the wiper guide is disposed on one side of the wiper cleaner in the third direction;

wherein the wiper guide is separated from the wiper; and wherein the wiper guide is located at a position at which a distance from the wiper guide to the wiper cleaner is less than a length of the wiper in the third direction.

19. The liquid discharge apparatus according to claim 18;

wherein the wiper includes:

an upper end on a side close to the liquid discharge surface; and a terminal end on a side opposite to the upper end in the second direction perpendicular to the liquid discharge surface; and wherein the wiper guide includes a first guide piece facing the first surface of the wiper and a second guide piece facing the second surface of the wiper, and is configured to be positioned on both sides of the wiper so as to regulate deformation of the wiper in the case that the wiper is inserted into the space between the first contact part and the second contact part.

20. The liquid discharge apparatus according to claim 19;

wherein a distance between the first guide piece and the second guide piece in the first direction is longer than a length of the wiper in the first direction; and wherein the first surface of the wiper is separated from the first guide piece in the first direction and the second surface of the wiper is separated from the second guide piece in the first direction, in a state that the wiper is not brought into contact with the wiper cleaner.

* * * * *